US009040803B2

(12) United States Patent
Wieder

(10) Patent No.: US 9,040,803 B2
(45) **Date of Patent: *May 26, 2015**

(54) MUSIC AND SOUND THAT VARIES FROM ONE PLAYBACK TO ANOTHER PLAYBACK

(71) Applicant: James W. Wieder, Ellicott City, MD (US)

(72) Inventor: James W. Wieder, Ellicott City, MD (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/941,618

(22) Filed: Jul. 15, 2013

(65) Prior Publication Data

US 2014/0190335 A1 Jul. 10, 2014

Related U.S. Application Data

(63) Continuation of application No. 12/783,745, filed on May 20, 2010, now Pat. No. 8,487,176, which is a continuation-in-part of application No. 11/945,391, filed on Nov. 27, 2007, now Pat. No. 7,732,697, which (Continued)

(51) Int. Cl.

| | |
|---|---|
| ***G10H 7/00*** | (2006.01) |
| ***G10H 1/00*** | (2006.01) |
| *H04R 5/04* | (2006.01) |

(52) U.S. Cl.

CPC ..... *G10H 7/00* (2013.01); *G10H 1/0025* (2013.01); *G10H 1/0041* (2013.01); *G10H 2210/141* (2013.01); *G10H 2240/131* (2013.01); *H04R 5/04* (2013.01)

(58) Field of Classification Search

USPC ..... 84/600–602, 615, 653
IPC ..... G10H 7/00
See application file for complete search history.

(56) References Cited

U.S. PATENT DOCUMENTS

| | | | | | |
|---|---|---|---|---|---|
| 4,729,044 | A | * | 3/1988 | Kiesel | 386/281 |
| 4,787,073 | A | * | 11/1988 | Masaki | 369/178.01 |
| 5,281,754 | A | * | 1/1994 | Farrett et al. | 84/609 |
| 5,315,057 | A | * | 5/1994 | Land et al. | 84/601 |

(Continued)

OTHER PUBLICATIONS

"32 & 16 Years Ago (Jul. 1991)"; Neville Holmes (editor); IEEE Computer; Jul. 2007; p. 9.

(Continued)

*Primary Examiner* — David Warren
(74) *Attorney, Agent, or Firm* — James W. Wieder

(57) ABSTRACT

A method and apparatus for the creation and playback of music and/or sound, so that sound sequences are generated that vary from one playback to another playback. In one embodiment, during composition creation, artist(s) may define how the composition may vary from playback to playback using visually interactive display(s). The artist's definition may be embedded into a composition dataset. During playback, a composition data set may be processed by a playback device and/or a playback program, so that each time the composition is played-back a unique version may be generated. Variability during playback may include: the variable selection of alternative sound segment(s); variable editing of sound segment(s) during playback processing; variable placement of sound segment(s) during playback processing; the spawning of group(s) of alternative sound segments from initiating sound segment(s); and the combining and/or mixing of alternative sound segments in one or more sound channels. MIDI-like variable compositions and the variable use of sound segments comprised of a timed sequence of MIDI-like commands are also disclosed.

25 Claims, 31 Drawing Sheets

Related U.S. Application Data is a continuation-in-part of application No. 10/654,000, filed on Sep. 4, 2003, now Pat. No. 7,319,185, which is a continuation-in-part of application No. 10/012,732, filed on Nov. 6, 2001, now Pat. No. 6,683,241.

(56) References Cited

U.S. PATENT DOCUMENTS

| | | | | |
|---|---|---|---|---|
| 5,350,880 | A * | 9/1994 | Sato | 84/609 |
| 5,496,962 | A * | 3/1996 | Meier et al. | 84/601 |
| 5,663,517 | A * | 9/1997 | Oppenheim | 84/649 |
| 5,693,902 | A * | 12/1997 | Hufford et al. | 84/650 |
| 5,728,962 | A | 3/1998 | Goede | |
| 5,808,222 | A | 9/1998 | Yang | |
| 5,952,598 | A * | 9/1999 | Goede | 84/609 |
| 5,973,255 | A * | 10/1999 | Tanji | 84/636 |
| 5,990,407 | A | 11/1999 | Gannon | |
| 6,051,770 | A * | 4/2000 | Milburn et al. | 84/611 |
| 6,093,880 | A | 7/2000 | Arnalds | |
| 6,121,533 | A * | 9/2000 | Kay | 84/616 |
| 6,150,598 | A | 11/2000 | Suzuki et al. | |
| 6,153,821 | A | 11/2000 | Fay et al. | |
| 6,169,242 | B1 | 1/2001 | Fay et al. | |
| 6,215,059 | B1 * | 4/2001 | Rauchi et al. | 84/611 |
| 6,230,140 | B1 | 5/2001 | Severson | |
| 6,255,576 | B1 | 7/2001 | Suzuki et al. | |
| 6,281,420 | B1 | 8/2001 | Suzuki et al. | |
| 6,281,421 | B1 | 8/2001 | Kawaguchi | |
| 6,313,388 | B1 | 11/2001 | Suzuki | |
| 6,316,710 | B1 | 11/2001 | Lindemann | |
| 6,320,111 | B1 | 11/2001 | Kizaki | |
| 6,362,409 | B1 | 3/2002 | Gadre | |
| 6,410,837 | B2 * | 6/2002 | Tsutsumi | 84/604 |
| 6,433,266 | B1 * | 8/2002 | Fay et al. | 84/609 |
| 6,448,485 | B1 | 9/2002 | Barile | |
| 6,609,096 | B1 * | 8/2003 | De Bonet et al. | 704/500 |
| 6,683,241 | B2 * | 1/2004 | Wieder | 84/609 |
| 6,686,531 | B1 | 2/2004 | Pennock et al. | |
| 7,078,607 | B2 * | 7/2006 | Alferness | 84/609 |
| 7,319,185 | B1 * | 1/2008 | Wieder | 84/609 |
| 7,696,426 | B2 | 4/2010 | Cope | |
| 7,732,697 | B1 * | 6/2010 | Wieder | 84/609 |
| 8,487,176 | B1 | 7/2013 | Wieder | |
| 2001/0039872 | A1 * | 11/2001 | Cliff | 84/609 |
| 2002/0166440 | A1 * | 11/2002 | Herberger et al. | 84/625 |
| 2003/0159566 | A1 * | 8/2003 | Sater et al. | 84/615 |
| 2003/0174845 | A1 | 9/2003 | Hagiwara | |
| 2004/0112202 | A1 * | 6/2004 | Smith et al. | 84/609 |
| 2005/0174923 | A1 | 8/2005 | Bridges | |
| 2008/0141850 | A1 | 6/2008 | Cope | |

OTHER PUBLICATIONS

"Recombinant Music"; David Cope; IEEE Computer; Jul. 1991; pp. 22-28.

"Algorithms for Musical Composition: A Question of Granularity"; Steven Smoliar; IEEE Computer; Jul. 1991; pp. 54-56.

"Computer-Generated Music"; Dennis Baggi; IEEE Computer; Jul. 1991; pp. 6-9.

"Beatles Music, Reimagined with Love"; Wall Street Journal; Nov. 11, 2006, p. D10.

Longplayer description from website "longplayer.org" (4 pages).

"Musikalisches Wurfelspiel (Musical dice game)" from Wikipedia.org—Printout from Internet at http://en.wikipedia.org// wiki/Musikalisches_Würfelspiel.

"Mozart's Musikalisches Würfelspiel (Musical dice game)"; Printout from Internet at http://sunsite.univie.ac.at/Mozart/dice/.

"Mozart Dice Game"; Printout from Internet at http://jmusic.ci.qut.edu.au/jmtutorial/MozartDiceGame.html.

"Mozart—Musical Game in C K. 516f"; Printout from Internet at http://www.asahi-net.or.jp/~rb5h-ngc/e/k516f.htm.

"Music of Changes"; Printout from Internet at http://en.wikipedia.org/wiki/Music_of_Changes.

"Aleatoric music"; Printout from Internet at http://en.wikipedia.org/wiki/Aleatoric_music.

"Generative music"; Printout from Internet at http://en.wikipedia.org/wiki/Generative_music.

* cited by examiner

Legend:

△ = Spawning Location.

↑ = Spawns

Figure 9.

90a

| Track Usage List (Channel 1): | | | | | |
|---|---|---|---|---|---|
| Track # | Last sample # placed | sample 1 | sample 2 | sample 3 | ..... |
| 1 | | | | | |
| 2 | | | | | |
| 3 | | | | | |
| ..... | | | | | |

90b

| Track Usage List (Channel 2): | | | | | |
|---|---|---|---|---|---|
| Track # | Last sample # placed | sample 1 | sample 2 | sample 3 | ..... |
| 1 | | | | | |
| 2 | | | | | |
| 3 | | | | | |
| ..... | | | | | |

Channel 1 (Stereo-Right) Rate Smoothing Memory
91a

Channel 2 (Stereo-Left) Rate Smoothing Memory
91b

92

| Spawn List: | | |
|---|---|---|
| Spawned into channel number | Spawning Location | Pointer to Spawned Group |
| | | |
| | | |
| | | |
| | | |

Fig. 17A

| Disadvantage | Overcome by |
|---|---|
| Composition definition is larger to store and download. | Storage & bandwidth cost decreasing at > 1.5x per year. |
| Requires more processing. | Processing costs decreasing by 1.5x per year. |
| Greater start-up delay. | Pipeline playback. Use faster processor. |
| Data is more sensitive to storage or bandwidth errors. | Sensitivity is similar to software. Use Error correction. |
| More effort for artists to create a composition. | Use visually driven composition creation software. |
| Artist's snippets could be used by others without authorization. | Use encryption. |
| | |

Fig. 17B

| Growth at 50% per year: | |
|---|---|
| Years | Amount of Improvement |
| 4 | 5 |
| 8 | 25 |
| 12 | 125 |
| 16 | 625 |
| 20 | 3125 |
| 24 | 15625 |

Legend:

q = Segment q q + r = Segment (combination of q and r)

Figure 23

| | | | | | | |
|---|---|---|---|---|---|---|
| 60a | 60a+ 61b | 60a+61b+69a | 60a | 60a+62a | 60a+62a | 60a |
| 60a | 60a+ 61b | 60a+61b+69a | 60a | 60a+62b | 60a+62b | 60a |
| 60a | 60a+ 61b | 60a+61b+69a | 60a | 60a+62c | 60a+62c | 60a |

| | | | | | | |
|---|---|---|---|---|---|---|
| 60a | 60a+ 61b | 60a+61b+69b | 60a | 60a+62a | 60a+62a | 60a |
| 60a | 60a+ 61b | 60a+61b+69b | 60a | 60a+62b | 60a+62b | 60a |
| 60a | 60a+ 61b | 60a+61b+69b | 60a | 60a+62c | 60a+62c | 60a |

| | | | | | |
|---|---|---|---|---|---|
| 60a | 60a+ 61a | 60a+61a+63a | 60a+62a+63a | 60a+62a | 60a |
| 60a | 60a+ 61a | 60a+61a+63a | 60a+62a+63b | 60a+62a | 60a |
| 60a | 60a+ 61a | 60a+61a+63a | 60a+62a+63c | 60a+62a | 60a |

| | | | | | |
|---|---|---|---|---|---|
| 60a | 60a+ 61a | 60a+61a+63b | 60a+63b+62a | 60a+62b | 60a |
| 60a | 60a+ 61a | 60a+61a+63b | 60a+63b+62b | 60a+62b | 60a |
| 60a | 60a+ 61a | 60a+61a+63b | 60a+63b+62c | 60a+62b | 60a |

| | | | | | |
|---|---|---|---|---|---|
| 60a | 60a+ 61a | 60a+61a+63c | 60a+63c+62a | 60a+62c | 60a |
| 60a | 60a+ 61a | 60a+61a+63c | 60a+63c+62b | 60a+62c | 60a |
| 60a | 60a+ 61a | 60a+61a+63c | 60a+63c+62c | 60a+62c | 60a |

Figure 24
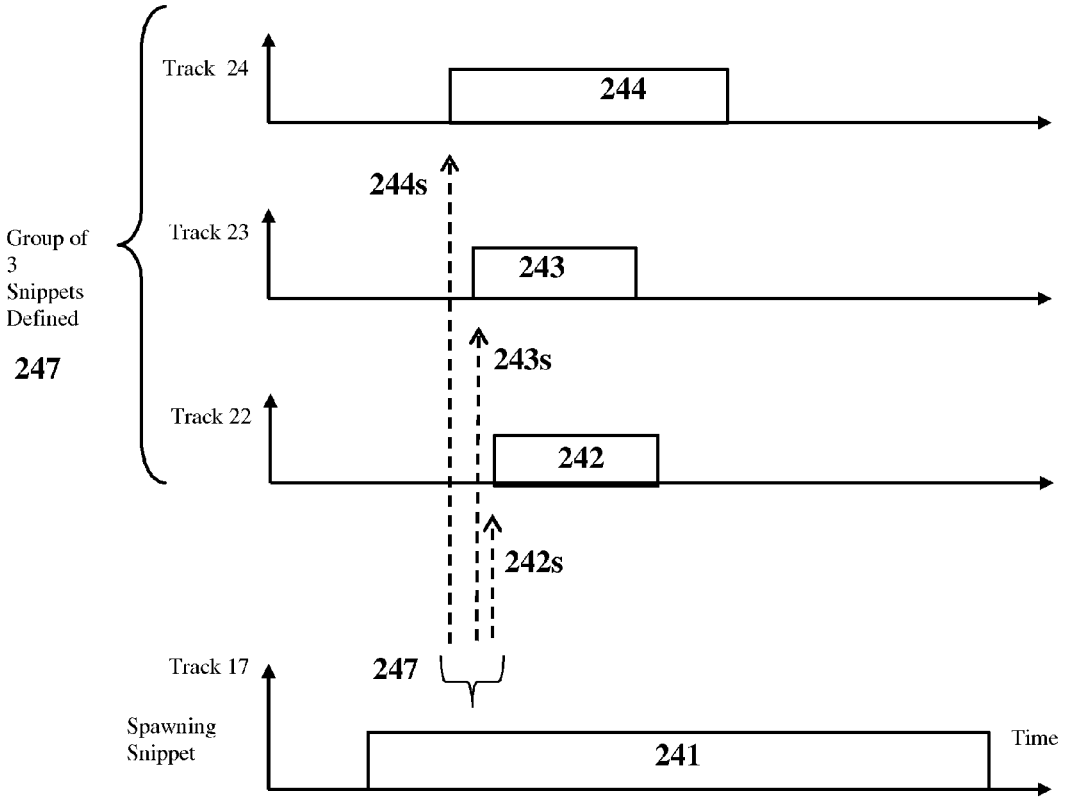
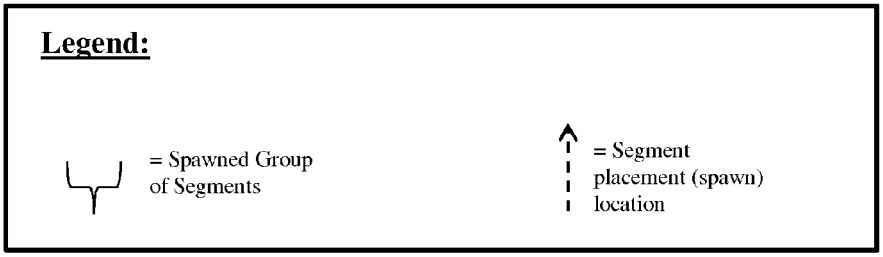

Figure 27
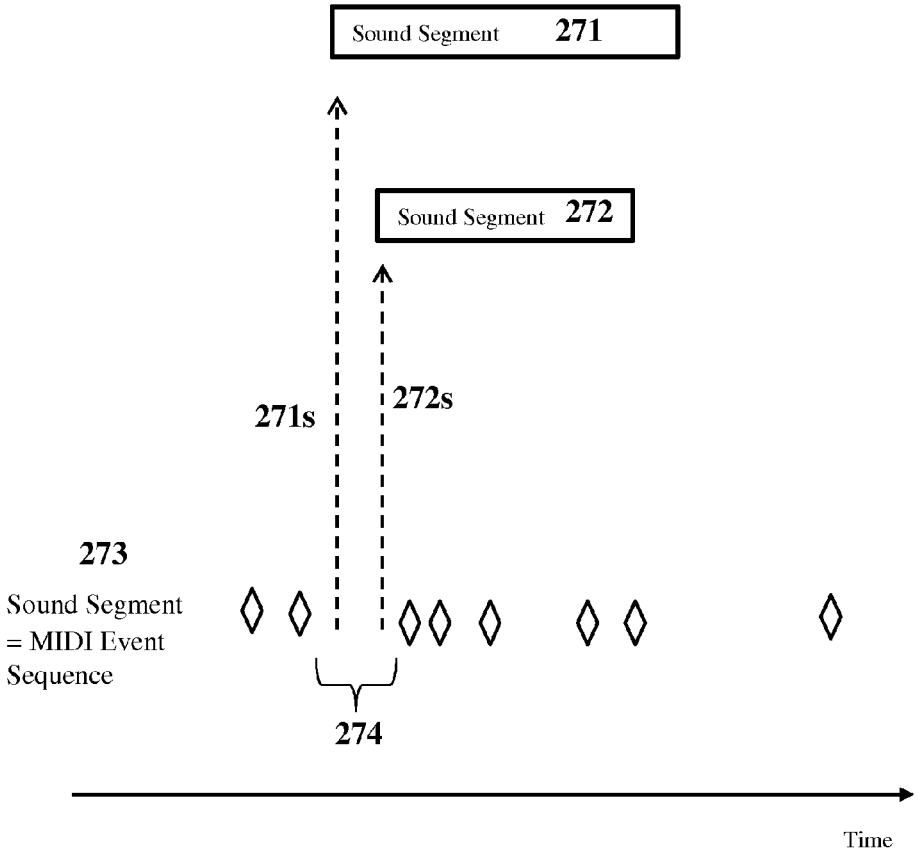
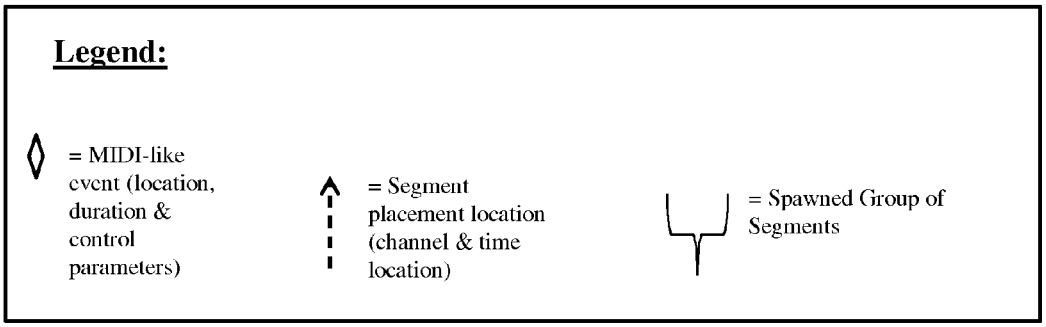

MUSIC AND SOUND THAT VARIES FROM ONE PLAYBACK TO ANOTHER PLAYBACK

CROSS REFERENCE TO RELATED APPLICATIONS

This application is a continuation of U.S. application Ser. No. 12/783,745, filed May 20, 2010, entitled "Music and Sound that Varies from one Playback to another Playback"; which is continuation-in-part of U.S. application Ser. No. 11/945,391, filed Nov. 27, 2007, entitled "Creating Music and Sound that Varies from Playback to Playback" now U.S. Pat. No. 7,732,697; which is a continuation-in-part of U.S. application Ser. No. 10/654,000, filed Sep. 4, 2003, entitled "Pseudo-Live Music and Sound" now U.S. Pat. No. 7,319,185; which is a continuation-in-part of U.S. application Ser. No. 10/012,732, filed Nov. 6, 2001, entitled "Pseudo-Live Music and Audio" now U.S. Pat. No. 6,683,241. Each of these earlier applications, in their entirety, are incorporated herein by reference.

BACKGROUND OF INVENTION

Current methods for the creation and playback of recording-industry music are fixed and static. Each time an artist's composition is played back, it sounds essentially identical.

Since Thomas Edison's invention of the phonograph, much effort has been expended on improving the exactness of "static" recordings. Examples of static music in use today include the playback of music on records, analog and digital tapes, compact discs, DVD's and MP3. Common to all these approaches is that on playback, the listener is exposed to the same audio experience every time the composition is played.

A significant disadvantage of static music is that listeners strongly prefer the freshness of live performances. Static music falls significantly short compared with the experience of a live performance.

Another disadvantage of static music is that compositions often lose their emotional resonance and psychological freshness after being heard a certain number of times. The listener ultimately loses interest in the composition and eventually tries to avoid it, until a sufficient time has passed for it to again become psychologically interesting. To some listeners, continued exposure, could be considered to be offensive and a form of brainwashing. The number of times that a composition maintains its psychological freshness depends on the individual listener and the complexity of the composition. Generally, the greater the complexity of the composition, the longer it maintains its psychological freshness.

Another disadvantage of static music is that an artist's composition is limited to a single fixed and unchanging version. The artist is unable to incorporate spontaneous creative effects associated with live performances into their static compositions. This imposes is a significant limitation on the creativity of the artist compared with live music.

And finally, "variety is the spice of life". Nature such as sky, light, sounds, trees and flowers are continually changing through out the day and from day to day. Fundamentally, humans are not intended to hear the same identical thing again and again.

PRIOR ART EXAMPLES

The following are examples of prior art that have employed techniques to reduce the repetitiveness of music; sound; sound effects; and/or musical instruments.

During the 18th and 19th centuries, musical games called Musikalisches Wurfelspiel or musical dice games, were published in printed form and became popular throughout Western Europe. Examples include Joseph Haydn's "Philharmonic Joke"; Johann Kirnberger's "The Ever Ready Composer of Polonaises and Minutes" and Mozart's K. 516f. The published composition typically included musical notes printed on musical staves where alternative sections (e.g., measures/bars) were identified with letters/numbers. Written rules defined how the "human players" should select and combine (e.g., concatenate) the alternative sections with each other. To play the musical game, the "human players" would use dice or a spinning-top to manually select between the pre-defined alternatives to "create" a "new" composition that the players would then perform with their musical instrument(s). For example, one or more friends may roll the dice to make the selections between the pre-defined alternatives; while other friend(s) may then be challenged to perform the selected version in front of the group.

In the 20th/21th century, some of these "musical dice games" were implemented as programs on the computer. Typically, to create each "new" composition, the user manually enters numbers (e.g., seed values that generate the "dice rolls") via a computer input interface. Once the user has entered these input values and indicated "begin", the computer then automatically makes the selections and combines the selections to generate a "new" composition that corresponds to the user's input (e.g., the user's "dice rolls"). In some cases, the computer program may also generate the musical score/staves and/or a MIDI version of the "new" composition which may be then be played back by a hardware or software MIDI player (e.g, MIDI music player). A major limitation is that the user must manually input new values into the program each time the user wants to generate another "new" version. Only a single fixed (I.e., static) version may be generated for each set of user inputs.

U.S. Pat. No. 4,787,073 by Masaki describes a method for randomly selecting the playing order of the songs on one or more storage disks (e.g., compact disks). One disadvantage of Maski is that it is limited to randomly varying the order that the songs are played in. When a song is played it always sounds the same.

U.S. Pat. No. 5,350,880 by Sato describes a demo-mode (for a keyboard instrument) using a fixed sequence of "n" static versions. Each of the "n" versions are different from each other, but each individual version sounds exactly the same each time it is played and the "n" versions are always played in the same order. When the demo-mode is initiated the complete sequence of the "n" versions always sounds the same and this same sequence is repeated again and again (looped-on), until the listener switches the demo-mode "off". Basically, Sato has only increased the length of an unchanging, fixed sequence by "n", which is somewhat useful in reducing repetitiveness when looping in a musical instrument demo-mode. But, the listener is exposed to the same sound sequence (now "n" times longer) every time the demo is played and looped. Additional limitations include: 1) Unable to playback one version per play. 2) Does not end on it's own since user action is required to stop the looping. 3) Limited to a sequence of synthetically generated tones.

Another group of prior art deals with dynamically changing music in response to events and actions during interactive computer/video games. Examples are U.S. Pat. No. 5,315,057 by Land U.S. Pat. No. 6,153,821 by Fay. A major objective here is to coordinate different music to different game conditions and user actions. Using game-conditions and user actions to provide a real-time stimulus in-order to change the music played is a desirable feature for an interactive game. Some disadvantages of Land are: 1) It's not automatic since it requires user actions. 2) Requires real-time stimulus based on user actions and game conditions to generate the music 3) The variability is determined by the game conditions and user actions rather than by the artists definition of playback variability 4) The sound is generated by synthetic methods which are significantly inferior to humanly created musical compositions.

Another group of prior art deals with the creation and synthesis of music compositions automatically by computer or computer algorithm. An example is U.S. Pat. No. 5,496,962 by Meier, et al. A very significant disadvantage of this type approach is the reliance on a computer or algorithm that is somehow infused with the creative, emotional and psychological understanding equivalent to that of recording artists. A second disadvantage is that the artist has been removed from the process, without ultimate control over the creation that the listener experiences. Additional disadvantages include the use of synthetic means and the lack of artist participation and experimentation during the creation process.

Tsutsumi U.S. Pat. No. 6,410,837 discloses a remix apparatus/method (for keyboard type instrument) capable of generating new musical tone pattern data. It's not automatic, as it requires a significant amount of manual selection by the user. For each set of user selections only one fixed version is generated. Tsutsumi slices up a music composition into pieces (based on a template that the user manually selects), and then re-orders the sliced up pieces (based on another template the user selects). Chopping up a musical piece and then re-ordering it, will not provide a sufficiently pleasing result for sophisticated compositions. The limitations of Tsutsumi include: 1) It's not automatic since it requires a significant amount of user manual selection via control knobs; 2) For each set of user selections only one fixed version is generated; 3) Uses a simple re-ordering of segments that are sliced up from a single user selected source piece of music; 4) Limited to simple concatenation. One segment follows another; 5) No mixing of multiple tracks.

Kawaguchi U.S. Pat. No. 6,281,421 discloses a remix apparatus/method (for a keyboard instrument) capable of generating new musical tone pattern data. It's not automatic as it requires a significant amount of manual selection by the user. Some aspects of Kawaguchi use random selection to generate a varying playback, but these are limited to randomly selecting among the sliced segments of the original that have a defined length. The approach is similar to slicing up a composition into pieces, and then re-ordering the sliced up pieces randomly or partially randomly. This will not provide a sufficiently pleasing result with recording industry compositions or other complex applications. The amount of randomness is too large and the artist does not have enough control over the playback variability. The limitations of Kawaguchi include: 1) It's not automatic since it requires a significant amount of user manual selection via control knobs; 2) Uses a simple re-ordering of segments that are sliced up from a single user selected source piece of music; 3) Limited to simple concatenation. One segment follows another; 4) No mixing of multiple tracks.

Severson U.S. Pat. No. 6,230,140 describes method/apparatus for generating continuous sound effects. The sound segments are played back, one after another to form a long and continuous sound effect. Segments may be played back in random, statistical or logical order. Segments are defined so that the beginning of possible following segments will match with the ending of all possible previous segments. Some disadvantages of Severson include: 1) Due to excessive unpredictability in the selection of groups, artists have incomplete control of the playback timeline; 2) A simple concatenation is used, one segment follows another segment; 3) Concatenation only occurs at/near segment boundaries; 4) There is no mechanism to position and overlay segments finely in time; 5) No provision for the synchronized mixing of multiple tracks; 6) Since there is no output rate buffer, the concatenation result may vary on each playback with task complexity, processor speed, processor multi-tasking, etc; 7) No provision for multiple channels; 8) No provision for inter-channel dependency or complimentary effects between channels; 9) A sequence of the programmed instructions disclosed will not be compatible with multiple compositions; 10) A custom program must be created for each sound effect/application; 11) The user must take action to stop the sound from continuing indefinitely ("continuous sound").

The "Longplayer" (longplayer.org) is a 1000 year long piece of music. "Longplayer" utilizes a specific existing recorded piece of music as its source material and simultaneously plays 6 sections taken from it, each at a slightly different position and each at a different pitch. According to the longplayer.org web site, Longplayer uses "the same principle as taking six copies of a record and playing them on six turntables, each one rotating at a different speed". Longplayer is a "static" composition since it may sound the same each time it is started. Longplayer may repeat itself after a certain period of playback (e.g., >1000 years).

All of this prior art has significant disadvantages and limitations.

SUMMARY OF INVENTION

During composition creation, the artist's definition of how the composition may vary from playback to playback may be embedded into the composition data set. During playback, the composition data set may be automatically processed, without requiring listener action, by a playback program or playback device; so that each time the composition is played back a unique version may be generated.

A method and apparatus for the creation and playback of music and/or sound; such that each time a composition is played back, a different sound sequence may be generated. In one embodiment, during composition creation, artist(s) may define how the composition may vary from playback to playback using visually interactive display(s). The artist's definition may be embedded into a composition dataset. During playback, a composition data set may be processed by a playback device and/or a playback program, so that each time the composition is played-back a unique version may be generated. Variability during playback may include: the variable selection of alternative sound segment(s); variable editing of sound segment(s) during playback processing; variable placement of sound segment(s) during playback processing; the spawning of group(s) of alternative sound segments from initiating sound segment(s); and the combining and/or mixing of alternative sound segments in one or more sound channels. MIDI-like variable compositions and the variable use of sound segments comprised of MIDI-like command sequences are also disclosed.

There are many objects and advantages compared with the existing state of the art. The objects and advantages may vary with each embodiment. The objects and advantages of each of the various embodiments may include different subsets of the following objects and advantages:

Each time an artist's composition is played back, a unique musical version may be generated.

Does not require listener action, during playback, to obtain the variability and "aliveness".

Allows the artist to create a composition that more closely approximates live music.

Provides new creative dimensions to the artist via playback variability.

Allows the artist to use playback variability to increase the depth of the listener's experience.

Increases the psychological complexity of an artist's composition.

Allows listeners to experience psychological freshness over a greater number of playbacks. Listeners are less likely to become tired of a composition.

Playback variability may be used as a teaching tool (for example, learning a language or music appreciation).

The artist may control the nature of the "aliveness" in their creation. The composition may be embedded with the artist's definition of how the composition varies from playback to playback. (It's not randomly generated).

Artists create the composition through experimentation and creativity (It's not synthetically generated).

Allow the simultaneous advancement in different areas of expertise:

a) The creative use of playback variability by artists;

b) The advancement of the playback programs by technologists;

c) The advancement of the "variable composition" creation tools by technologists.

Allow the development costs of composition creation tools and playback programs to be amortized over a large number of variable compositions.

New and improved playback programs may be continually accommodated without impacting previously released pseudo-live compositions (i.e., allow backward compatibility).

Generate multiple channels of sound (e.g., stereo or quad). Artists may create complementary variability effects across multiple channels.

Compatible with the studio recording process and special effects editing used by today's recording industry.

Each composition definition may be digital data of fixed and known size in a known format.

The composition data and playback program may be stored and distributed on any digital storage mechanism (such as disk or memory) and may be broadcast or transmitted across networks (such as, airwaves, wireless networks or Internet).

Compositions may be played on a wide range of hardware and systems including dedicated players, portable devices, personal computers and web browsers.

Pseudo-live playback devices may be configured to playback both existing "static" compositions and pseudo-live compositions. This facilitates a gradual transition by the recording industry from "static" recordings to "pseudo-live" compositions.

Playback may adapt to characteristics of the listener's playback system (for example, number of speakers, stereo or quad system, etc).

The playback device may include a variability control, which may be adjusted from no variability (i.e., the fixed default version) to the full variability defined by the artist in the composition definition.

The playback device may be located near the listener or remotely from the listener across a network or broadcast medium.

The variable composition may be protected from listener piracy by locating the playback device remotely from the user across a network or communication path, so that the listeners may only have access to a different static version on each playback.

It is possible to optionally default to a fixed unchanging playback that is equivalent to the conventional static music playback.

Playback processing may be pipelined so that playback may begin before all the composition data has been downloaded or processed.

In an optional embodiment, the artist may also control the amount of variability as a function of elapsed calendar time since composition release (or the number of times the composition has been played back). For example, the artist may define, no or little variability following a composition's initial release, but increased variability after several months.

In some embodiments, artists may create and listeners experience, "living" compositions that may "creatively" vary from one playback to another playback. And thereby transcend the limitations of a fixed repetitive playback.

Those skilled in the art will recognize other objects and advantages.

Other Applications

Although the above discussion may be directed to the creation and playback of music; audio; and sound by artists, it may also be easily applied to any other type of variable composition such as sound; audio; sound effects; musical instruments; variable demo-modes for instruments; non-repetitive background sound; music videos; videos; multi-media creations; and variable MIDI-like compositions. Further objects and advantages of the various embodiments will become apparent from a consideration of the drawings and detailed description.

BRIEF DESCRIPTION OF DRAWINGS

FIG. 9 is shows details of working storage used by the playback program.

FIG. 17A lists the disadvantages of pseudo-live music versus static music, and shows how each of these disadvantages may be overcome.

FIG. 17B shows the amount of exponential improvement that will compound with a (assumed) 50% improvement per year.

FIG. 23 shows a group of pre-mixed alternative versions.

FIG. 24 shows the spawning of a group of segments where each segment has a unique placement location.

FIG. 27 shows the spawning of a group from a MIDI-type event sequence (MIDI-type sound segment).

DETAILED DESCRIPTION

Figure 1:
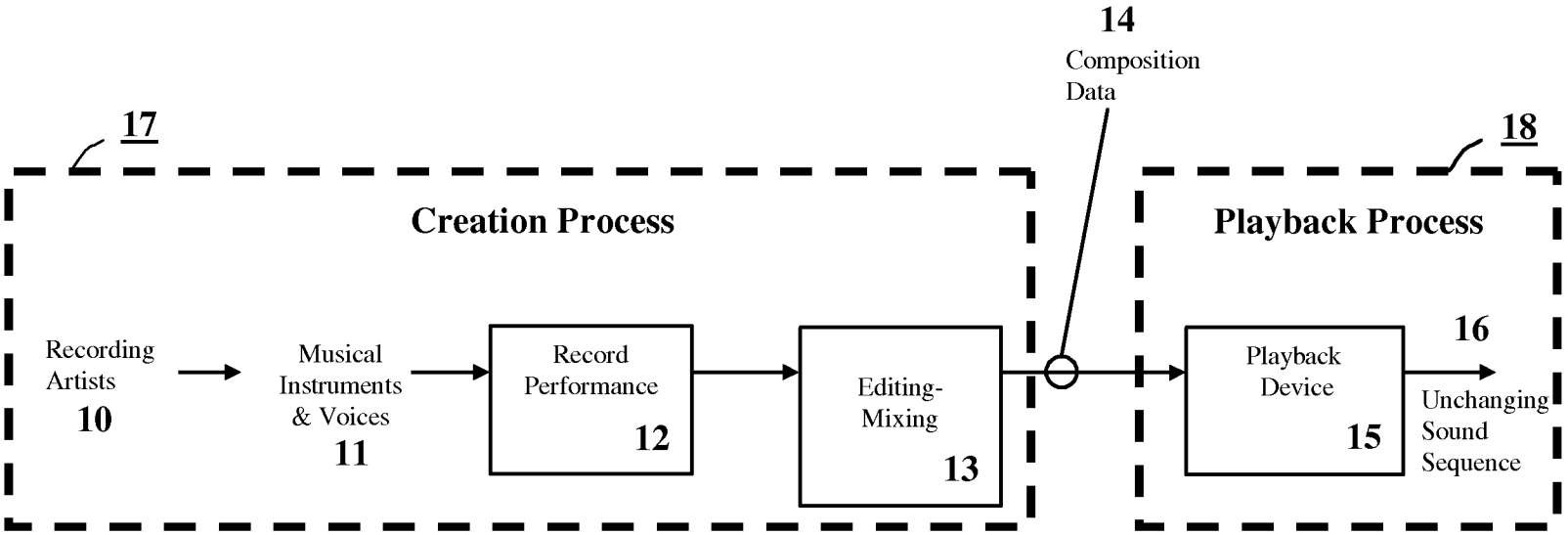
Figure 1. Prior Art
FIG. 1 is an overview of the composition creation and playback process for static music (prior-art).

Glossary of Terms:

The following definitions are intended to help a first-time reader to more quickly understand the illustrations and examples shown in the detailed embodiments. The complete specification contains additional embodiments and details that go beyond these simplified definitions provided for a first time reader. Hence, these definitions should not be used to limit of the scope to the understanding of a first-time reader or to the specific details of the detailed embodiments chosen for illustrative purposes.

Composition: An artist's definition of the sound sequence for a single song or a sound creation. A "static" composition generates the same sound sequence every playback. A pseudo-live (or variable) composition may generate a different sound sequence each time it is played back or initiated.

Channel: One of an audio system's output sound sequences. For example, for "stereo" there are two channels: stereo-right and stereo-left. Other examples include the four channels of quadraphonic-sound and the six channels of 5.1 surround-sound. In pseudo-live compositions, a channel may be generated during playback by variably selecting and combining alternative sound segments.

Track: Tracks may be used during both composition creation and composition playback. A track may have an associated memory for holding or storing sound segment(s). A track may represent or hold sound segment(s) that may be combined or mixed together to form new sound segments; new tracks; or output sound channels. For example, the sound from a single instrument or voice may be associated with a track. Alternatively, a combination/mix of many voices and/or instruments may be associated with a track. During creation, multiple tracks may also be mixed together and recorded as another track. During creation, many alternative sound segments may be created and stored as separate tracks. During playback processing, sound segments may be temporarily stored in (virtual) tracks to form the output channel(s).

Sound segment: A sound segment may have an analog or digital representation. In some embodiments, a sound segment may be represented by a sequence of digitally sampled sound samples. A sound segment may represent a time slice of one instrument or voice; or a time slice of many studio-mixed instruments and/or voices; or any other type of sounds. During playback, many sound segments may be combined together in alternative ways to form each channel. In some embodiments, a sound segment may also be defined by a sequence of MIDI-like commands that control one or more instruments that may generate the sound segment. In some embodiments, during playback, each MIDI-like segment (command sequence) may be converted to a digitally sampled sound segment before being combined with other sound segments. In some embodiments, some sound segments may initiate a variable selection of alternative sound segments during playback. MIDI-like segments may have the same initiation capabilities as other sound segments. In some embodiments, pointers/parameters may be used to identify the location/beginning of a sound segment and the segment's length/ending. For some compositions, only a fraction of all the sound segments in a composition data set may be used in any given playback.

Snippet: May be a sound segment or a sound segment which has other data associated with it. A snippet may also include (or have association with) one or more initiation definitions in-order to spawn other segments and/or group(s) of segments in the same channel or in other channels. A snippet may also include placement location(s). A snippet may also include (special-effects) edit variability parameters and placement variability parameters that are used to automatically variably edit a sound segment during playback processing. For some compositions, only a fraction of all the snippets in a composition data set may be used in any given playback.

Group: A definition of a set of one or more sound segments (or snippets). In some embodiments, one of the plurality of sound segments in a group may be selected during each specific playback. In other embodiments, a different subset of the plurality of segments in a group may be selected during each specific playback. In some embodiments, a segment selection method (that defines how a segment or segments in the group are selected whenever the group is processed during playback) may be associated with each group. In some embodiments, a group insertion location may be defined. For some compositions, a given group may or may not be used in any given playback.

Spawn: To initiate the processing of a specific group and the insertion of one or more of it's processed sound segments in a specified channel. Each snippet may spawn any number of groups that the artist defines. Spawning allows the artist to have complete control of the unfolding use of groups (e.g., alternative segments) in the composition playback.

Initiation (initiation/spawn definition): In some embodiments, initiating segments may be defined that may initiate the processing of a group(s) of sound segments whenever the initiating segment was used during a specific playback. In some embodiments, an initiation definition may include the insertion-time(s) or sample-number(s) where the group(s) or selected segment(s) are to be used during playback. In some embodiments, one or more initiation definitions may be associated with each initiating segment. Some segments may not initiate the use of other sound segments and hence may not have any initiation definitions associated with them.

Artist(s): Includes the artists, musicians, producers, recording and editing personnel and others involved in the creation of a composition.

Studio or In-the-Studio: Done by the artists and/or the creation tools during the composition creation process.

Existing Recording Industry Overview:

FIG. 1 is an overview of the music creation and playback currently used by today's recording industry (prior art). With this approach, the listener hears the same music every time the composition is played back. A "composition" refers to a single song, for example "Yesterday" by the Beatles. The music generated is fixed and unchanging from playback to playback.

As shown in FIG. 1, there is a creation process 17, which is under the artist's control, and a playback process 18. The output of the creation process 17 is composition data 14 that represents a music composition (i.e., a song). The composition data 14 represents a fixed sequence of sound that may sound the same every time a composition is played back.

The creation process may be divided into two basic parts, record performance 12 and editing-mixing 13. During record performance 12, the artists 10 perform a music composition (i.e., song) using multiple musical instruments and voices 11. The sound from of each instrument and voice is, typically, separately recorded onto one or more tracks. Multiple takes and partial takes may be recorded. Additional overdub tracks are often recorded in synchronization with the prior recorded tracks. A large number of tracks (24 or more) are often recorded.

The editing-mixing 13 includes editing and then mixing of the recorded tracks in the "studio". The editing includes the enhancing individual tracks using special effects such as frequency equalization, track amplitude normalization, noise compensation, echo, delay, reverb, fade, phasing, gated reverb, delayed reverb, phased reverb or amplitude effects. In mixing, the edited tracks are equalized and blended together, in a series of mixing steps, to fewer and fewer tracks. Ultimately stereo channels representing the final mix (e.g., the master) are created. All steps in the creation process are under the ultimate control of the artists. The master is a fixed sequence of data stored in time sequence. Copies for distribution in various media are then created from the master. The copies may be optimized for each distribution media (tapes, CD, etc) using storage/distribution optimization techniques such as noise reduction or compression (e.g., analog tapes), error correction or data compression.

During the playback process 18, the playback device 15 accesses the composition data 14 in time sequence and the storage/distribution optimization techniques (e.g., noise reduction, noise compression, error correction or data compression) are removed/performed. The composition data 14 is transformed into the same unchanging sound sequence 16 each time the composition is played back.

Figure 2:
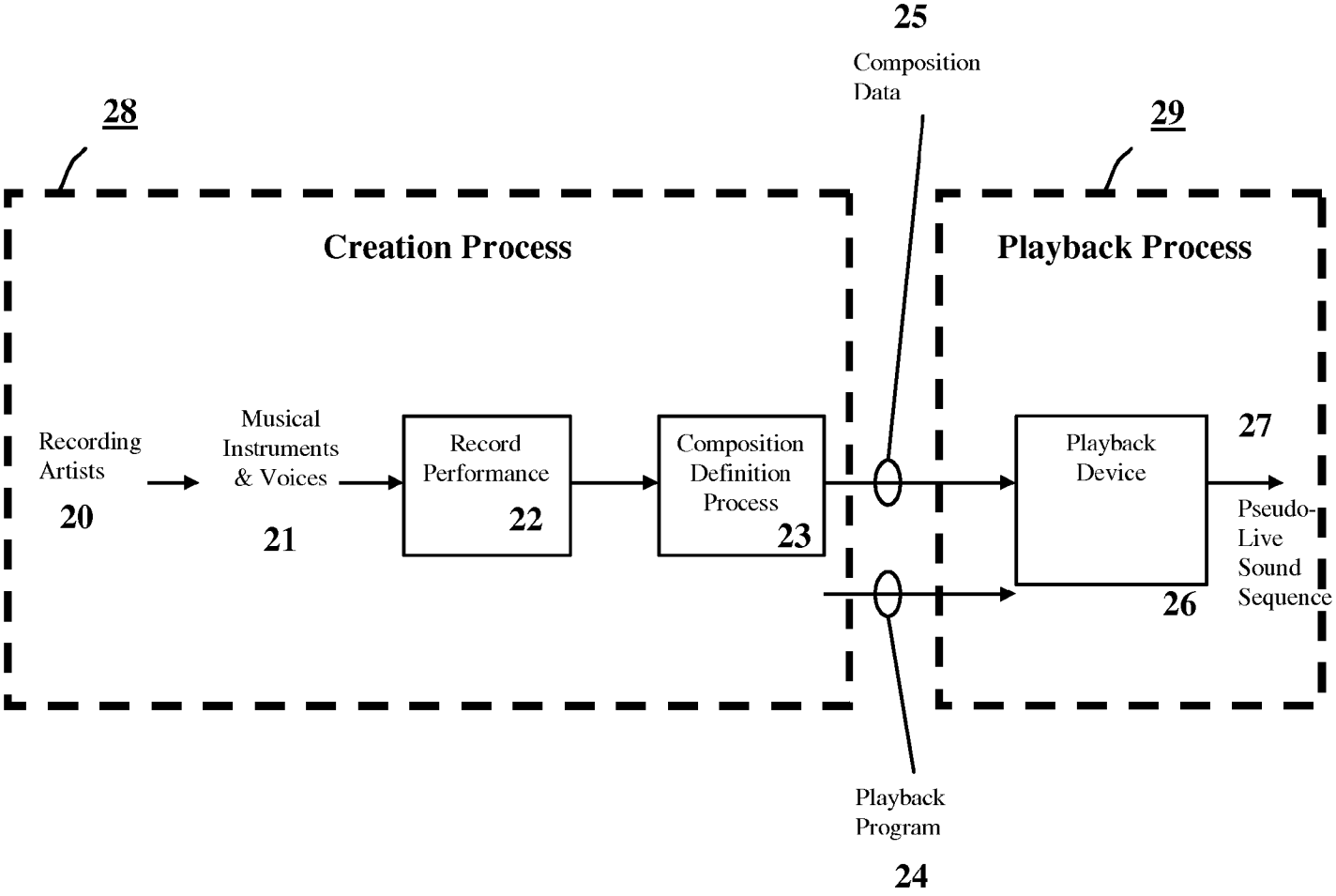
FIG. 2 is an overview of the composition creation and playback process for pseudo-live music and audio.

Overview of the Pseudo-Live Music & Audio Process:

FIG. 2 is an overview of the creation and playback of Pseudo-Live music and sound. In some embodiments, the listener may hear a different version each time a composition is played back. The music generated may change from one playback to another playback, by utilizing and/or combining sound segments in a different way during each playback, in the manner the artist defined. Some embodiments may allow the artist to have complete control over the playback variability that the listener experiences.

As shown in FIG. 2, there is a creation process 28 and a playback process 29. The output of the creation process 28 is a composition that may be comprised of the composition data 25 and a corresponding playback program 24. The composition data 25 contains the artist's definition of a pseudo-live composition (i.e., a song). The artist's definition of the variable usage of sound segments from playback to playback may be embedded in the composition data 25. Each time a playback occurs, the playback device 26 may execute the playback program 24 to process the composition data 25 such that a different pseudo-live sound sequence 27 may be generated. The artist may maintain control of the playback via information contained within the composition data 25 that was defined in the creation process.

The composition data 25 may be unique for each artist's composition. If desired, the same playback program 24 may be used for many different compositions. At the start of the composition creation process, the artist may chose a specific playback program 24 to be used for a composition, based upon the desired variability techniques the artist wishes to employ in the composition.

In some embodiments, a playback-program may be dedicated to a single composition. As discussed elsewhere, using a dedicated playback program for each composition, may not be as economically advantageous as using the same playback-program for many compositions.

In an alternative embodiment, the composition data may be distributed-within and/or embedded-within the playback-program's code. But some of the advantages of separating the composition data and the playback-program; may be compromised.

The advantages of separating the playback program from the playback data, and allowing a playback program to be compatible with a plurality of compositions, may include:

Allowing software tools, which aid the artist in the variable composition creation process, to be developed for a particular playback program. The development cost of these tools may then be amortized over a large number of variable compositions.

Allowing simultaneous advancement in different areas of expertise such as:

The creative use of creation tools and playback programs by artists.

The advancement of the playback programs by technologists.

The advancement of the "variable composition" creation tools by technologists.

It may be expected that the playback program(s) may advance over time with both improved versions and alternative programs, driven by artist requests for additional variability techniques. Over a period of time, it may be expected that multiple playback programs may evolve, each with several different versions. Parameters that identify the specific version (i.e., needed capabilities) of the playback program 24 may be imbedded in the composition data 25. This allows playback program advancements to occur while maintaining backward compatibility with earlier pseudo-live compositions.

As shown in FIG. 2, the creation process 28 includes the record performance 22 and the composition definition process 23. The record performance 22 may be very similar to that used by today's recording industry (shown in FIG. 1 and described in the previous section above). For many embodiments, a main difference is that the record performance 22 (in FIG. 2) may typically require that many more tracks and overdub tracks be recorded. These additional overdub tracks are ultimately utilized in the creation process as a source of variability during playback. In some cases, some alternative segments may be created and separately recorded, simultaneously with the creation of the segments that the alternatives may mix with during later playback. In some cases, some of the overdub (alternative) tracks may be created and recorded simultaneously with the artist listening to a playback of an earlier recorded track (or one of its component tracks). For example, the artists may create and record alternative overlay tracks, by voicing or playing instrument(s), while listening to a replay(s) of an earlier recorded track or sub-track.

The composition definition process 23 (FIG. 2) may be more complex and has additional steps compared with the edit-mixing block 13 shown in FIG. 1. The output of the composition definition process 23 is composition data 25. During the composition definition process, the artist embeds the definition of the playback variability into the composition data 25.

Due to increased selection possibilities and the alternative sound segments used to provide playback-to-playback variability; in some embodiments, the composition data size may be significantly larger than static compositions. The variability created from this larger composition dataset is intended to expand both artistic possibilities and the listener's experience.

Examples of Artistic Playback-to-Playback Variation:

The types of playback variability include all the variations that normally occur with live performances, as well as the creative and spontaneous variations artists employ during live performances, such as those that occur in concerts, riffs; jazz; or jam sessions. The potential types of playback-to-playback variations are basically unlimited and are expected to increase over time as artists request new creative effects.

Examples of the types of variations artist(s) may employ to obtain creative playback-to-playback variability may include:

Selecting between alternative versions/takes of an instrument and/or each of the instruments. For example, different drum sets, different pianos, different guitars.

Selecting between alternative versions of the same artist's voice or alternate artist's voices. For example, different lead, foreground or background voices.

Different harmonized combinations of voices. For example, "x" of "y" different voices or voice versions could be harmonized together.

Different combinations of instruments. For example, "x" of "y" percussion overlays (bongos, tambourine, steel drums, bells, rattles, etc).

Different progressions through the sections of a composition. For example, different starts, finishes and/or middle sections. Different ordering of composition sections. Different lengths of the composition payback.

Highlighting different instruments and/or voices at different times during a playback.

Variably inserting different instrument regressions. For example, sometimes a sax, trumpet, drum, etc solo may be inserted at different times.

Varying the amplitudes of the voices and/or instruments relative to each other.

Variability in the placement of voices and/or instruments relative to each other from playback to playback.

Variations in the tempo of the composition at differing parts of a playback and/or from playback-to-playback.

Performing real-time special effects editing of sound segments before they are used during playback.

Varying the inter-channel relationships and inter-channel dependencies.

Performing real-time inter-channel special effects editing of sound segments before they are used during playback.

Based on this specification, those skilled in the art will recognize many other artistic possibilities for creating playback to playback variability. An artist may not need to utilize all of the above variability methods for a particular composition.

During the creation phase, the artist may experiment with and choose: the editing and mixing variability to be generated during playback. In one embodiment, the variable compositions may be defined so that only those editing and mixing effects that are actually needed to generate playback variability are performed during playback processing. In many embodiments, the majority of the special effects editing and much of the mixing may continue to be done in the studio during the creation process.

In one example, a very simple pseudo-live composition may utilize a fixed unchanging base track for each channel for the complete duration of the song, with additional instruments and voices variably selected and mixed onto this base.

In another example, the duration of the composition may vary with each playback based upon the variable selection of different length segments, the variable spawning of different groups of segments or variable placement of segments.

In even more complex pseudo-live compositions, many (or all) of the variability methods listed above may be simultaneously used. In many embodiments, how a composition varies from playback to playback may be determined by the artists definition created during the creation process.

Composition Definition Process:

Prior to starting the composition definition process, the artists may decide the various playback variability effects that may ultimately be incorporated into the variable composition. It may be expected there may ultimately be various playback programs available to artists, with each program capable of utilizing a different set of playback variability techniques. It is expected that (interactive, visually driven) composition definition tools, optimized for the various playback programs, may assist the artist during the composition definition process. In this case, the artist chooses a playback program based on the variability effects they desire for their composition and the capabilities of the composition definition tools.

Figure 3:
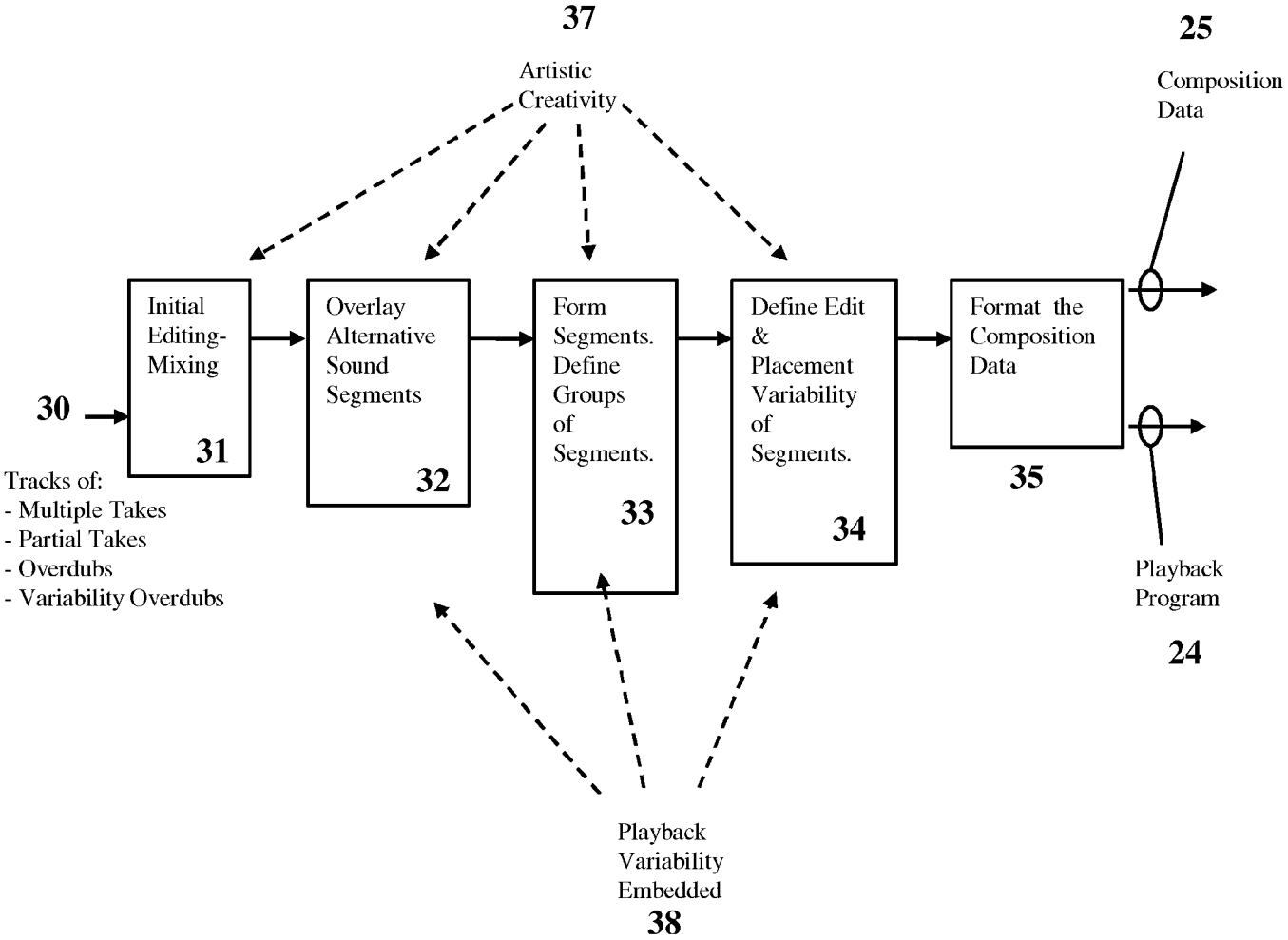
FIG. 3 is a flow diagram of the composition definition process (creation).

FIG. 3 is a flow diagram detailing the "composition definition process" 23 shown in FIG. 2. The inputs to this process are the tracks recorded in the "record performance" 22 of FIG. 2. The recorded tracks 30 include multiple takes, partial takes, overdubs and variability overdubs.

As shown in FIG. 3, the recorded tracks 30 undergo an initial editing-mixing 31. The initial mixing-editing 31 may be similar to the editing-mixing 13 block in FIG. 1, except that in the FIG. 3 initial editing-mixing 31 only a partial mixing of the larger number of tracks may be done since alternative segments are kept separate at this point. Another difference may be that different variations of special effects editing may be used to create additional overdub tracks and additional alternative tracks that may be variably selected during playback. At the output of the initial editing-mixing 31, a large number of partially mixed tracks and variability overdub tracks are saved.

The next step 32 is to "overlay alternative sound segments" that are to be combined differently from playback-to-playback. In step 32, the partially mixed tracks and variability overdub tracks are overlaid and synchronized in time. Various alternative combinations of tracks (each track holding a sound segment) are experimented in various mixing combinations. When experimenting with alternative segments, the artists may listen to the mixed combinations that the listener would hear on playback, but the alternative segments are recorded and saved on separate tracks at this point. The artist creates and chooses the various alternate combinations of segments that are to be used during playback. Composition creation software may be used to automate the recording, synchronization and visual identification of alternative tracks, simultaneous with the recording and/or playback of other composition tracks. Additional details of this step are described in the "Overlaying Alternative Sound Segments" section.

The next step 33 is to "form segments and define groups of segments". The forming of segments and grouping of segments into groups depends on whether "pre-mixing" or "playback mixing" (described later) is used. If "pre-mixing" is used, additional slicing and mixing of segments occurs at this point. The synchronized tracks may be sliced into shorter sound segments. The sound segments may represent a studio mixed combination of several instruments and/or voices. In some cases, a sound segment may represent only a single instrument or voice.

A sound segment also may spawn (i.e., initiate the use of) any number of other groups at different locations in the same channel or in other channels. During a playback, when a group is initiated then one or more of the segments in the group may be inserted based on the selection method specified by the artist. Based on the results of artist experimentation with various alternative segments, segments that are alternatives to be inserted at the same time location are defined as a group by the artist. The method to be used to select between the segments in each group during playback may be also chosen by the artist. Additional details of this step are described in the "Defining Groups of Segments" and the "Examples of Forming Groups of Segments" sections.

The next step 34 is to define the "edit & placement variability" of sound segments. Placement variability includes a variability in the location (placement) of a segment relative to other segments. Based on artist experimentation, placement variability parameters specify how spawned snippets are placed in a varying way from their nominal location during playback processing. Edit variability includes any type of variable special effects processing that are to be performed on a segment during playback prior to their use. Based on artist experimentation, the optional special-effects editing, to be performed on each snippet during playback, may be chosen by the artist. Edit variability parameters are used to specify how special effects are to be varyingly applied to the snippet during playback processing. Examples of special effects that artists may define for use during playback include echo effects, reverb effects, amplitude effects, equalization effects, delay effects, pitch shifting, quiver variation, pitch shifting, chorusing, harmony via frequency shifting and arpeggio. Artist experimentation, also may lead to the definition of a group of alternative segments that are defined to be created from a single sound segment, by the use of edit variability (special effects processing) applied in real-time during playback. Variable inter-segment special effects processing, to be performed on multiple segments during playback, may also embedded into the composition at this point. Inter-segment effects allow a complementary effect to be applied to multiple related segments. For example, a special effect in one channel also causes a complementary effect in the other channel(s).

The final step 35 is to package the composition data, into the format that may be processed by the playback program 24. Throughout the composition definition process, the artists are experimenting and choosing the variability that may be used during playback. Note that artistic creativity 37 may be embedded in steps 31 through 34. Playback variability 38 may be embedded in steps 32 through 34 under artist control.

In-order to simplify the description above, the creation process was presented as a series of steps. Note that, it is not necessary to perform the steps separately in a sequence. There may be advantages to performing several of the steps simultaneously in an integrated manner using composition creation tools.

Figure 18:
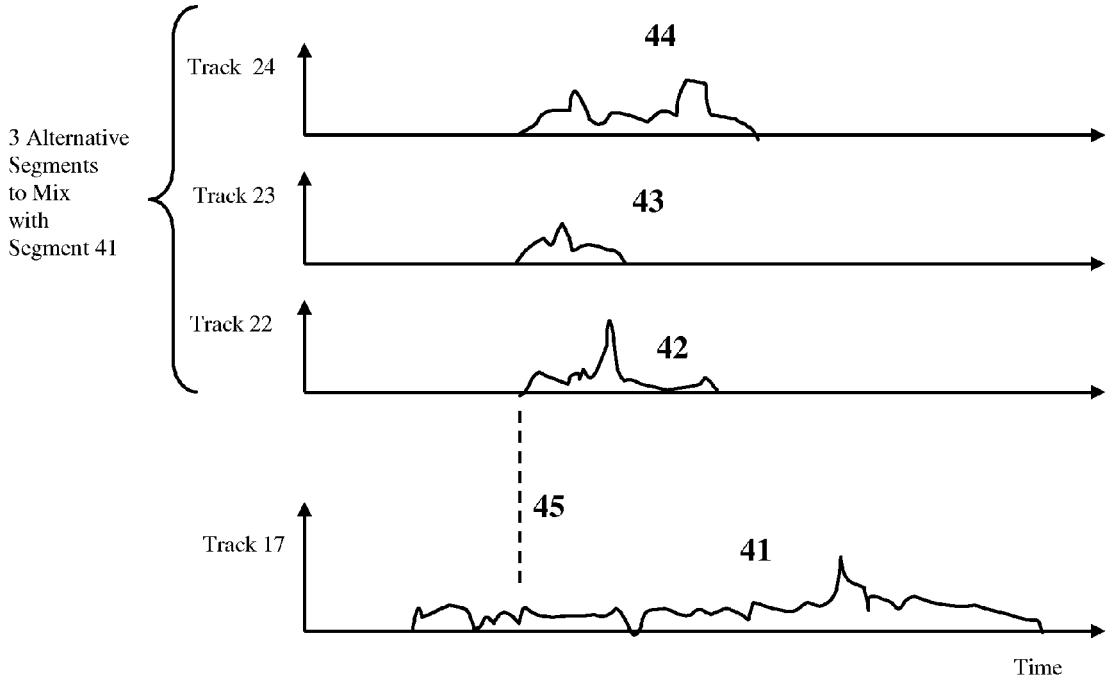
FIG. 18 shows an example of artists, in the studio, creating variability by adding different variations on top of a sound segment (creation).

Overlaying Alternative Sound Segments (Composition Creation Process):

FIG. 18 shows a simplified example of artists, in the studio, creating variability by adding different variations on top of a foundation (base) sound segment (track). In this example, segment 41 may be a foundation segment, typically created in the studio by mixing together tracks of various instruments and voices. In this example, three variability segments (42, 43 and 44) are created by the artists. Each of the variability segments my represent an additional instrument, voice or a mix of instruments and/or voices that may be separately mixed with segment 41.

The variability segments may be created and recorded by the artists simultaneous with the creation or re-play of the foundation segment or with the creation or re-play of sub-tracks that make up the foundation segment.

Alternatively, some of the variability segments may be created by using in-studio special effects editing of a recorded segment or segments in-order to create alternatives for playback.

The artists may define the time or sample location 45 where alternate segments are to be located relative to segment 41. Note that null value samples may be appended to the beginning or at the end of any of the alternate segments, if needed for alignment reasons.

Figure 20:
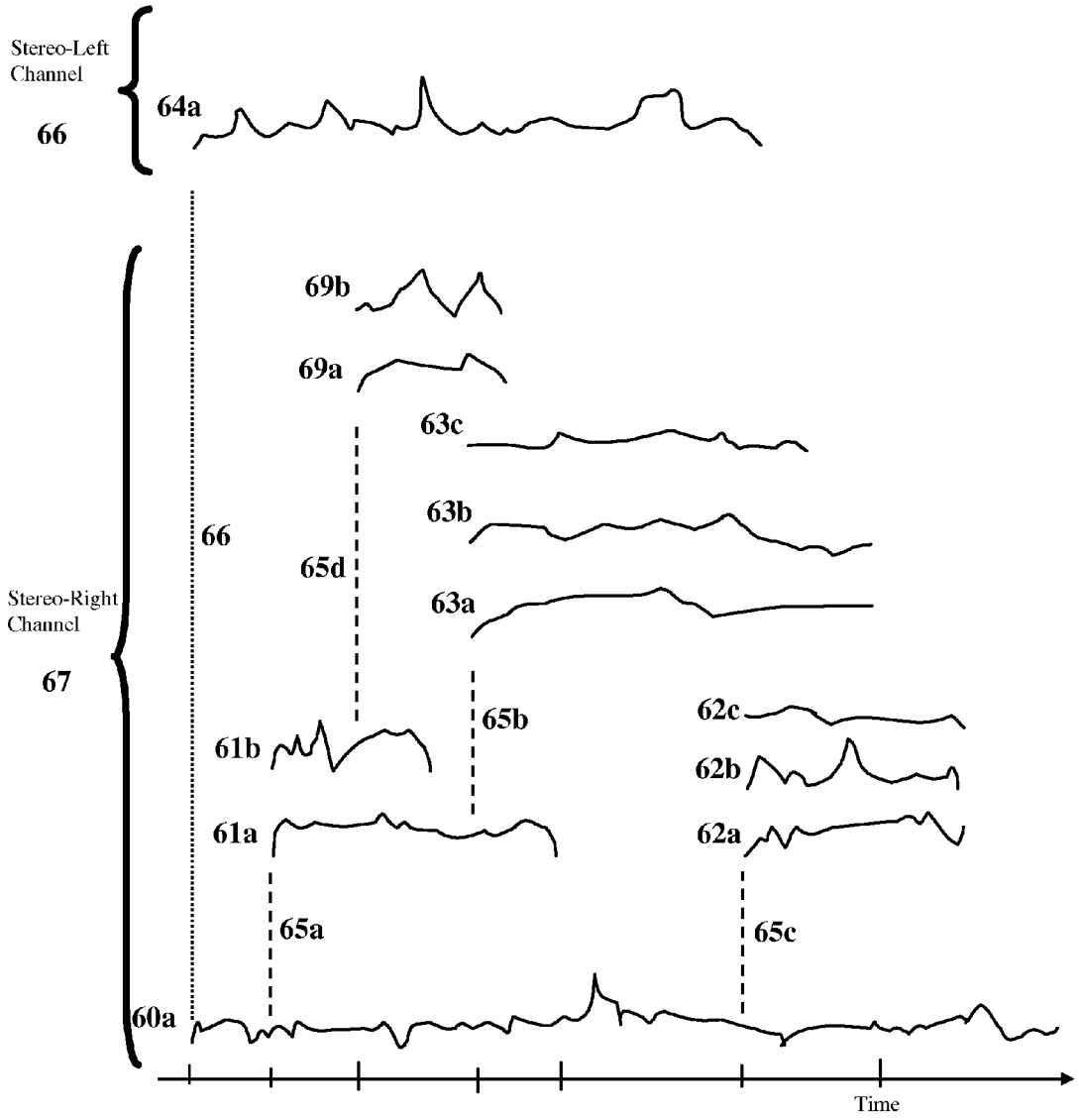
FIG. 20 shows a more complicated example of artists, in the studio, creating and recording multiple groups of alternative segments that overlap in time (creation).

FIG. 20 shows a more complex example of artists, in the studio, creating and recording multiple groups of alternative segments that overlap in time. This example is intended to illustrate capabilities rather than be representative of an actual composition. In-order to simplify this example, the number of alternative segments in each group are limited to only two or three. Segment 60*a*, a segment in the stereo right channel 67, is overlaid with a choice of alternative segments 61*a* or 61*b* at insertion location 65*a* and also overlaid with a choice of alternative segments 62*a*, 62*b* or 62*c* at insertion location 65*c*. If segment 61*a* is selected for use then one of alternative segments 63*a*, 63*b* or 63*c* is also to be used. If segment 61*b* is selected for use then one of alternative segments 69*a* or 69*b* is also to be used. Similarly (but not shown in FIG. 20), the artists may form the stereo left channel (and other desired channels) by locating the stereo left segments relative to segment 60*a* or any other segments.

Visually Interactive Creation Tools:

In some embodiments of creation tools, composition creation may be facilitated by the use visually interactive software on active-display(s). This may allow automation of many of the steps/processes used to create a variable composition(s). Examples of active-displays include 2-dimensional and 3-dimensional displays such as cathode ray tubes (CRT); liquid crystal displays (LCD); plasma-displays; surface-conduction electron-emitter displays (SED); digital light Processing (DLP) micro-mirror projectors/displays; front-side or back-side projection displays (e.g., projection-TV); projection of images onto a wall or screen; computer-driven projectors; digital-projectors; light emitting diode (LED) displays; active 3-D displays; active holographic displays; or any other type of display where what is being displayed can be changed based on context and/or user actions. Visual interactivity may be accomplished with any combination of user pointing; designating and/or selecting devices including mouse; trackball; active-pointers; touch-pads; touch-screens; selection-buttons; controls; dials; wheels; joy-sticks; verbal-commands; etc.

In some embodiments, visually interactive creation software may contain a set of general purpose capabilities that may be employed to create an unlimited number of different compositions by many different artists. Once an artist/sound-engineer has learned to use a particular creation software tools to create one composition; that artist/sound-engineer may more quickly create other variable compositions using the same tool set in a similar visually interactive manner. The non-recurring and recurring costs of the creation software and hardware may be amortized over many variable-playback compositions. The creation software may be modularized so that new variability tools/effects may be more easily added into the creation software if/when new types of playback-to-playback variability are requested by the artists.

The creation hardware may have a limited number of external world inputs (e.g., from microphones and/or instruments) which may limit the number of sources (analog and/or digital inputs) that can be simultaneously captured at any one instant from the external real-world. Internal to the creation software, sound segments may be represented as virtual tracks so that the number of possible tracks is limited by only the processing capability. By using multiple "takes" from the real-world, any desired number of external sources may be input into the internal virtual tracks of the creation software.

Foundation/baseline segments may be captured as external inputs from the real-world. Foundation/baseline segments may also be created by combining; concatenating; and/or mixing together a plurality of different sound segments. In addition, foundation/baseline segments may be changed by special-effects editing. For example, the foundation/baseline segment (41) in FIG. 4 may be created from an external input that was then changed by a combination/mixing with other sound segments and/or special-effects editing to create the segment.

The creation software may allow alternative segments to be created simultaneously with the creation of a foundation/baseline segment. For example, the hardware inputs may be configured to simultaneously capture foundation/baseline segment(s) as well as other inputs representing alternatives. For example, plurality of microphones may be setup to simultaneously capture many individual voices, where each alternative voice may be captured on its own virtual track. Then during a single "take", a foundation/baseline segment and the plurality of alternative voice segments may be each simultaneously captured as separate tracks. The alternative tracks may be automatically displayed on the active-display in relative location to the foundation/baseline segments(s). The software may aid the artist in visually selecting only the "active" portions of sound segments. For example, the software may automatically detect when there is no activity (e.g., less then a threshold for a certain period of time) and remove or visually indicate this in the display of the captured segment. For example, in FIG. 4, the three alternative segments (42; 43; 44) may have been simultaneously created by three different artist voices/instruments (and captured on separate external inputs) during the creation of foundation/baseline segment (41). Alternatively, perhaps only a subset of the alternative segments (42; 43; 44) might be created simultaneous with the creation of the foundation/baseline segment (41) and the other alternative segments are created in other ways described elsewhere.

The creation software may automatically display the newly created alternate sound segment(s) as track(s) on the active-display(s). The new alternative segments may be automatically located in time relative to that foundation/baseline segment that had been played-back. The new alternative segment(s) may be automatically marked as a new alternative by some designation (e.g., color) on the active-display. The creation software may automatically mark new segments as not assigned yet assigned to a group and/or not yet incorporated into the composition. Alternatively, a create group mode may automatically add new alternative segments into a group as they are created.

The creation software may allow the artist to select, drag and/or drop segments/tracks around on the active-display. For example, the artist may define a group of segments; and/or add or remove alternative segment(s) from a group by visually interacting with segment(s). For example, the artist may visually move the location of a segment or a group by doing a drag and drop. For example, the artist may define a group by visually selecting each desired segment on the active-display.

The creation software may allow the artist to easily select track(s) to be immediately played or played together so the artist can quickly test; experiment or verify certain tracks or combinations of tracks.

The creation software may also allow an artist to create additional alternatives, simultaneous with the artists hearing a playback of an already existing [foundation/baseline] track(s). For example, the artists may use their voices and/or instruments to create alternative segment(s) while hearing the playback of an already existing [foundation/baseline] track(s). For example, in FIG. 4, the alternative segment 42 may have been simultaneously created by the artist's voices/instruments during a playback of foundation/baseline segment (41). The other alternative segments (43; 44) may have each been simultaneously created by the artist's voices/instruments during other playbacks of foundation/baseline segment (41).

By simultaneously capturing/recording voice/instrument from multiple external inputs, multiple alternative segments may be simultaneously created each time the foundation/baseline segment(s) is played-back. For example, different voices and different instruments may be each captured and displayed on a separate track each time the foundation/baseline segment is played-back. The artists may simultaneously create (e.g., using voice or instruments) one or more alternative segments; each time a foundation/baseline segment is being played-back. For example, in FIG. 4, the three alternative segments (42; 43; 44) may have been simultaneously created by three different artist voices/instruments (and captured on 3 separate external inputs) during a single playback of foundation/baseline segment (41).

The creation software may also allow the creation of alternative segments by visually designating the special-effects editing an existing sound segment. For example, an artist may start with a single sound segment, and then special-effects editing that segment in different ways to create a plurality of alternative segments. Examples include echo or reverb changes; amplitude or frequency changes; compressive or non-linear effects; time-shifting; etc. The special-effects editing may include any of the effects currently used in the recording industry today or effects as described elsewhere in this specification. For example, in FIG. 4, any or all of the three alternative segments (42; 43; 44) may have been created by special effects editing to create new alternatives from another sound segment.

The creation software may also allow the creation of alternative segments by visually designating the combining; concatenating; and/or mixing together different sound segments to create new and/or alternative sound segments. For example, in FIG. 4, any or all of the three alternative segments (42; 43; 44) may have been created by combining; concatenating; and/or mixing a plurality of different segments in different ways. In another example, in FIG. 19, the 3 alternative segments (41*b*+42; 41*b*+43; 41*b*+44) are created by combining a plurality of different segments in different ways.

The creation software may facilitate the handling of multiple channel inputs (e.g., stereo; quad; etc) and outputs. Each input channel may be automatically captured on individual tracks. The creation software may help automate the simultaneous manipulation of tracks across multiple sound channels. For example, when the user visually interacts-with a right channel track; the corresponding left channel track may be also be automatically adjusted in a corresponding way. For example, if the artist drags and drops a right-channel segment to add it to a group; the creation software may automatically add/move the corresponding left-channel segment into the corresponding left-channel group.

Figure 30:
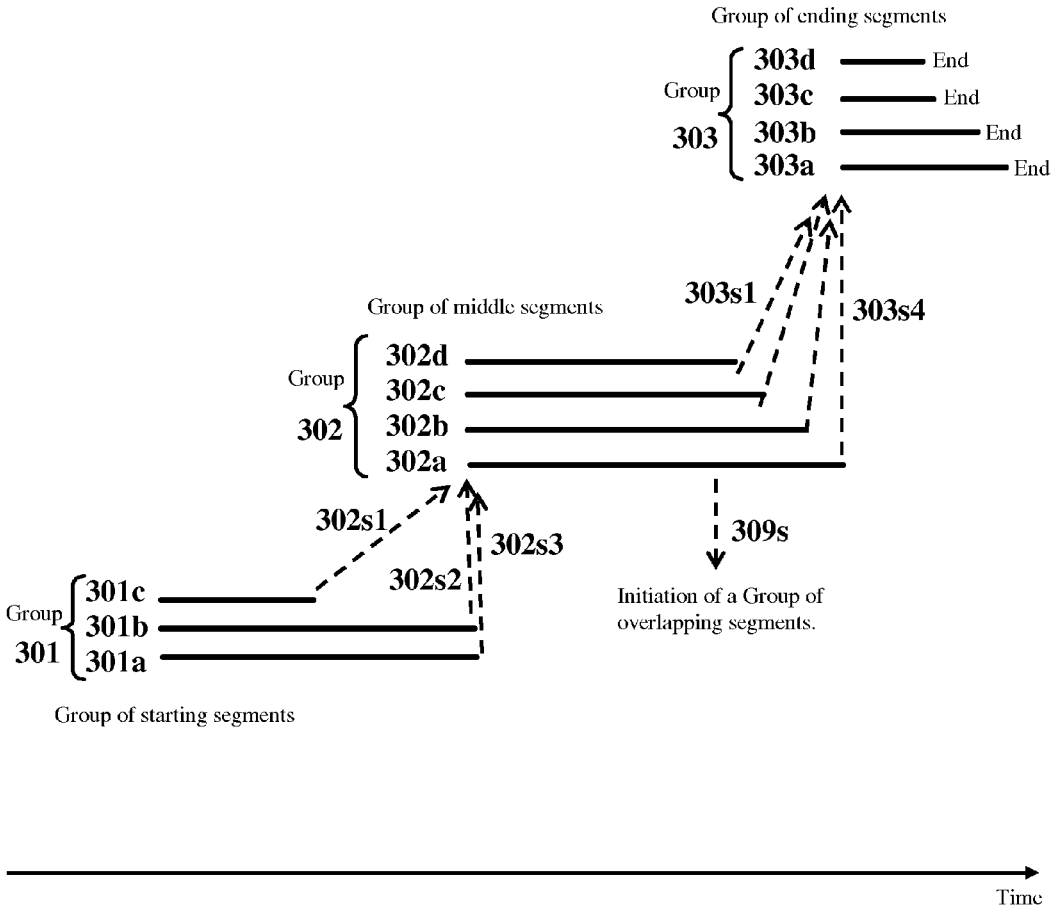
FIG. 30 shows a simple example of defining a composition with a plurality of possible alternative paths and/or progressions from one playback to another playback.
Figure 31:
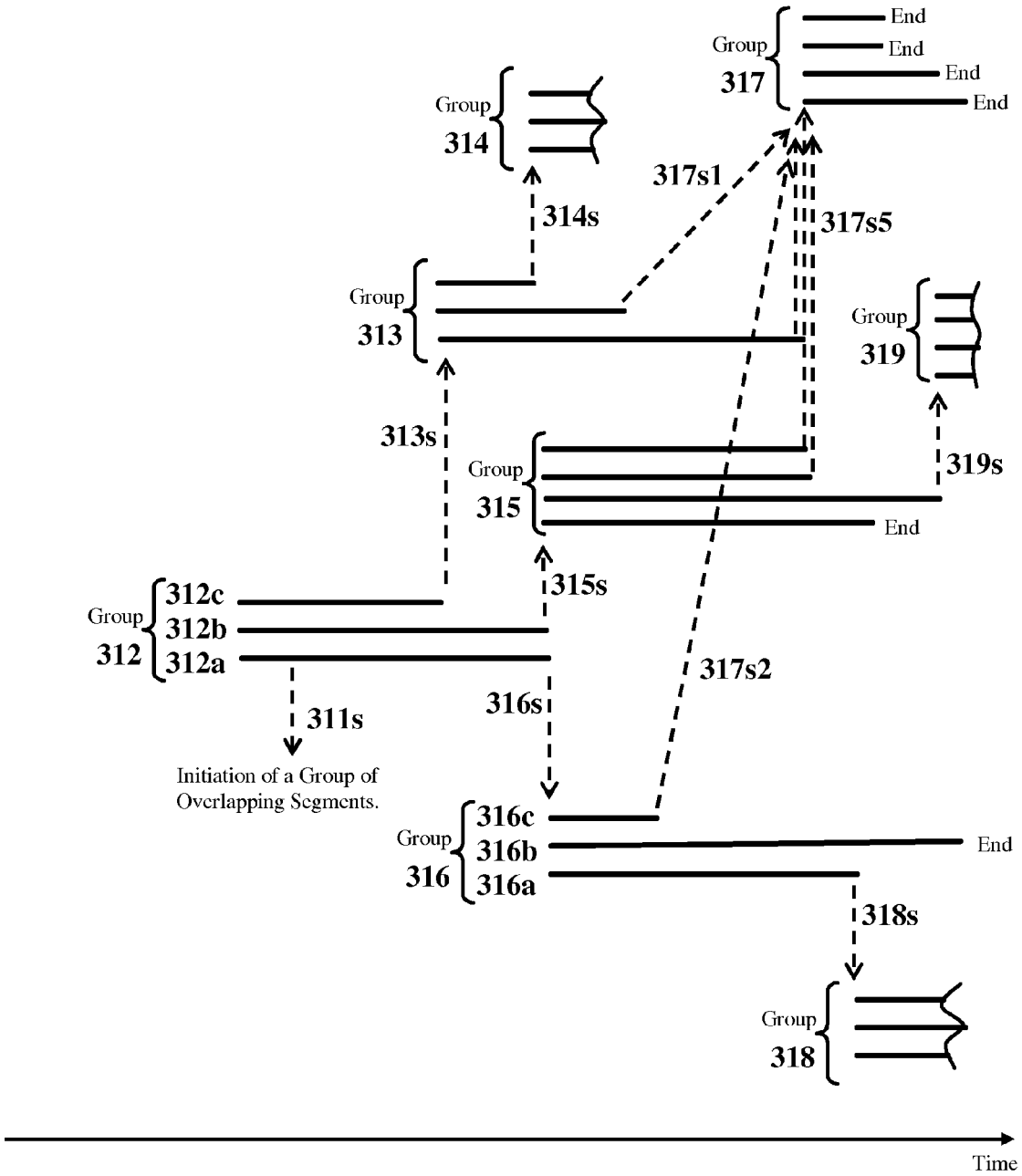
FIG. 31 shows a more complex example of defining a composition with a plurality possible alternative paths and/or progressions from one playback to another playback.

The creation software may also facilitate the definition of an initiation (e.g., spawning) of group(s) of segments; by allowing the artist/sound-engineer to visually designate the initiating segment; group(s) of initiated segments and their locations using interactive active-display(s). By using initiation/spawning, the artist may easily create variable compositions where the choice of a particular segment during a playback may lead to a different selection of the segments that follow. By being able to easily define initiation/spawning on a visually interactive display, the artist may easily define alternate progressions through segments that may occur during different playbacks of the compositions. Some examples are shown in FIGS. 30 and 31.

The creation software may also allow an interactive designation on an active display of a variable playback-to-playback placement/location of sound segments as described elsewhere.

The creation software may also allow an interactive designation on an active display of a variety of different playback-to-playback variable special effects editing of sound segments as described elsewhere.

In general, the creation software may facilitate (and automate) the designation and definition of the various types of playback variability the artists wish to embed in their composition(s).

The creation software may also facilitate and/or automate the creation of playback format(s). Once the artist has laid out all the segments visually on the interactive active-display, the creation software may then be tasked to automatically create a composition format that can be processed by a pre-defined playback processor(s) and/or playback program(s).

Examples of Segment Representations (Creation):

During composition creation, a sound segment [or snippet] may be represented on active-display(s) (of the creation tool) by many different waveforms and/or representations.

In some cases, the creator may desire to see a detailed bi-polar waveform (showing both the positive and negative values) in detail. In other cases, the creator may desire to see a waveform that shows only the positive portion of a sound waveform but still see the detailed amplitude variations. In still other cases, the creator may desire to see a waveform that shows only the positive envelope of a sound waveform (e.g., without all the waveform details).

In situations where many overlapping segments to shown on an active display, simplified segment representations may be used to allow a large number of segments to be viewed on the screen; without burdening the creators with unneeded details of the actual waveforms. For example, a line or rectangle may be sufficient to indicate a segment's placement location. In some other situations, the thickness of the line or height of the rectangle may also be used to indicate both segments location and to provide a rough sense of segment magnitude. In other cases, the displayed intensity or displayed color may be used to indicate a rough sense of a segment's amplitude/magnitude. For example, segments that have an excessive amplitude that may cause distortion (e.g., clipping) may be automatically flagged in a red color by the creation software.

Where many overlapping segments may need to be displayed, a method may be provided to allow the user to quickly switch between simplified segment representation(s) (such as line or rectangular box) and the more detailed waveform and/or waveshape representations of a sound segment. For example, the user may quickly switch between simplified and detailed views of segment waveforms by using a pointing device to "click-on" or "roll-over" a segment representation and to quickly cycle through one of several different available representations with each "click". For example, the creation toll may allow a user to quickly cycle between: the full detailed waveform; the positive peak envelope; the Midi-type representations and/or the simplified line/rectangular representations of a particular sound segment.

In some creation tool embodiments, symbols may also be attached to segment representations for identification purposes. In some embodiments of creation tool display(s), a combination of symbols; icons; colors; dynamics (e.g., blinking); and attached text may be utilized to ease visual recognition of different sound and segment types. For example, different symbols or colors may be used to identify the nature of a segment by type of instrument or voice. For example, it may be desirable to easily visually distinguish between: the segments of a group; segments already embedded in the composition; and segments available for embedding in the composition.

Similarly, different representations may be utilized to distinguish between different types of groups such as a group already embedded in the composition; and group available for embedding in the composition.

Note that the waveforms and representations of the segments, shown in the figures of this specification, are not necessarily representative of actual compositions; but are intended to illustrate the inventive capabilities. In general, the segment representations, shown in the figures of this specification, are intended to indicate the time duration and/or placement location of a sound segment, independent of whether the sound segment is defined by a sequence of sampled digital samples or a sequence of MIDI-type events or defined in another manner. The embodiments are not limited to the types of segment representations shown in the figures, since these have been simplified to reduce figure complexity; clutter and detail; in-order to make the inventive concepts easier for the reader to understand. For example, the waveforms such as segment 44 (in FIG. 4), are intended to represent the location and duration of the sound segment and not the details of an actual waveform or waveshape. In other figures (such as FIG. 19), some waveforms or segments are illustrated using rectangular boxes in-order to indicate the location and duration of the sound segment. In some cases, symbols are attached to rectangular segments in-order to also identify which combinations of other segments, a pre-mixed segment represents (e.g., FIG. 19, symbol 41*b*+44).

Creating Alternative Paths and Progressions:

FIG. 30 shows a simple example of how artists may create compositions that may have alternative paths and/or progressions (e.g., alternative sequencings of sound segments) from playback to playback. This example is intended to illustrate the creation of a simple variable composition that has a plurality of alternative beginning segments; a plurality of alternative middle segments and a plurality of alternative ending segments.

In FIG. 30, each segment is represented by a horizontal line and the length of the line indicates its duration. The segments may be interactively defined on an active display by the artist(s) and may be defined using standardized creation software. For example, group 301 may contain three alternative segments (301*a*; 301*b*; 301*c*) of the same and/or different lengths. In this example, only one of three segments in group 301 is assumed to be selected during a given playback. At the end of each of these segments is an initiation (302*s*1; 302*s*2; 302*s*3) which points to a group of segments that will be used immediately following each of the segments. To simplify this example, the three segments (301*a*; 301*b*; 301*c*) are assumed to each initiate the same group 302. In this example, group 302 is assumed to designate a group of alternative middle segments (302*a*; 302*b*; 302*c*; 302*d*) which may have the same and/or different lengths. At the end of each of these four middle segments is an initiation (303*s*1; . . . ; 302*s*4) which points to a group of segments that will be used immediately following each of the segments. To simplify this example, the four segments (302*a*; 302*b*; 302*c*; 302*d*) are assumed to each initiate the same group 303. In this example, group 303 is assumed to designate a group of alternative ending segments (303*a*; 303*b*; 303*c*; 303*d*) which may have the same and/or different lengths.

In this example, it is assumed that one segment is selected (e.g., initiated) from each group and that each selected non-overlapping segment will be concatenated to the initiating segment that spawned it. Note that in this example, the composition may conclude with an ending segment; because each ending segment may not initiate (at the end of the segment) additional groups and/or segments.

To simplify complexity, FIG. 30 mostly shows only spawning (e.g., initiation of groups) that occurs at the end of an initiating segment. But as discussed and illustrated elsewhere, the spawning of groups may occur anywhere in an initiating segment and at as many locations as desired in any initiating segment(s). For example in FIG. 30, segment 302*a* may spawn/initiate (309*s*) a group that may contain segments that overlap or partially overlap the initiating segment (302*a*) and the overlapping portions of the segments may be mixed together. Similarly, the spawning/initiation of zero; one; or more other group(s) may also be defined at any of the other segments shown in FIG. 30.

FIG. 31 shows a more complex example of how artists may create compositions that may have alternative paths and/or progressions (e.g., alternative sequencings of sound segments) from playback to playback. Group 312 may contain three alternative segments (312*a*; 312*b*; 312*c*). The segments may be interactively defined on an active display by the artist(s) and may be defined using standardized creation software. In this example, one of the three segments may be variably selected during playback processing. Each of the segments may initiate a group at the end of the segment. For example, segment 312*b* may initiate 315*s* a group 315 that contains four alternative segments. Note that each segment in group 312 may spawn/initiate the use of a separate group of alternative segments. Alternatively, different segments located in different groups may each initiate (e.g., 317*s*1; 317*s*2; . . . ; 317*s*5) the use of the same group (e.g., 317). In this example, it is assumed that one segment is selected (e.g., initiated) from each group and that each selected non-overlapping segment will be concatenated to the initiating segment that spawned it. Also note that in this example, the composition may conclude with an ending segment, because each ending segment may not initiate (at the end of the segment) additional groups and/or segments.

To simplify complexity, FIG. 31 mostly shows only spawning (e.g., initiation of groups) that occurs at the end of an initiating segment. But as discussed and illustrated elsewhere, the spawning of groups may occur anywhere in an initiating segment and at as many locations as desired in any initiating segment(s). For example in FIG. 31, segment 312*a* may spawn/initiate (311*s*) a group that may contain segments that overlap or partially overlap the initiating segment (312*a*) and the overlapping portions of the segments may be mixed together. Similarly, the spawning/initiation of one or more other group(s) may also be defined at any of the other segments shown in FIG. 31. The portions of the segments that overlap in the same sound channel may be mixed together to form a sound sequence.

Also note in FIG. 31, that the creation software may allow a spawning/initiation to be defined using a diagonal line/arrow (e.g., 317*s*1); where an initiated group (e.g., 317) is understood to be concatenated immediately after the initiating segment (e.g., 316*c*); so that one (or a subset) of the segments that is (are) variably selected from group 317 is (are) placed/located immediately following segment 316*c*.

Also note that although only a few segments are shown in each group to reduce the clutter in FIGS. 30 and 31, in general, the groups may have any number of segments that the artists may desire.

Creating Variable Compositions from Older Static Compositions (Optional Composition Creation Capability):

Variable compositions may also be created out of old static compositions, including those cases where some or all of the original artists are no longer living. In the studio: the old static recordings; old alternate recordings; old previously unused recordings; old pre-mixed recordings; and/or old pre-mixed tracks may be deconstructed and/or separated into tracks of the component instrument and vocal parts. In addition, deconstructed and/or separated tracks from other compositions by the same artists may also be used in some situations. Methods for deconstructing a static composition into component parts are already known to those who are skilled in the art. For example, new static remixed versions of older compositions have already been created by deconstructing and recovering the component instrument and vocal parts from the available original recordings; and then remixing and editing the component parts to create a new static version. An example is the "Love" album which was created for a "Cirque du Soleil" show, from much earlier Beatles recordings. It was released in 2006 when only half of the Beatles were still living. This remixed version was created using only source material from older Beatle recordings. The members of Beatles that were still living did not need to record any new material (instruments and vocals) to create this remixed album.

To create a variable composition in the studio, a plurality of alternative segments (in a group of alternative segments) may be created by using these different deconstructed source versions; other versions that occur at different locations in the original versions and/or special-effects editing of the original version(s). If desired, (the still living) artists may also play and record new instruments and vocals to create some additional alternate sound segments. Otherwise, the creation of a variable composition may occur in the same manner as discussed elsewhere in this description.

Defining Groups of Segments (Composition Creation Process):

There are two general strategies for partitioning overlapping alternative segments into groups; in-order to generate variability during later playback:

Real-time "playback mixing". During playback, alternative overlapping sound segments are variably selected and the overlapping segments are mixing together in substantially real-time during playback.

"Pre-mixing" of the alternative combinations in the studio. The alternative combinations of sound segments are mixed in advance in the studio. During playback, the pre-mixed segments are variably selected and combined/concatenated without using playback mixing.

If desired, a combination of both methods maybe used in the same variable composition. For both methods, it is recommended that, the segments be synchronized and located accurately in time in-order to meet the quality standards expected of the recording industry compositions.

Note that, "playback mixing" partially repartitions the editing-mixing functions that are done in the studio by today's recording industry. The artists decide which editing and mixing functions are to be done during playback, to vary the music from playback to playback. Editing-mixing that is not needed to generate playback variability may continue to be done in the studio, rather than unnecessarily burdening the playback processing.

Examples of Real-time Playback Mixing (Composition Creation):

The following paragraphs show additional details of the "forming segments and defining groups of segments" (shown in block 33 of FIG. 3).

Figure 4:
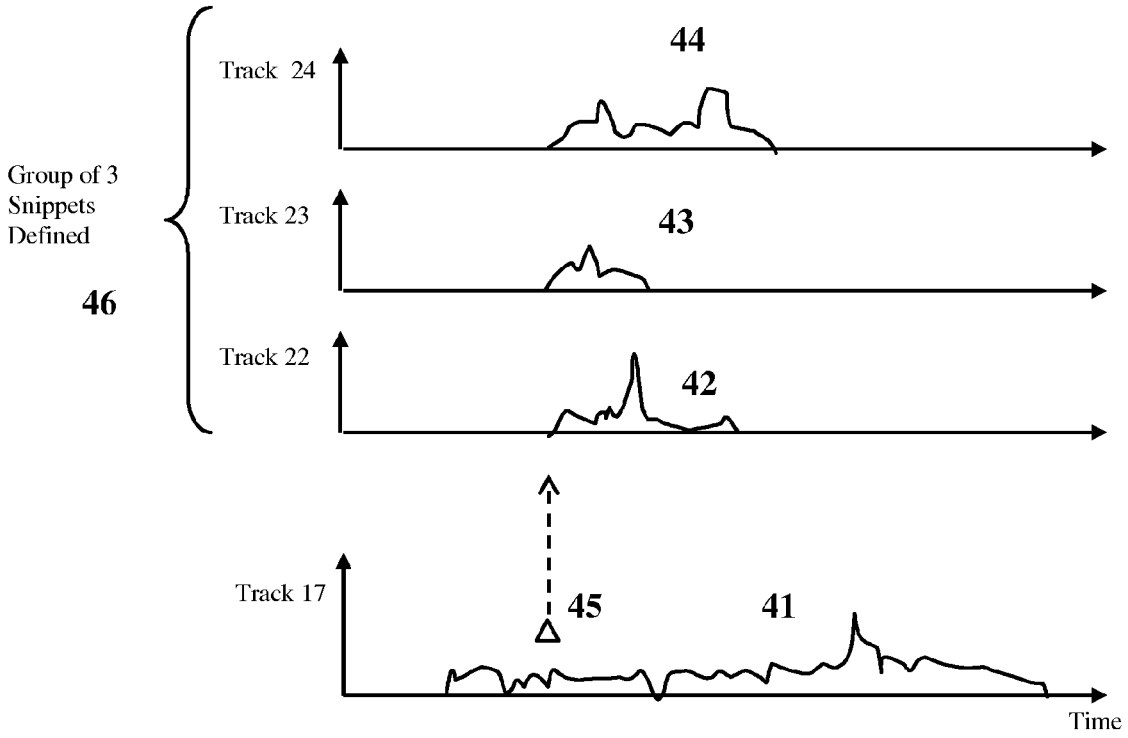
FIG. 4 is an example of defining a group of sound segments (in an initiation timeline) during the composition definition process to allow real-time "playback mixing" (creation).

FIG. 4 is a simplified example of defining a group of sound segments (in an initiation timeline) to allow real-time "playback mixing". The starting data is shown in FIG. 18 and was discussed earlier. Four tracks containing sound segments are shown in FIG. 4. In this example, one of the segments 42, 43, or 44 is to be selected and mixed with segment 41 during a playback. The artist defines a group containing three segments (42, 43, 44). The artist also defines the selection method to be used to choose among the three segments during playback, in this case, an equally likely random choice of one of the three segments in the group. The artist defines the insertion time 45 (or sample number) where the group may be initiated at during later playback. If desired, the artist may also define special effects processing to be performed on the segments prior to mixing. If desired, the artist may also define a playback-to-playback variability from the nominal in placing the segments.

Figure 21:
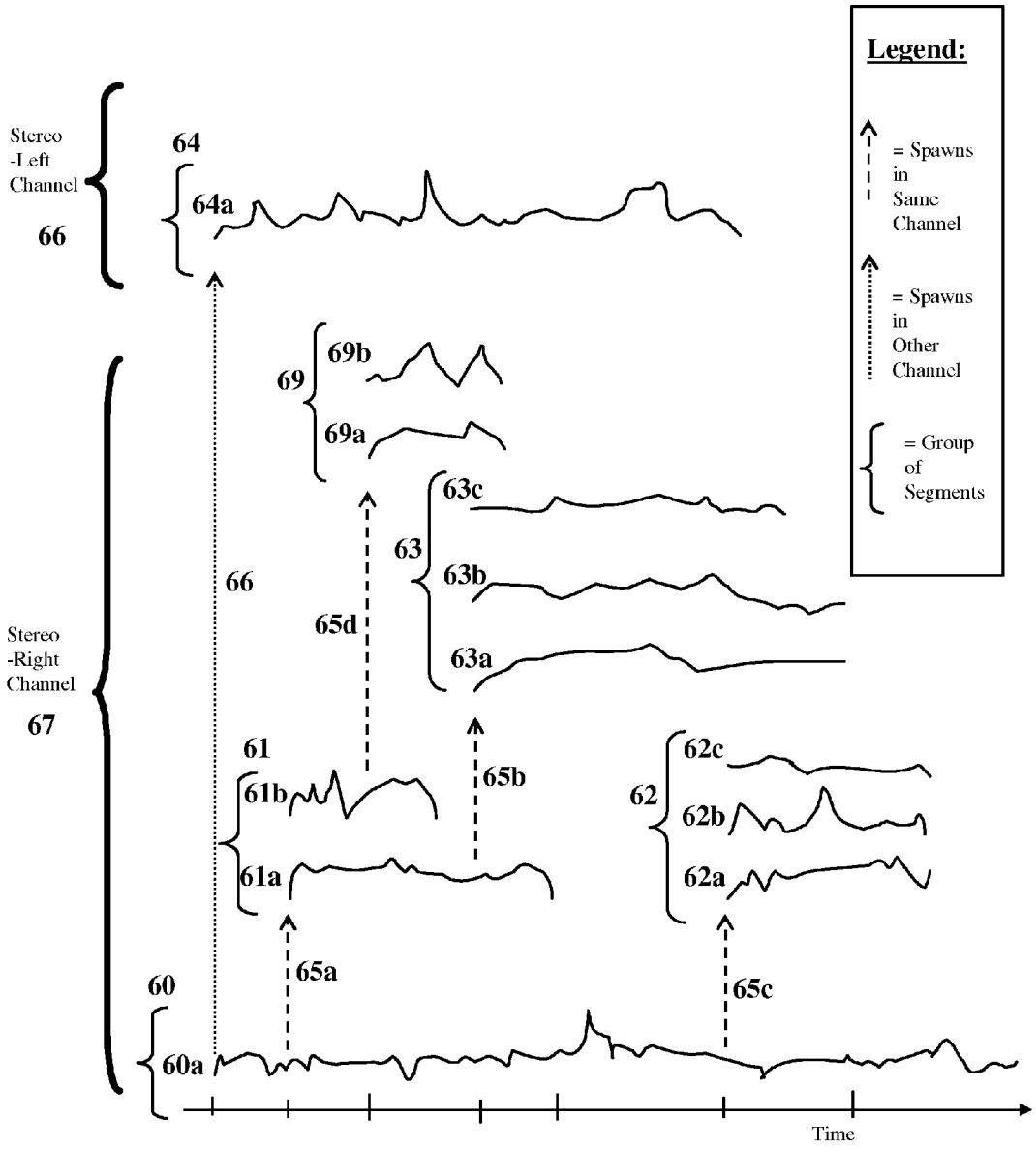
FIG. 21 is a more complicated initiation timeline that illustrates real-time "playback mixing" (creation).

FIG. 21 is a more complicated initiation timeline that illustrates real-time "playback mixing". FIG. 21 is a more complicated example of defining groups to allow real-time "playback mixing". The starting data is shown in FIG. 20 and was discussed earlier. The artist defines group 61 containing segments 61*a* and 61*b*. The artist defines a selection method for group 61 and the group 61 insertion time 65*a* relative to segment 60*a* where the group may be initiated at during later playback. The artist defines group 62 containing segments 62*a*, 62*b* and 62*c*. The artist defines a selection method for group 62 and the group 62 insertion time 65*c* relative to segment 60*a* where the group may be initiated at during later playback. The artist defines group 63 containing segments 63*a*, 63*b* and 63*c*. The artist defines a selection method for group 63 and the group 63 insertion time 65*b* relative to segment 61*a* where the group may be initiated at during later playback. The artist defines group 69 containing segments 69*a* and 69*b*. The artist defines a selection method for group 69 and the group 69 insertion time 65*d* relative to segment 61*b* where the group may be initiated at during later playback. The artist defines group 64 to contain segment 64*a*. The artist defines a selection method for group 64 and the group 64 insertion time (into the stereo-left channel) relative to segment 60*a* where the group may be initiated at during later playback. If desired, the artist may also define special effects processing to be performed on the segments prior to mixing. If desired, the artist may also define a playback-to-playback placement variability from/about their nominal segment placement locations. An equally likely random choice of one of the segments in a group is used in this example.

Figure 19:
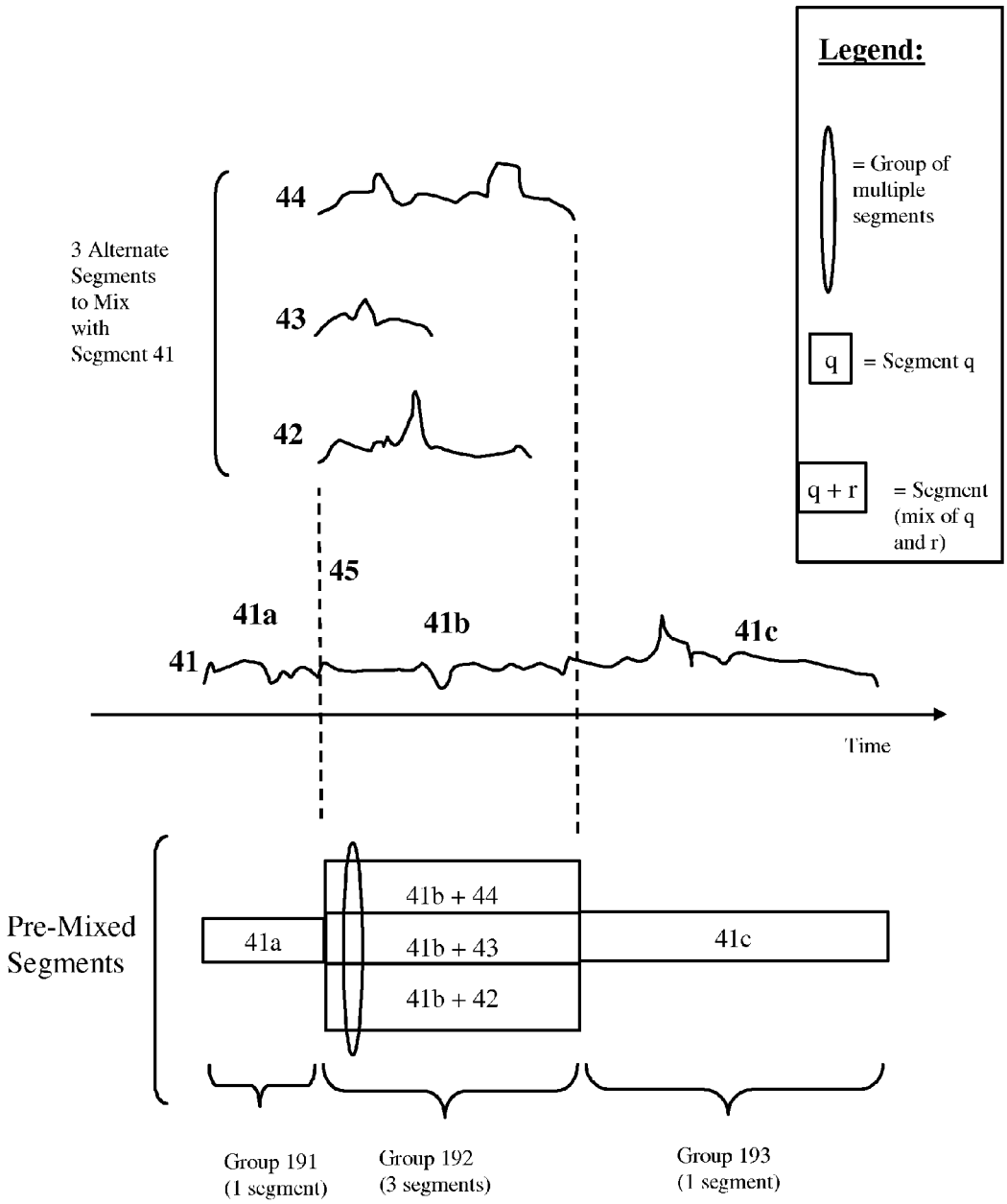
FIG. 19 is a simplified initiation timeline that illustrates an in-the-studio "pre-mix" of the alternative combinations of overlapping segments (creation).

Examples of "Pre-Mixing" Alternative Combinations (Composition Creation):

FIG. 19 is a simplified initiation timeline that illustrates an in-the-studio "pre-mix" of the alternative combinations of overlapping segments (creation). FIG. 19 is a simplified example of defining groups of "pre-mixed" segments. The starting data is shown in FIG. 18 and repeated at the top of FIG. 19. In this case, segment 41*b* is mixed with segment 42 and the resulting segment (41*b*+42) in the overlapping area, is saved. Segment 41*b* is mixed with segment 43 and the resulting segment (41*b*+43) in the overlapping area, is saved. Segment 41*b* is mixed with segment 44 and the resulting segment (41*b*+44) in the overlapping area, is saved. Group 192 comprising three segments (41*b*+42), (41*b*+43) and (41*b*+44) in the overlap area) is defined. The artist also defines the selection method to be used to chose among the three segments during playback, in this case, an equally likely random choice of one of the three segments in the group. Group 191 comprising one segment (41*a*) is defined. Group 193 comprising one segment 41*c* is defined. Segments 41*a* is defined to have one initiation definition, which initiates group 192 at the sample immediately following the end of the segment 41*a*. Segments (41*b*+42), (41*b*+43) and (41*b*+44) are each defined to have one initiation definition, which initiates group 193 at the sample immediately following the end of each the segments.

Figure 22:
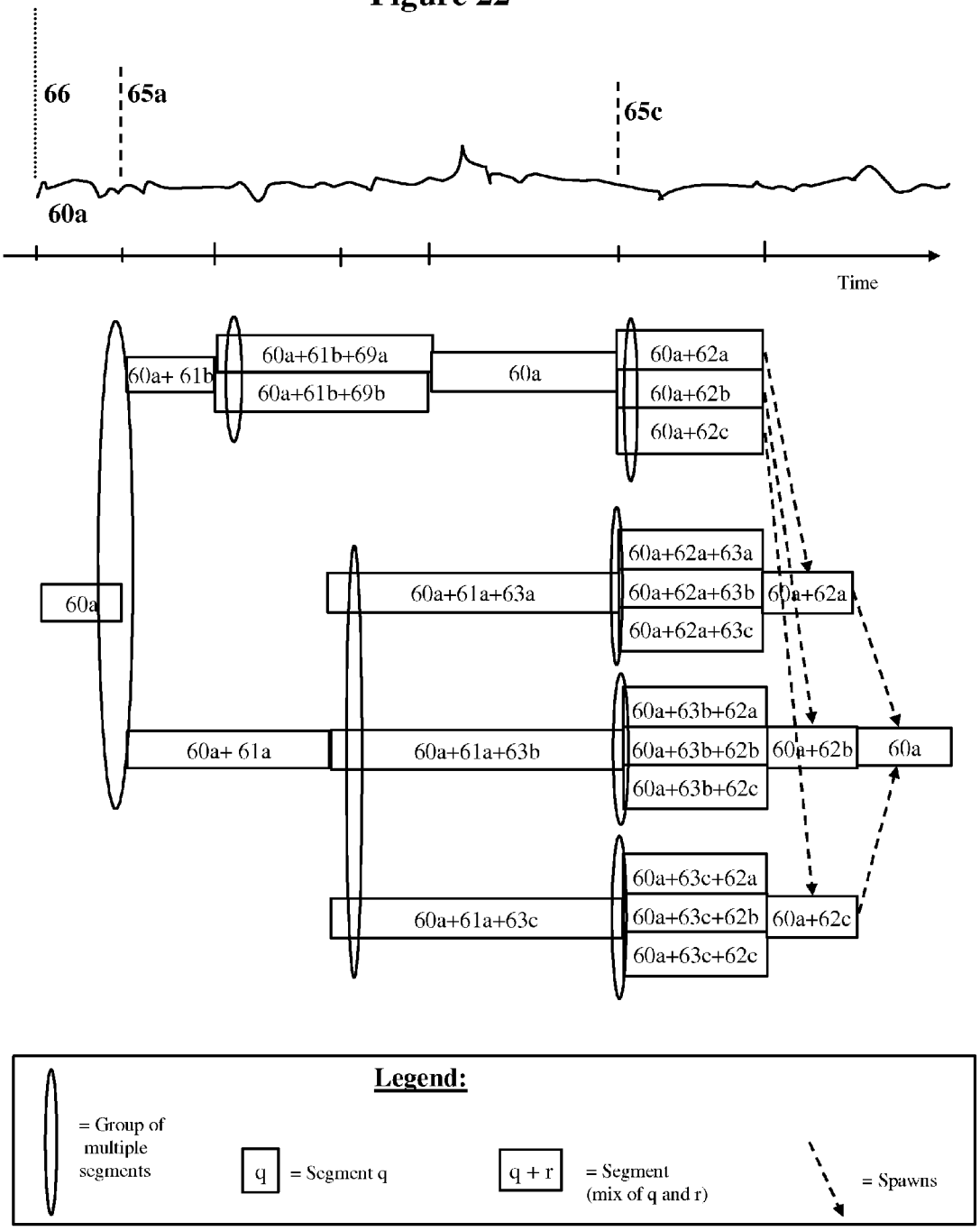
FIG. 22 is a more complicated initiation timeline that illustrates an in-the-studio "pre-mix" of alternative combinations of overlapping segments (creation).

FIG. 22 is a more complicated initiation timeline that illustrates an in-the-studio "pre-mix" of alternative combinations of overlapping segments (creation). FIG. 22 is a more complicated example of defining groups in-order to "pre-mix" the alternative combinations of overlapping segments in the studio. The starting data is shown in FIG. 20 and is partially repeated at the top of FIG. 22 in-order to provide a time reference to the detail on FIG. 20. To simplify the illustration, only the stereo-right channel is illustrated and it is assumed that group 60 contains only segment 60*a*. Note that each segment spawns a "following" group at the sample immediately following the segment. Segments 60*a* also spawns group 64 at the first sample of the segment 60*a*. Initially, only segment 60*a* is used since there is no segment overlap initially in the stereo-right channel. A group comprised of segments (60*a*+61*a*) and (60*a*+61*b*) is defined. Where (60*a*+61*a*) indicates a mix of segment 60*a* and segment 61*a*, for the sliced up time intervals time shown.

Following the upper path when segment 61*b* is assumed to be selected, segment (60*a*+61*b*) then spawns a group comprised of segments (60*a*+61*b*+69*a*) and (60*a*+61*b*+69*b*). Segments (60*a*+61*b*+69*a*) and (60*a*+61*b*+69*b*) are each defined to spawn a group comprised of segment 60*a*. Segment 60*a* is defined to spawn a group comprised of segments (60*a*+62*a*), (60*a*+62*b*) and (60*a*+62*c*). Segment (60*a*+62*a*) is defined to spawn a group comprised of segment (60*a*+62*a*). Segment (60*a*+62*b*) is defined to spawn a group comprised of segment (60*a*+62*b*). Segment (60*a*+62*c*) is defined to spawn a group comprised of segment (60*a*+62*c*). Finally, segments (60*a*+62*a*), (60*a*+62*b*) and (60*a*+62*c*) are each defined to spawn a group comprised of segment 60*a*.

Following the lower path when segment 61*a* is assumed to be selected, segment (60*a*+61*a*) then spawns a group comprised of segments (60*a*+61*a*+63*a*), (60*a*+61*a*+63*b*) and (60*a*+61*a*+63*c*). Segment (60*a*+61*a*+63*a*) then spawns a group comprised of segments (60*a*+62*a*+63*a*), (60*a*+62*a*+63*b*) and (60*a*+62*a*+63*c*). Each of the segments (60*a*+62*a*+63*a*), (60*a*+62*a*+63*b*) and (60*a*+62*a*+63*c*) then spawns a group comprised of segment (60*a*+62*a*). Segment (60*a*+62*a*) then spawns a group comprised of segment 60*a*. The spawning continues in a similar manner for the rest of the lower path shown in FIG. 22.

Notice that the number of pre-mixed segments increases exponentially with the number of overlapping alternate segments. For example, if groups 62 and 63 had each had 7 alternative segments (instead of 3), then 49 (=7×7) pre-mixed segments would have been created; instead of only 9 (=3×3).

Comparison of "Playback Mixing" versus "Pre-Mixing" of Segments:

The advantages of real-time "playback mixing" (relative to "pre-mixing") include:

A significantly smaller composition data size for compositions with many overlapping groups of alternatives. Consider a composition with 4 different simultaneously overlapping groups of segments with 5 segments in each group. With "playback mixing", the composition data would contain the 20 (=4×5) segments in the overlap region. With "pre-mixing", the composition data would contain 625 (=5×5×5×5) segments representing all the possible combinations of the segments. With "pre-mixing" the amount of composition data expands exponentially with the number of simultaneously overlapping groups and the number of segments in each group.

Ability to create additional variability by performing special effects processing (to alter one or more segments) during playback but prior to playback mixing of the segments.

The disadvantages of real-time "playback mixing" include a significant increase in playback processing and the difficulties of performing the mixing in real-time during playback.

The advantages of "pre-mixing" (relative to "playback mixing") include:

Simpler and reduced playback processing. Requires less playback processor capability. Easier to pipeline (stream).

Easier to assure quality since all mixing may be done in the studio. Playback may be just variably selecting and combining segments in time.

Reasonable when there are a small number of simultaneously overlapping groups and the number of segments in each group may be small.

Note that due to their generality and flexibility, either or both of these playback strategies may be used in various embodiments. In some embodiments, either one of the strategies may be used. In some embodiments, a composition may simultaneously use both strategies.

Playback Combining and Mixing Considerations:

For some applications, it may be desirable that the music quality after playback combining and mixing may be comparable-to or better-than the "static" compositions typical of today's recording industry. The sound segments provided in the composition data set and used for playback combining and mixing may be frequency-equalized and appropriately pre-scaled relative to each other in the studio. In addition, where special effects processing is performed on a segment during playback before it is used, additional equalization and scaling may be performed on each segment to set an appropriate level before it is combined or mixed during playback. To prevent loss of quality due to clipping or compression, the digital mixing bus may have sufficient extra bits of range to prevent digital overflow during digital mixing. To preserve quality, dithering (adding in random noise at the at the appropriate bit level) may used during "playback mixing", in a manner similar to today's in-studio mixing. Normalization and/or scaling may also be utilized following combining and/or mixing during playback. Accurate placement of segments relative to each other during payback processing may be critical to the quality of the playback.

Figure 5:
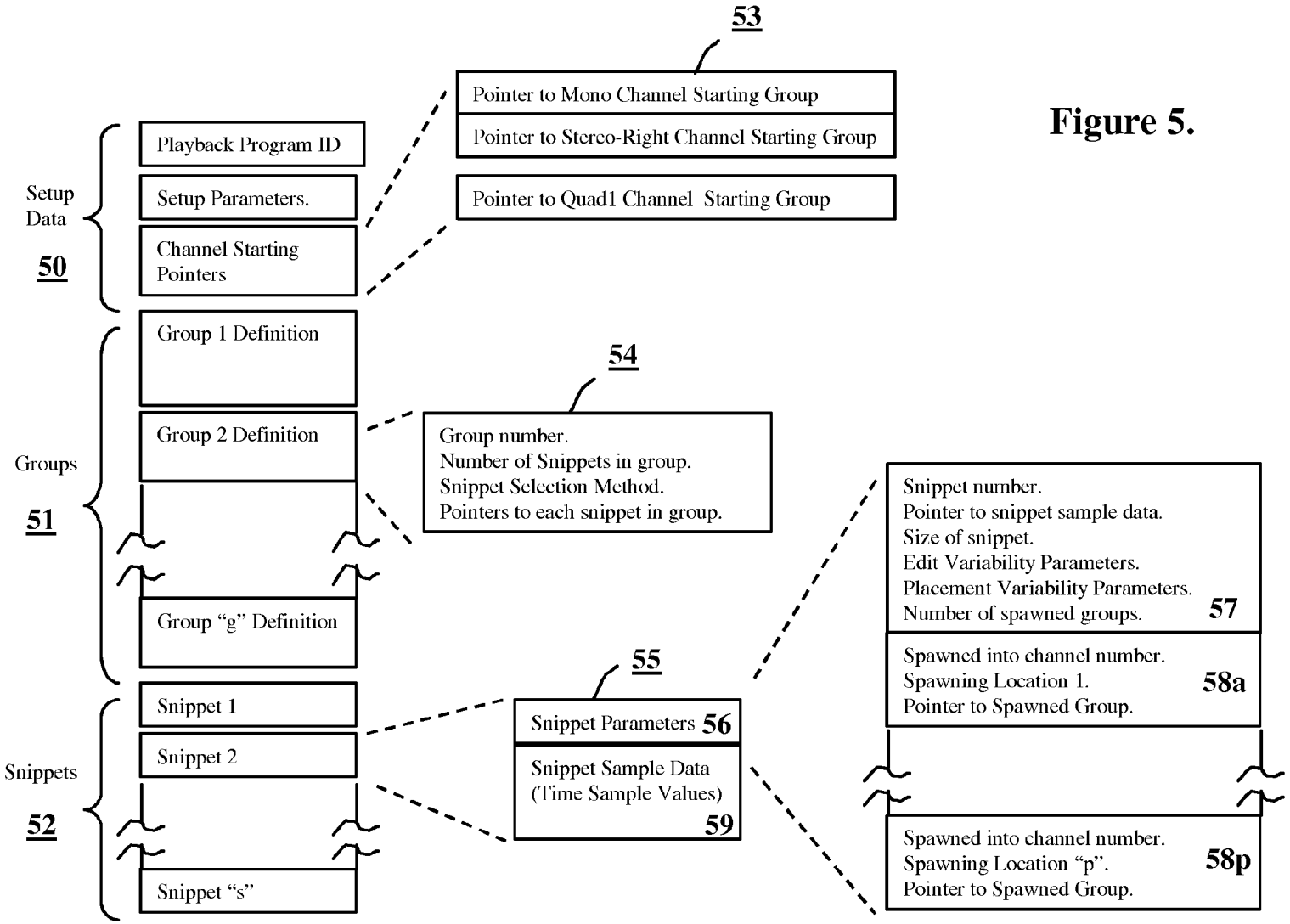
FIG. 5 details a format of the composition data.

Format of Composition Data:

FIG. 5 shows details of a format of the composition data 25. This format is compatible with real-time "playback-mixing". Although a detailed format is presented, those skilled in the art will realize that there are many alternate sets of parameters and arrangements of parameters that may accomplish a similar result and fall within the inventive concepts disclosed herein.

The composition data 25 may have a specific format, which may be compatible-with and processed by a specific playback program(s) 24. The amount of data in the composition data format may differ for each composition but it may be a known fixed amount of data that is defined by the composition creation process 28.

The composition data (e.g., dataset and sound segments) may be a fixed, unchanging, set of digital data (e.g., bits or bytes) that are a digital representation of the artist's composition. In general, the segments and dataset that define a composition may be stored using any type of storage means. The composition data may be stored and distributed on any conventional digital storage mechanism (such as disks, tape or memory). Storage means may include semi-conductor memory; non-volatile semi-conductor memory; floppy-disk; hard-disk drives; removable storage disks; storage media (e.g., CD's, DVD's); network storage devices; network servers and/or any other types of digital storage.

The composition data may also be broadcast through the airwaves or transmitted across networks (such as the Internet). Mechanisms to distribute compositions may also include broadcast; multi-cast; client-server networks; peer-to-peer networks; distributed objects; remote procedure calls; and/or any other means for distributing digital data.

If desired the composition data 25 may be stored in a compressed form by the use of a data compression program. Such compressed data would need to be decompressed prior to being used by the playback program 24.

In-order to allow great flexibility in composition definition, pointers may be used throughout the format structure. A pointer holds the address or location of where the beginning of the data pointed to may be found. Pointers allow specific data to be easily found within packed data elements that have arbitrary lengths. For example, a pointer to a group holds the address or location of where the beginning of a group definition may be found. Those skilled in the art will recognize that a pointer may also include a link; hyperlink; uniform resource locator (URL); uniform resource identifier (URI); or any other method of pointing to the location where the data/information may be found. In some embodiments, the data pointed-to, may be located at and/or distributed from multiple locations across a network (e.g., the Internet).

As shown in FIG. 5, the composition data 25 includes three types of data:

Setup data 50

Groups 51

Snippets 52.

The setup data 50 includes data used to initialize and start playback and playback setup parameters. The setup data 50 includes a playback program ID, setup parameters, channel starting pointers.

The playback program ID indicates the specific playback program and version to be used during playback to process the composition data. This allows the industry to utilize and advance playback programs while maintaining backward compatibility with earlier pseudo-live compositions.

The setup parameters include all those parameters that are used throughout the playback process. The setup parameters include a definition of the channel types that may be created by the composition (for example, mono, stereo, quad, 5.1, etc). Other examples of setup parameters include "max placement variability" and playback pipelining setup parameters (which are discussed later).

The channel starting pointers (shown in block 53) may point to the starting group to be used for the starting channel types (e.g., mono; stereo; quad; 5.1; . . . ). Each playback device may indicate, the specific channel types it desires. The playback program may begin processing the starting group corresponding to the channel types requested by the playback device. For example, for a stereo playback device, the program may begin with the stereo-right channel, starting group. The stereo left channel, starting group may be spawned from the stereo right channel, so that the channels may have the artist desired channel dependency. Note that for the stereo channel example, the playback program may only generate the two stereo channels desired by the playback device (and the mono and quad channels may not be generated). During playback, the unfolding of events in one channel is usually not arbitrary or independent from other channels. Often what is happening in one channel may need to be dependent on what occurs in another channel. Spawning groups into other channels allows cross channel dependency and allows variable complementary channel effects.

The groups 51 include "g" group definitions. Any number of groups may be used and the number used may be unique for each artist's composition. The size of each group definition may be different. If the artist desires, a group may be used multiple times in a chain of spawned snippets. A group may be used in as many different chains of spawned snippets as the artist desires.

Referring to FIG. 5, block 54 details the contents of each group definition. The group definition parameters and their purposes may include:

"Group number" is a group ID.

Number of snippets in the group. Used to identify the end of the snippet pointers.

Snippet selection method. The snippet selection method defines how zero, one or more of the snippets in the group may be selected each time the group is used during playback. The selection method to be used for each group may be defined by the artist. The artist may define that one of the snippets in a group is selected with equal probability (or other probability distribution). Note that artists may define many other methods of selecting segments besides just a random selection of one of the segments in a group. For example, if the artist desires a variable harmony of voices (or a variable combination of instruments) then a choice of "y" of the "z" segments in the group could be used. For example, a random choice of "3" of the "8" segments in the group may be used. Or perhaps a variable, random choice of "1, 2 or 3" of the 8 segments in the group may be used.

Pointers to each snippet in the group. Allows the start of each snippet to be found.

The snippets 52 includes "s" snippets. Any number of snippets may be used and the number used may be unique for each artist's composition. A snippet definition may be any length and each snippet definition may typically have a different length. If the artist desires, the same snippet may be used in different groups of snippets. The total number of snippets (s) needed for a single composition, of several minutes duration, may be quite large (100's to 100,000's or more) depending on the artist's definition (and whether optional pipelining, as described later, may be used).

Block 55 details the contents of each snippet. Each snippet includes snippet parameters 56 and snippet sample data 59. The snippet sample data 59 may be a sequence of time sample values representing a portion of a track, which may be to be combined to form an output channel during playback. Typically, the time samples represent amplitude values at a uniform sampling rate. Note that an artist may optionally define a snippet with time sample values of all zeroes (null), yet the snippet may still spawn groups.

Referring to FIG. 5, the snippet parameters 56 include snippet definition parameters 57 and "p" spawned group definitions (58*a* and 58*p*).

The snippet definition parameters 57 and their purpose may include:

The "snippet number" may be a snippet ID.

The "pointer to the start of data" allows the start of "snippet sample data" to be found.

The "size of snippet" may be used to identify the end of the snippet's sample data.

The "edit variability parameters" may be used to specify special effects editing to be done during playback. Edit variability parameters are used to specify how special effects are to be varyingly applied to the snippet during playback processing. Use of edit variability may be optional for any particular artist's composition. Examples of special effects that may be applied to segments during playback processing include echo effects, reverb effects, amplitude effects, equalization effects, delay effects, pitch shifting, quiver variation, pitch shifting, chorusing, harmony via frequency shifting and arpeggio. Note that, many of the edit variability effects may be alternately accomplished by an artist by using more snippets in each group (where the edit variability processing was done during the creation process and stored as additional snippets to be selected from a group).

The "placement variability parameters" may be used to specify how spawned snippets are placed in a varying way from nominal during playback processing. Placement variability also allows the option of using or not using a snippet in a variable way. Use of placement variability may be optional for any particular artist's composition. Note that, many of the placement variability effects may be alternately accomplished by using more snippets in each group (where the placement variability processing was done during the creation process and stored as additional snippets to be selected from a group).

The number of spawned groups may be used to identify the end of the "p" spawned group definitions.

Each "spawned group definition" (58*a* and 58*p*) may identify the spawn of a group from the current snippet. "Spawn" means to initiate the processing of a specific group and the insertion of one of its processed snippets at a specified location in a specified channel. Each snippet may spawn any number of spawned groups and the number spawned may be unique for each snippet in the artist's composition.

Note that spawning allows the artist to have complete control of the unfolding use of groups in the composition playback.

Because of the use of pointers, there may be no limit to the artist's spawning of snippets from other snippets. The parameters of the "spawned group definition" (58*a* and 58*p*) and their purpose may include:

The "spawned into channel number" identifies which channel the group may be placed into. This parameter allows snippets in one channel to spawn snippets in any other channel. This allows the artist to control how an effect in one channel may result in a complementary effect in another channel.

The "spawning location" identifies the time location where a spawned snippet may be to be nominally placed.

The "pointer to spawned group" identifies which group of snippets the spawned snippet may come from.

Figure 6:
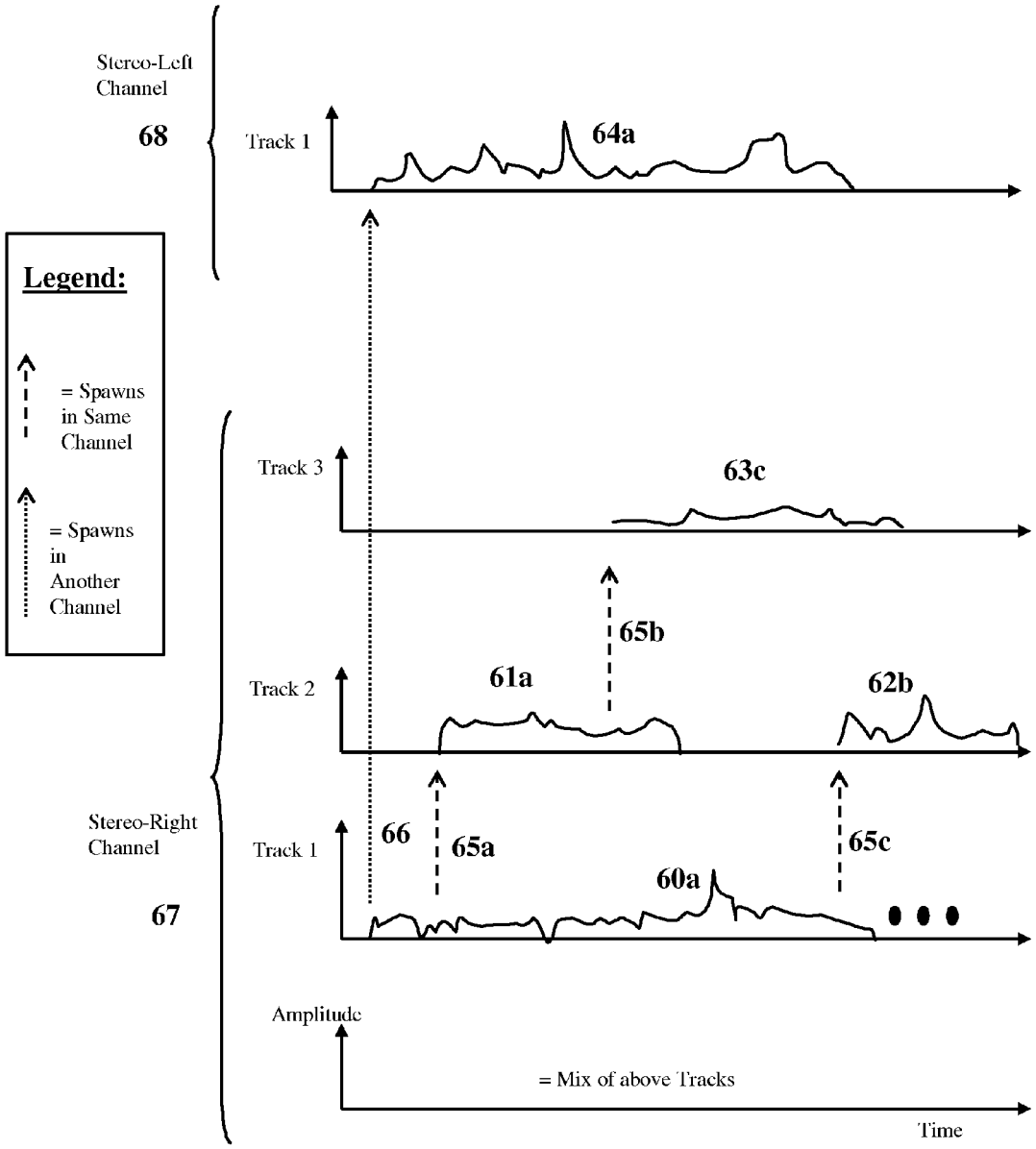
FIG. 6 is an example of the placing and mixing of sound segments during playback processing (playback).

Example of Placing & Mixing Snippets (Playback Processing):

FIG. 6 is an example of the placing and mixing of snippets during playback processing to generate stereo channels. This example is representative of the real-time "playback mixing" of the composition data shown in FIG. 21. This example is intended to illustrate the flexibility available in the spawning of groups and the placement of snippets. It is not intended to be representative of an actual composition. The steps in FIG. 8, blocks 80 through 82, which may be performed before placing a snippet during playback, may include:

The snippet was selected from a group of snippets (80).

The snippet was edited for special effects (81).

The snippet placement variability from nominal was determined (82).

Note that each of these 3 steps may be a source of additional variability that the artist may have chosen to utilize for a given composition. In order to simplify the example, snippet placement variability is not used in FIG. 6.

As shown in FIG. 6, the first snippet 60*a* to be placed, may be selected from the "stereo-right channel starting group" defined in the composition data.

Snippet 60*a* may then spawn two groups in the same channel (stereo-right) at spawning locations 65*a* and 65*c*. Snippet 61*a*, assumed to have been randomly selected from group 61 during this playback, is placed into track 2 on the stereo-right channel at spawning location 65*a*. Similarly, snippet 62*b*, assumed to have been randomly selected from group 62 during this playback, is placed into track 2 on the stereo-right channel at spawning location 65*c*. Track 2 may (optionally) be used for both snippets, since they don't overlap. If these snippets overlapped, then snippet 62*b* would be placed into another track. Snippet 61*a* then spawns group 63 in the stereo-right channel at spawning location 65*b*. Snippet 63*c*, assumed to have been randomly selected from group 63, during this playback, is placed in track 3 of the stereo-right channel at spawning location 65*b*.

Snippet 60*a* also spawned group 64 in the stereo-left channel at spawning location 66. Snippet 64*a*, assumed to have been selected from group 64 during this playback, is placed into track 1 on the stereo-left channel at spawning location 66. This is an example of how a snippet in one channel may spawn snippets in other channels. This allows the artists to control how an effect in one channel may cause a complementary effect in other channels. Note that, snippet 64*a* may then spawn additional snippets for stereo-left and (possibly other channels) but for simplicity this is not shown. Similarly, any (or all) of the other snippets in right-stereo channel could have been defined by the artists to initiate group(s) in the left or right channels, but for simplicity this is not shown. For example, if desired, each snippet in the stereo-right channel may spawn a corresponding group in the stereo-left channel, where each corresponding group contains one segment that is complementary to the stereo-right segment that spawned it.

Once all the snippets have been placed, the tracks for each channel are mixed (i.e., added together) to form the channel time samples representing the sound sequence. In the example of FIG. 6, the stereo-right channel may be generated by the summation of stereo-right tracks 1, 2 and 3 (and any other stereo-right tracks spawned). Similarly, the stereo-left channel may be generated by the summation of stereo-left track 1 (and any other stereo-left tracks spawned). Note that the general capabilities may include:

A snippet may spawn any number of other groups in the same channel.

A snippet in one channel may also spawn any number of groups in other channels. This allows the artist to define complementary channel effects.

Spawned snippets may spawn other snippet groups in an unlimited chain.

The artist may mix together any number of snippets to form each channel.

The spawning location may be located anywhere within a snippet, anywhere relative to a snippet or anywhere within the composition. This provides great flexibility in placing snippets. We are not limited to simple concatenations of snippets.

Any number of channels may be accommodated (for example, mono, stereo or quad).

The spawning definitions may be included in the parameters defining each snippet (see FIG. 5).

Figure 7:
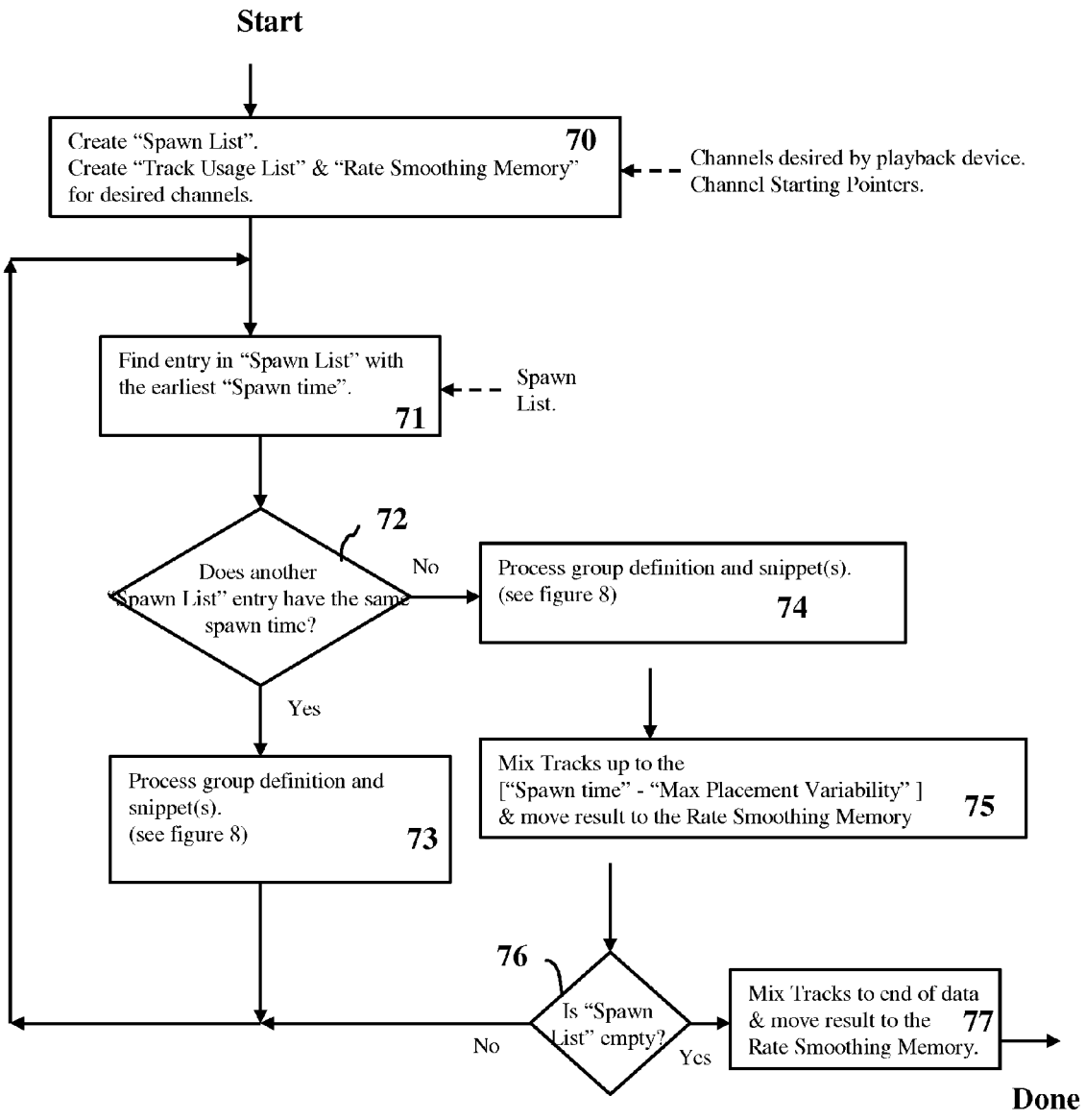
FIG. 7 is a flow diagram of the playback program.
Figure 8:
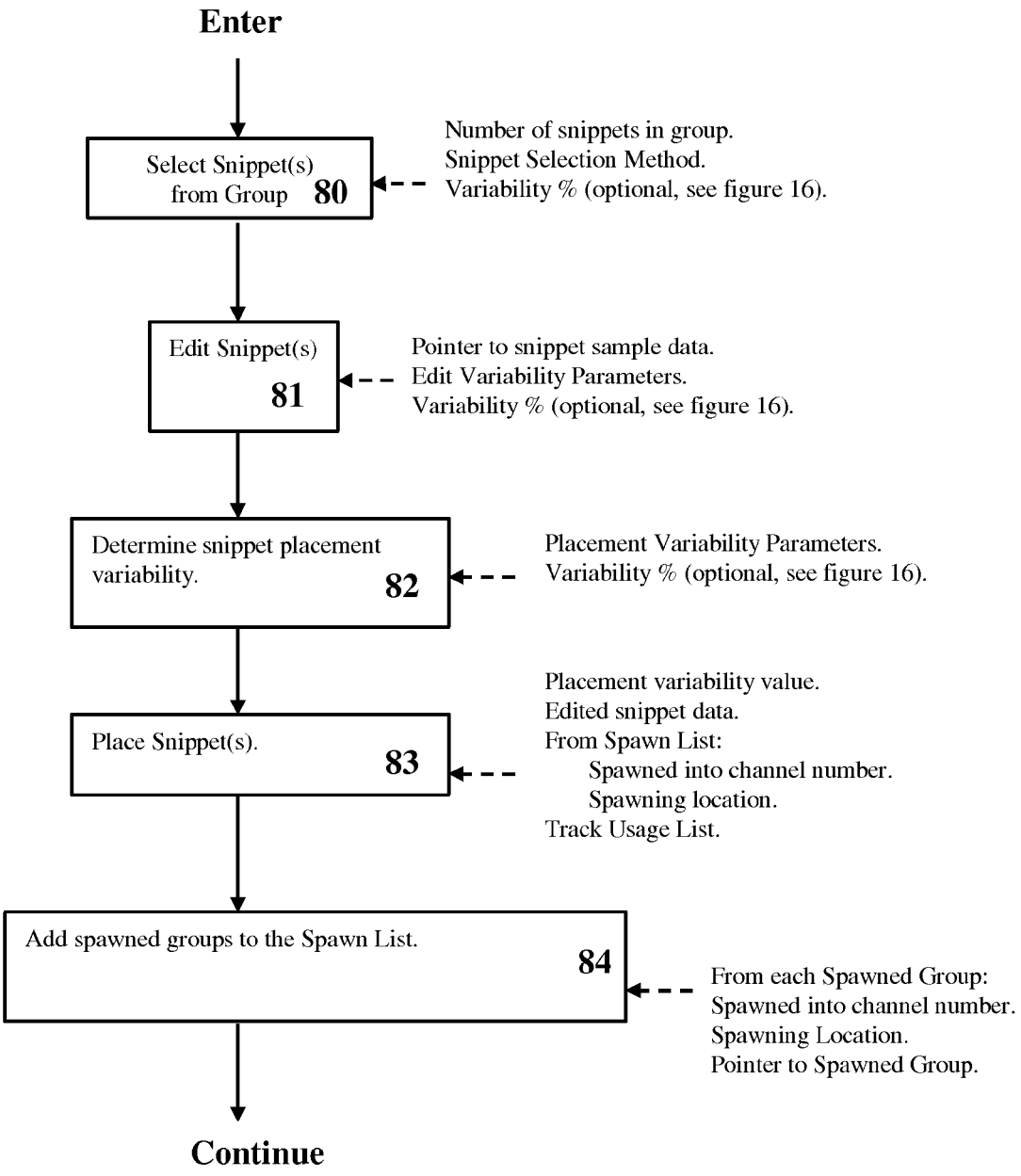
FIG. 8 is a flow diagram of the processing of a group definition and a snippet during playback.

Playback Program Flow Diagram:

A flow diagram of the playback program 24 is shown in FIG. 7. FIG. 8 provides additional detail of the "process group definition and snippet" blocks (73 and 74) of FIG. 7. The playback program processes the composition data 25 so that a different sound sequence may be generated on each playback. Throughout the playback processing, working storage may be utilized to hold intermediate processing results. The working storage elements are detailed in FIG. 9. This playback program may be capable of handling both "pre-mixing" and "playback mixing" approaches and the simultaneous use of both approaches in a composition. If only "pre-mixing" is used, then playback program may be simplified.

Playback processing begins with the initialization block 70 shown in FIG. 7. A "Track Usage List" and a "Rate smoothing memory" are created for each of the channels desired by the playback device. For example, if the playback device is a stereo device, then a "track usage list" (90*a* & 90*b*) and "rate smoothing memory" (91*a* & 91*b*) are created for both the stereo-right and stereo-left channels. The entries in these data structures are initialized with zero or null data where required. A single "spawn list" 92 may be created to contain the list of spawned groups that may need to be processed. The "spawn list" 92 may be initialized with the "channel starting pointer" corresponding to the channels desired by the playback device. For example, if the playback device is a stereo device then the "spawn list" may be initialized with the "stereo-right starting group" at spawning location 0 (i.e., the start).

The next step 71 is to find the entry in the spawn list with the earliest "spawning location". The group with the earliest spawning location may be always processed first. This assures that earlier parts of the composition are processed before later parts.

Next a decision branch occurs depending on whether there are other "spawn list" entries with the same "spawning location". If there are other entries with the same spawning location then "process group definition and snippet" 73 may be performed followed by accessing another entry in the "spawn list" via step 71.

If there are no other entries with the same spawning location; then "process group definition and snippet" 74 may be performed followed by mixing tracks and moving results to the rate smoothing memory 75. The tracks are mixed up to the "spawn location" minus the "max placement variability", since no following spawned groups may now be placed before this time. The "max placement variability" represents the largest shift in placement before a snippet's nominal spawn location.

Step 75 is followed by a decision branch 76, which checks the "spawn list" to determine if it is empty or whether additional groups still need to be processed. If the "spawn list" still has entries, the "spawn list" may be accessed again via step 71. If the "spawn list" is empty, then all snippets have been placed and step 77 may be performed, which mixes and moves the remaining data in the "track usage list" to the "rate smoothing memory". This concludes the playback of the composition.

Processing a Group Definition & Snippet (Playback Process):

FIG. 8 shows a flow diagram of the "process group definition and snippet" block 74 in FIG. 7, which may be part of the playback process. In FIG. 8, the steps are shown in blocks 80 to 84, while the parameters (from the composition definition or working storage) used in each step are shown to the right of each block.

The first step 80 is to "select snippet(s) from group". The entry into this step, followed the spawning of a group at a spawning location. The selection of zero, one or more snippets from a group may be accomplished by using the number of snippets in the group and the snippet selection method. Both of these parameters were defined by the artist and are in the "group definition" in the "composition data" (FIG. 5). In one embodiment, the "snippet selection method" may be to select any one of the snippets in the group with an equal likelihood. In other embodiments, the artist may utilize other selection methods including a statistical and/or weighted selection. In another embodiment, any subset "x" of the "y" segments in a group may be randomly selected; where "x" is a fixed integer (1; 2; . . . ) that is less than "y". In another embodiment, "x" might vary from playback-to-playback in a range from 0 to "h" segments where "h" is less than or equal to "y". In another embodiment, the selection of "x" segments may be made from only the first "g" segments in the group where "g" may vary but is less than "y". Also note that in some optional embodiments, "y" may also vary with the "Variability %" parameter discussed below.

The "Variability %" parameter, shown in FIG. 8, is associated with an optional enhancement described elsewhere in this specification. Basically, the "Variability %" limits the selection of the snippets to a fraction of the group. For example if the "Variability %" may be set at 60%, then the snippet selection may be limited to the first 60% of the snippets in the group, chosen according to the "snippet selection method". If the "Variability %" is set at 100%, then the snippet may be selected from all of the snippets in the group. If the "Variability %" is set at 0%, then only the first snippet in the group may be used and the composition may default to a fixed unchanging playback. The purpose of "Variability %" and how it's set is explained in a section below.

Once snippet(s) have been selected, the next step 81 is to "edit snippet" with a variable amount of special effects such as echo, reverb, amplitude effects, etc to each snippet. The amount of special effects editing, may vary from playback to playback. The "pointer to snippet sample data" may be used to locate the snippet data, while the "edit variability parameters" specify to the edit subroutine how the variable special effects may be applied to the "snippet sample data". The "Variability %" parameter functions similar to above. If the "Variability %" set to 0%, then no variable special effects editing may be done. If the "Variability %" set to 100%, then the full range of variable special effects editing may be done.

The next step 82 is to "determine snippet placement variability". The "placement variability parameters" are input to a placement variability subroutine to select a variation in placement of the snippet about the nominal spawning location. The placement variability for all snippets should/may be less then the "max placement variability" parameter defined in the setup data. The "Variability %" parameter functions similar to above. If the "Variability %" is set to 0%, then no placement variability may be used. If the "Variability %" is set to 100%, then the full range of placement variability for the snippet may be used.

The next step is to "place snippet" 83 into an open track for a specific channel. The channel may be defined by the "spawned into channel number" shown in the "spawn list" (see FIG. 9). The placement location for the snippet may be equal to the "spawning location" held in the "spawn list" plus the placement variability (if any) determined above. The usage of tracks for each channel may be maintained by the "track usage list" (see FIG. 9). When a snippet is to be placed in the channel, the "track usage list" may be examined for space in existing tracks. If space is not available in an existing track, another track may be added to the "track usage list" and the snippet sample values are placed there.

The next step is to "add spawned groups to the spawn list" 84. The parameters in each of the spawned group definitions (58*a*, 58*p*) for the snippet are placed into the "spawn list". The "spawn list" contains the list of spawned groups that still need to be processed.

Working Storage (Playback Process):

FIG. 9 shows the working storage data structures which hold intermediate processing results during the playback processing. FIG. 9 shows an example for a playback device with stereo channels. The data structures may include:

A "track usage list" (90*a* & 90*b*) for each channel desired by the playback device. The "track usage list" includes multiple rows of track data corresponding to the edited snippets that have been placed in time. Each row includes a "last sample # placed" to identify the next open space available in each track. A snippet may be placed into an open space in an existing track. When no space is available in the existing tracks, an additional track may be added to the list. The "track usage list" corresponds to the placement of edited snippets as shown in FIG. 6.

A "rate smoothing memory" (91*a* & 91*b*) for each channel desired by the playback device. Mixed sound samples in time order are placed into the rate-smoothing memory in non-uniform bursts by the playback program. The output side of the rate-smoothing memory, is able to feed samples to the DAC & audio system at a uniform sampling rate.

A single "spawn list" 92 used for all channels. The "spawn list" 92 holds the list of spawned groups that still need to be processed. The entry in the "spawn list" with the earliest spawning location may be always processed first. This assures that groups that effect the earlier portion of a composition are processed first.

Figure 10:
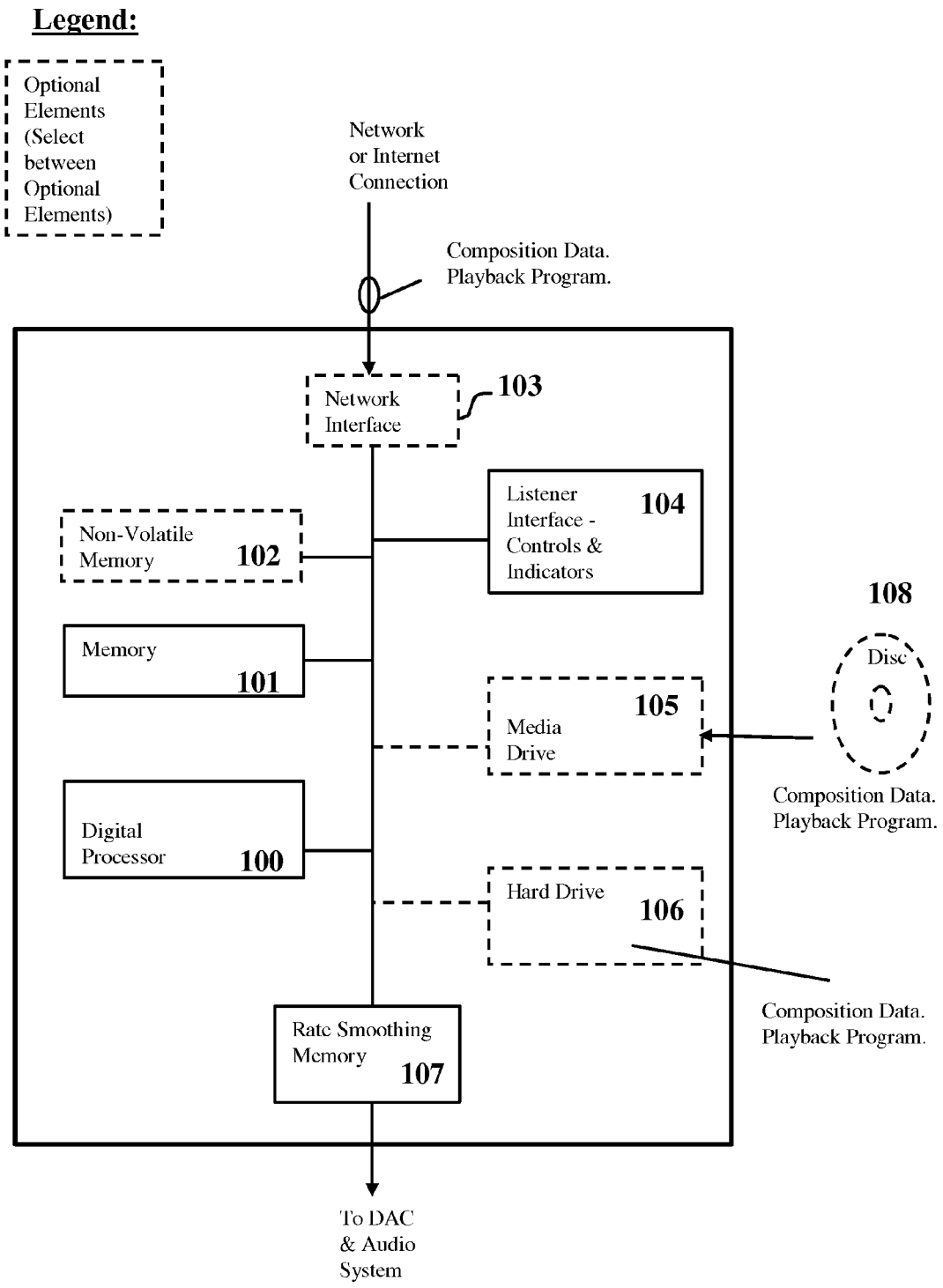
FIG. 10 is a hardware block diagram of a pseudo-live playback device.

Block Diagram of a Pseudo-Live Playback Device:

FIG. 10 shows an embodiment of a pseudo-live playback device. Each time an artist's composition is played back by the device, a unique version is generated. The playback device may be made portable and mobile if desired.

The basic elements are the digital processor 100 and the memory 101. The digital processor 100 incorporates and executes the playback program to process the composition data to generate a unique sequence of sound samples. The memory 101 may hold portions of the composition data, playback program code and working storage. The working storage includes the intermediate parameters, lists and tables (see FIG. 9) created by the playback program during the playback.

The digital processor 100 may be implemented with any digital processing hardware such as Digital processors, Central Processing Units (CPU), Digital Signal Processors (DSP), state machines, controllers, micro-controllers, Integrated Circuits (IC's), Custom Integrated Circuits, Application Specific Integrated Circuits (ASIC's), Programmable Logic Devices (PLD's), Complex Programmable Logic Devices (CPLD's), Field Programmable Gate Arrays (FPGA's), Electronic Re-Programmable Gate-Arrays/Circuitry and any other type of digital logic circuitry/memory.

If the processor is comprised of programmable-circuitry [e.g., electronically re-configurable gate-array/circuitry], the playback program (or portions of the playback program) may be incorporated into the downloadable digital logic configuration of the gate array(s).

The digital processor 100 places the completed sound samples in time order into the rate-smoothing memory 107, typically in non-uniform bursts, as samples are processed by the playback program.

In some embodiments, the digital processor may comprise a plurality of processors in a multi-processing arrangement which may execute the sequences of instructions contained in memory 101.

The memory 101 may be implemented using random access memory (e.g., DRAM, SRAM), registers, register files, flip-flops, integrated circuit storage elements, and storage media such as disc, or even some combination of these.

The output side of the rate-smoothing memory (rate-buffer) 107, is able to feed samples to the DAC (digital to analog converter) & audio system at a uniform (sampling) rate. Sending data into the rate-smoothing memory (e.g., input side of rate buffer) does not interfere with the ability to provide samples (from the output side of the rate buffer) at the desired times (or sampling rate) to the DAC. Possible implementations for the rate-smoothing memory 107 include a first-in first-out (FIFO) memory, a double buffer, or a rolling buffer located within the memory 101 or even some combination of these. There may be a single rate-smoothing memory dedicated to each audio output channel or the samples for the n channels may be time interleaved within a single rate-smoothing memory.

The music player includes listener interface controls and indicators 104. Besides the usual audio type controls, there may optionally be a dial or slider type control for playback variability. This control would allow the listener to adjust the playback variability % from 0% (no variability=artist defined fixed playback) to the 100% (=maximum level of variability defined by the artist). See FIG. 16 for additional details.

The playback device may optionally include a media drive 105 to allow both composition data and playback programs to be read from disc media 108 (or digital tape, etc). For the listener, operation of the playback device would be similar to that of a compact disc player except that each time an artist's composition is played back, a unique version may be generated rather then the same version every time.

The playback device may optionally include a network interface 103 to allow access to the Internet, other networks or mobile type networks. This would allow composition data and the corresponding playback programs to be downloaded when requested by the user.

The playback device may optionally include a hard drive 106 or other mass storage device. This would allow composition data and the corresponding playback programs to be stored locally for later playback.

The playback device may optionally include a non-volatile memory to store boot-up data and other data locally.

The DAC (digital to analog converter) translates the digital representation of the composition's time samples into analog signals that are compatible with any conventional audio system such as audio amplifiers, equalizers and speakers. A separate DAC may be dedicated to each audio output channel.

In some embodiments, hard-wired circuitry and/or programmable-circuitry may be used in place of or in combination with software instructions. Thus, embodiments are not limited to any specific combination of hardware circuitry and software/firmware.

The processor software, machine-language executable instructions, machine-interpretable instructions, firmware, and/or the configuration-data base of electronically-configurable-circuitry: may be stored on/in one or more computer-readable medium/media, and/or one or more digital storage memories.

Depending on the embodiment, the computer-readable medium may include: nonvolatile media, volatile media, and transmission media. Nonvolatile media include, for example, optical or magnetic disks, such as media drive 105. Volatile media include dynamic memory (e.g., DRAM), such as main memory 101. Transmission media include coaxial cables, copper wire, and fiber optics, including the wires that comprise an interface/communications bus. Transmission media can also take the form of acoustic or light waves, such as those generated during radio frequency (RF) and infrared (IR) data communications.

In some embodiments, the computer-readable media may include: floppy disk, a flexible disk, hard disk, magnetic tape, any other type of magnetic medium; Compact Disk (CD), CD-ROM, CD-RAM, CD-R, CD-RW, DVD, DVD+-R, DVD+-RW, DVD-RAM, and any other type of optical medium; punch cards, paper tape, any other physical medium with patterns of holes; RAM, DRAM, SRAM, PROM, EPROM, EEPROM, Flash-memory, FLASH EPROM, and any other type of memory chip/cartridge; or any other type of storage or memory from which a processor/computer can obtain its digital contents.

Pseudo-Live Playback Applications:

There are many possible pseudo-live playback applications, besides the Pseudo-Live Playback Device shown in FIG. 10.

Figure 12:
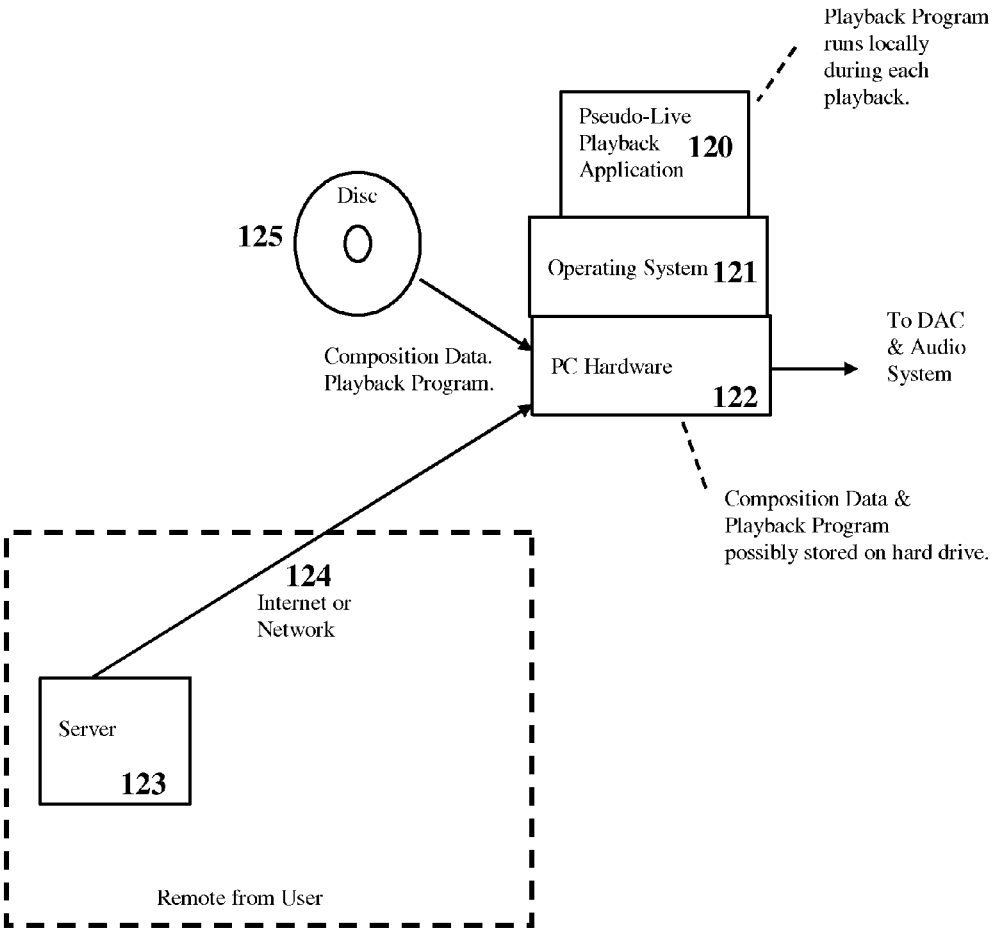
FIG. 12 shows an example of a personal computer (PC) based pseudo-live playback application (playback).

FIG. 12 shows an example of a personal computer (PC) application for playing back pseudo-live music. Here a pseudo-live playback application 120 (software program) sits above the PC operating system 121 and PC hardware 122. The composition data and playback program are provided to the PC via media (such as Disc 125 or Digital Tape) or remotely from a Server 123 over the Internet or network 124. The composition data and playback program may be optionally stored on the PC's hard drive or other media drive. The playback program may be executed locally to generate a unique version of the artist's composition each playback.

Figure 13:
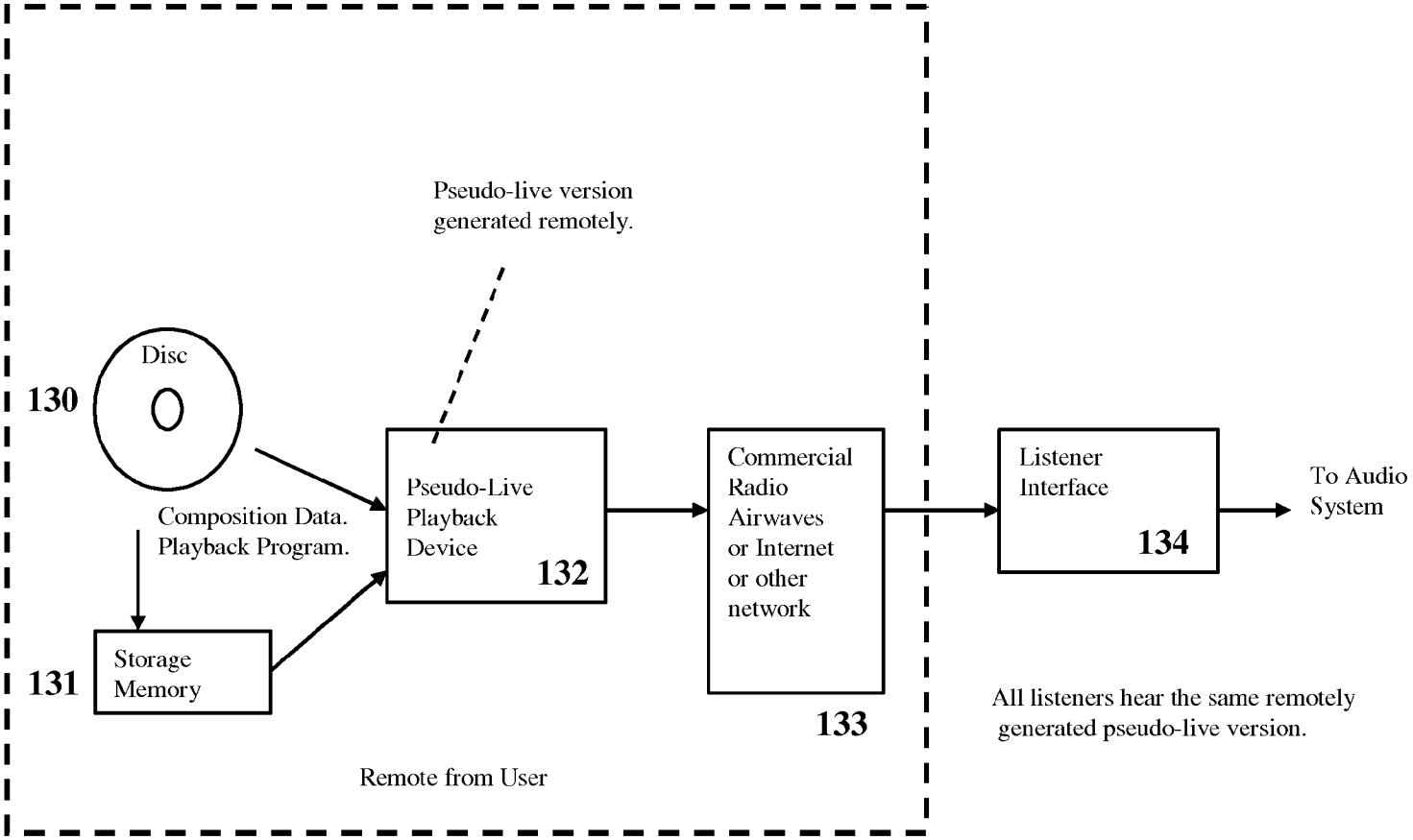
FIG. 13 shows an example of the broadcast of pseudo-live music over the commercial airwaves, Internet or other networks (playback).

FIG. 13 shows an example of the broadcast of pseudo-live music over commercial airwaves (e.g., AM or FM radio), the Internet or other networks 133. A pseudo-live playback device 132 accesses the composition data and playback program from media 130 or a storage memory 131. The playback device 132 generates a unique version of the artist's composition each playback, remotely from the listeners. The information sent to the listener may have the same format as today's static music. The pseudo-live playback version may be captured by a listener's interface function 134 and then sent to the audio system. The pseudo-live music may be generated remotely from the listeners. Note that on each playback, all listeners may hear the same but variable (unique) version of the artist's composition. With this configuration, note that the listener only has access to different playback versions of the composition. Since the listener does not have access to the variable composition itself, it may be protected from listener piracy.

Figure 14:
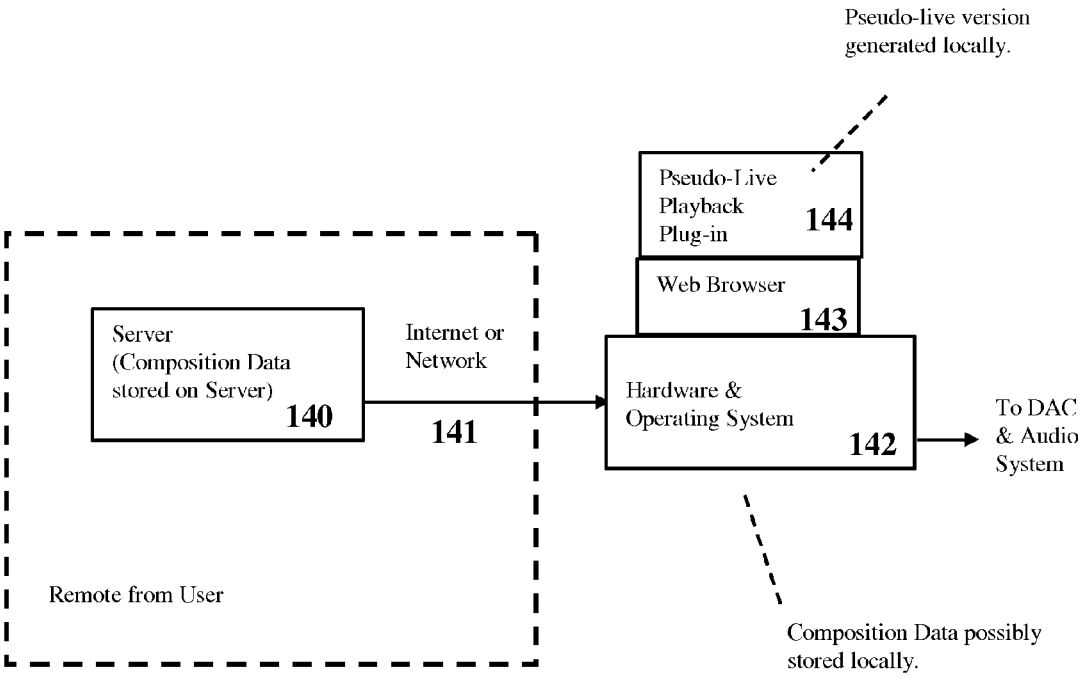
FIG. 14 shows a browser based pseudo-live music service (playback).

FIG. 14 shows an example of a web browser based pseudo-live music service. Composition data may be available remotely on a server 140 and may be sent to the user when requested over the Internet or other network 141. A pseudo-live playback plug-in 144, runs inside the web browser 143. The Web browser 143 runs on top of the hardware and operating system 142. Composition data may be stored locally for playback at a later time. A pseudo-live version may be generated locally each time a composition is played back.

Figure 15:
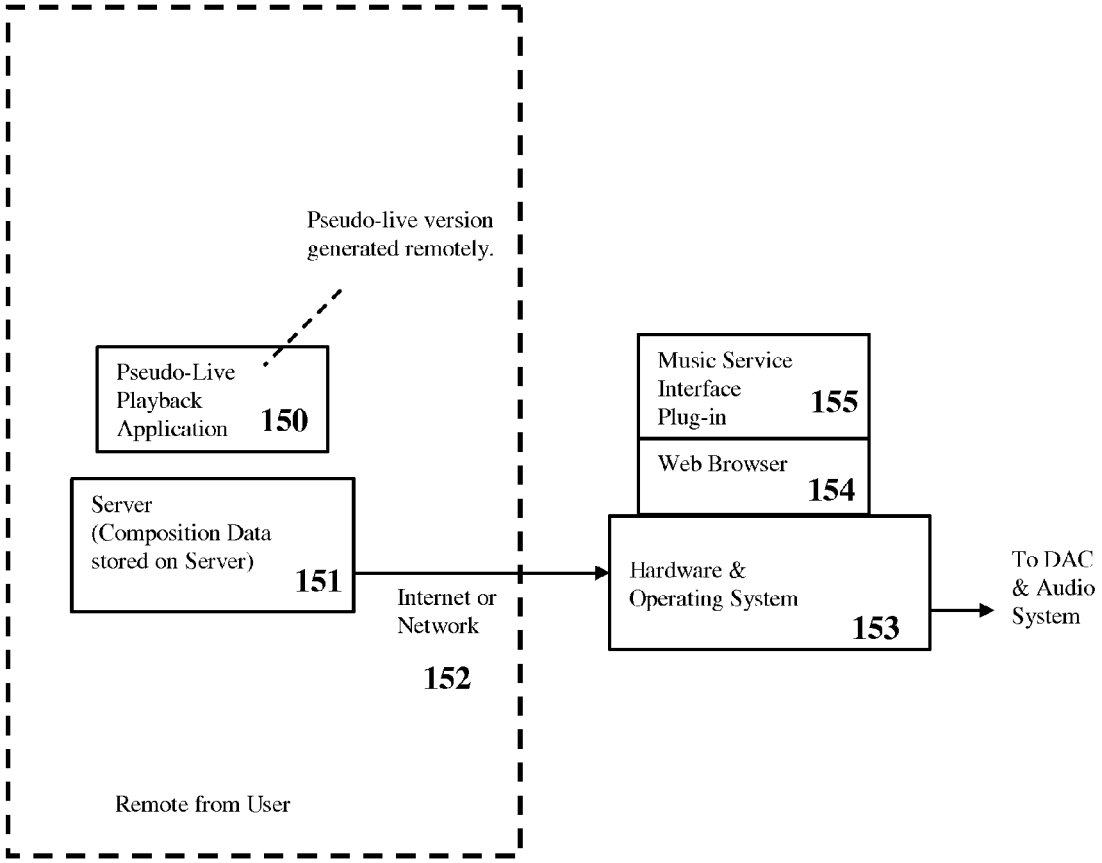
FIG. 15 shows a remote pseudo-live music service via a web browser (playback).

FIG. 15 shows an example of a remote music service via a Web browser. A pseudo-live playback application 150 may be run on a remote server 151 to generate a unique pseudo-live version remotely from the user during playback. The unique playback version may be sent to the listener over the Internet or another network 152. The user selects the desired composition via a music service plug-in 155 that plugs into a Web browser 154. The Web browser runs on top of the hardware and operating system 153. The pseudo-live playback program may be executed remotely from the listener. The listener hears an individualized version of the artist's composition. With this configuration, note that the listener only has access to different playback versions of the composition. Since the listener does not have access to the variable composition itself, it may be protected from listener piracy.

Pipelining to Shorten Delay to Music Start (Optional Playback Enhancement):

In some embodiments, an optional enhancement may allow the music to start sooner by pipelining (i.e., streaming) the playback process. Pipelining is not required but may optionally be used as an enhancement.

Pipelining may be accomplished by partitioning the composition data of FIG. 5 into time intervals. An ordering of the partitioned composition data is shown in the first row of FIG. 11, which illustrates the order that data may be downloaded over a network and initialized in the processor during playback. The data order is:

Playback program 24

Setup data 50

Interval 1 groups & snippets 110

Interval 2 groups & snippets 111

. . . additional interval data . . .

Last Interval groups & snippets 112

Figure 11:
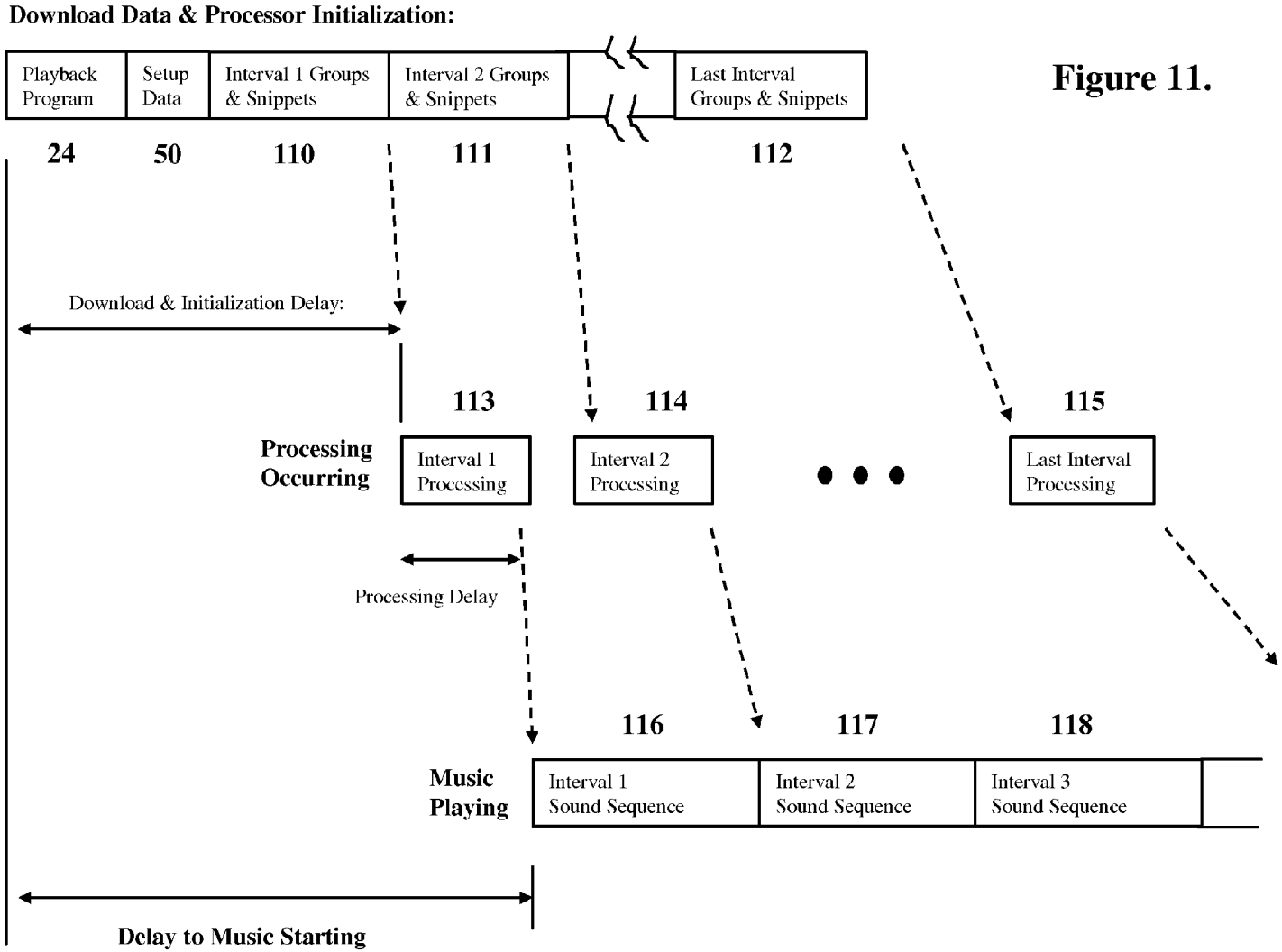
FIG. 11 shows how pipelining may be used to shorten the delay to music start (playback).

Playback processing may begin after interval 1 data is available. Playback processing occurs in bursts as shown in the second row of FIG. 11. As shown in FIG. 11, the start of processing may be delayed by the download and initialization delay. Processing for each interval (113, 114, . . . 115) begins after the data for each interval becomes available.

After the interval 1 processing delay (i.e., the time it takes to process interval 1 data), the music may begin playing. As each interval is processed, the sound sequence data may be placed into an output rate-smoothing memory. This memory allows the interval sound sequence data (116, 117, 118, . . . ) to be provided at a uniform sample rate to the audio system. Note that processing may be completed on all desired channels before beginning processing on the next interval. As shown in FIG. 11, the total delay to music starting may be equal to the download & initialization delay plus the processing delay.

Constraints on the pipelining described above may include:

All groups and snippets that may be needed for an interval should/may be provided before the processing of an interval begins.

The download & initialization time of all intervals following interval 1, should/may be less than the sound sequence time duration of the shortest interval.

The processing delay for all intervals should/may be less than the sound sequence time duration of the shortest interval.

Note that, any chain of snippets may be re-divided into another chain of partitioned shorter length snippets to yield an identical sound sequence. Hence, pipelining may shorten the length of snippets while it increases both the number of snippets and the number of spawned groups used. But note that, the use of pipelining, does not constrain what the artist may accomplish.

Variability Control (Optional Playback Enhancement):

An optional enhancement, not required by the basic embodiment, is a variability control knob or slider on the playback device. The variability may be adjusted by the user from between "none" (0% variability) and "max" (100% variability). At the "none" (0%) setting, all variability would be disabled and playback program may generate only the single default version defined by the artist (i.e., there is no variability from playback to playback). The default version may be generated by always selecting the first snippet in every group and disabling all edit and placement variability. At the "max" (100%) setting, all the variability in the artist's composition may be used by the playback program. At the "max" (100%) setting, snippets are selected from all of the snippets in each group while the full amount of the artist defined edit variability and placement variability are applied. At settings between "none" and "max", a fraction of the artist's defined variability may be used, for example only some of the snippets in a group are used while snippet edit variability and placement variability would be proportionately scaled down. For example if the "Variability %" set to 60%, then the snippet selection may be limited to the first 60% of the snippets in the group, chosen according to the "snippet selection method". Similarly, only 60% of the artist-defined edit-variability and placement-variability may be applied.

Another optional enhancement, not required by the basic embodiment, is an artist's specification of the variability as a function of the number of calendar days since the release of the composition (or the number of times the composition has been played). For example, the artist may define no variability for two months after the release of a composition and then gradually increasing or full variability after that. The same technique, described in the preceding paragraph, to adjust the variability between 0% and 100% could be utilized.

Figure 16:
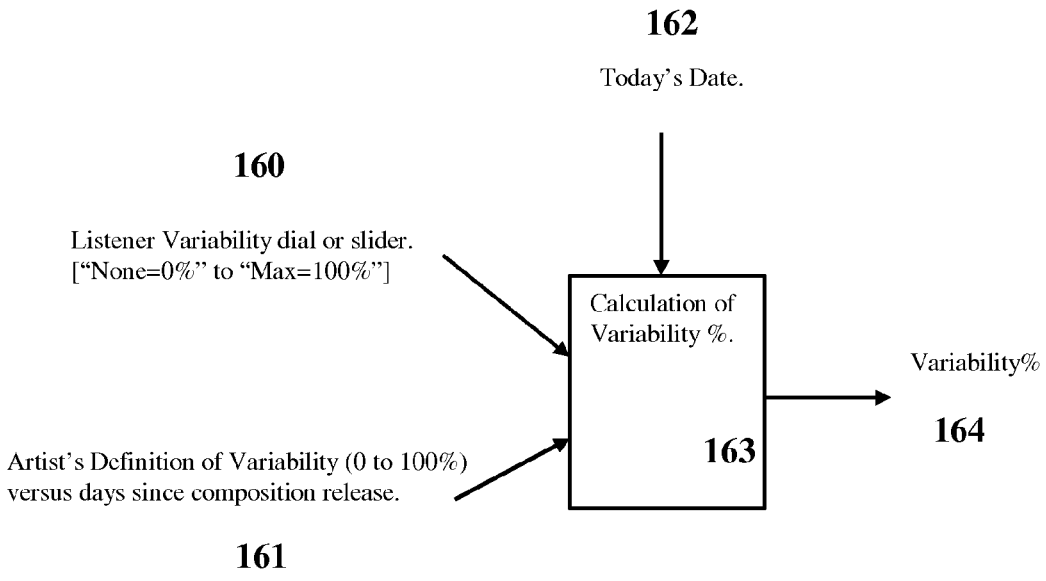
FIG. 16 shows a flow diagram for determining variability % (playback).

FIG. 16 shows a flow diagram for the generation of the Variability %. One input to this process may be an encoded signal representing "none" (0%) to "max" (100%) variability from a listener variability dial or slider 160. Options for the implementation of the knob or slider include a physical control or a mouse/keyboard controlled representation on a graphical user interface. Another input to the process may be the artist's definition of variability versus days since composition release 161. This definition would be included in the setup data fields of the composition data (see FIG. 5). A third input to this process may be Today's date 162. Using these inputs, the "Calculation of Variability %" 163 generates the "Variability %" 164.

Another optional enhancement, not required by the basic embodiment, is an artist's specification of the variability as a function of the number of times that a listener has heard the composition. For example, the artist may define no variability for the first "x" times that the listener hears the composition and then, as the listener becomes more familiar with the composition, gradually increasing to full variability as a function of the number of times the listener has heard the composition. The same technique, described elsewhere, to adjust the variability between 0% and 100% may be utilized. For this embodiment, the playback-device(s) may need to be able to identify different listeners and maintain a record of a listener's playback history.

Another optional enhancement, not required by the basic embodiment, is an artist's specification of the variability as a function of both the number of calendar days since the release of the composition and the number of times that a listener has heard the composition. The same technique, described elsewhere, to adjust the variability between 0% and 100% may be utilized.

Using Sound Segments Defined by a Command Sequence (Such as MIDI):

A sound segment may also be defined in other ways then just digitized samples of sound. For example, a sound segment may also be defined by a sequence of commands to instruments (or software virtual instruments) that may generate a particular sound segment. An example, is a sound segment defined by a sequence of MIDI-type commands to control one or more instruments that may generate the sound sequence. For example, a MIDI-type sequence of commands that generate a piano sound segment. For example, a time sequence of MIDI-type commands for a plurality of instruments (e.g., a time sequence of instrument note parameters) may generate a sound segment containing multiple instruments.

If artists desire, both digitized sound segments and MIDI-type sound segments may be used in the same variable composition. Any fraction of the composition sound segments may be MIDI-type sound segments, from none to all of the segments in the composition. If desired, a group may contain all MIDI-like sound segments or a combination of MIDI-like sound segments and other sound segments.

An advantage of using MIDI-like sound segments may be that the amount of data needed to describe a MIDI-like sound sequence is typically much less than that required for a digitized sampled sound segment. A disadvantage of using a MIDI-like sound segment is that each MIDI-like sequence must be converted into a digitized sound segment or segments before being combined with the other segments forming the variable composition. A more capable playback device may be required since it must also incorporate the virtual MIDI instruments (software) to convert each selected MIDI-like sequence to a digitized sample sound sequence.

MIDI-like segments have the same initiation capabilities as other sound segments. As with other sound segments in a variable composition, each MIDI-like sound segment may have zero, one or more spawning definitions associated with it. Similarly, each spawn definition identifies one group of sound segments and a group insertion time. The spawning of a group and processing of the selected segment(s) occurs in the same manner as with other sound segments. The artists may define a group to be spawned anywhere relative to the MIDI-like sound segment that spawns it (i.e., not limited to spawning just at the MIDI-like segment boundaries). The only difference during playback is that when a MIDI-like sound segment is selected it must first be converted into a digitized sample sound segment before it is combined with the other segments during playback.

The variable composition creation process does not significantly change when MIDI-like segments are used. Many instruments are capable of generating a MIDI or MIDI-like command sequence at an output interface. The MIDI-like sequence reflects what actions the artist performed while playing the instrument. The composition creation software would be capable of capturing these MIDI-like command sequences and able to locate the MIDI-like segments relative to other composition segments. For those instruments that the artist defines, the MIDI-like sequences are captured instead of a digitally sampled sound segment. There may be means for visually indicating where each MIDI-like segment is located relative to other composition segments. The playback alternatives may be created and defined by the artists in a manner similar to the way other alternative segments are created. The formation of groups for playback occurs in a similar manner. The composition format may be modified to include the MIDI-like (command sequence) sound segments. The playback program would incorporate or access the virtual MIDI instruments (software), so each selected MIDI-like sound segment may be converted into a digitally sample sound segment, during playback, before being combined with other sound segments.

Spawning with MIDI-like Sound Segments:

The spawning of other sound segment(s) and alternative sound segment(s) is not limited to just digitally-sampled sound segments but may be compatible with any type of sound segment definition (i.e., the many different ways of defining a sound sequence). For example, FIG. 27 shows a simplified example of spawning from a sound segment defined as a MIDI-like event sequence of sound generation events. Each sound event may be defined by a set of MIDI-like parameters that control the location, the duration, the amplitude and the parameterized controls of a sound generator (such as a music instrument or tone generator).

A spawn event may be considered to be another event in a MIDI-type sequence of events except a spawn event has slightly different capabilities. A spawn event (definition) may initiate a variable selection of a group of alternative segments. A spawn event may also affect sound segments or MIDI-like sound events or MIDI-like control parameters that occur in the same or other sound channels.

In FIG. 27, a sound segment 273 may be defined by a MIDI-like event sequence. The event sequence may consist of MIDI-like events where each event may be defined by a location, duration & control parameters for an instrument or other sound generator. A MIDI-like event sequence may also contain the spawn of a group (or multiple groups) of segments in the same channel or other channels. In FIG. 27, segment 273 initiates group 274 which consists of two sound segments 271 and 272. A selection method defines a method of variably selecting the segments in group 274 during each playback. A placement location (271*s* and 272*s*, respectively) may be defined for each segment in the group. On later playback, the selected segment(s) and the spawning segment 273 are converted into digitally sampled sound segments and are then combined to produce an output sound sequence that may vary from playback to playback.

A composition may include many different types of sound segment definitions (e.g., digitally sampled or MIDI-like). In general, any type of sound segment definition may spawn one or more other groups, where each group may contain any possible combination of various types of sound segment definitions.

Another optional enhancement is to define a playback-to-playback variability of the MIDI-like parameters (or tone-type parameters) themselves. The value of a MIDI-like parameter (or tone parameter) during a particular playback may be determined by randomly selecting between a group of value(s) or randomly selecting a value within a value range.

Other Optional Playback Enhancements:

Other optional enhancements, not required by the basic embodiment are:

The playback program code may be execution within a security protected virtual machine in order to protect the playback device and its files from corruption caused by the execution of a malicious software program.

In some embodiments, variable inter-segment special effects editing may be performed during playback processing. Inter-segment effects may allow a complementary effect to be applied to multiple related segments. For example, a special-effect in one channel also causes a complementary effect in the other channel(s) or in other segments. An example of inter-channel variability effect is a variable stereo panning effect (right/left channel amplitude shifting). This may be accomplished by the addition of a few parameters into the snippet parameters 56. An inter-segment edit flag would be added to each of the spawned groups 58*a* through 58*p*. When the flag is set, it signals that the selected segment from the group, is to be inter-segment edited with the other spawned groups (58*a*-58*p*) that have the flag set. The inter-segment edit parameters needed by the inter-segment processing subroutine would be added to the edit variability parameters located in block 57.

Encryption methods may be used to protect against the unauthorized use of the artist's snippets.

Disadvantages and how to Overcome:

The left column of the table in FIG. 17A, lists the disadvantages of pseudo-live music compared with the conventional "static" music of today's recording industry. The right column in the table indicates how each of these disadvantages may be overcome with the continuous rapid advancement and decreasing cost of digital technologies.

FIG. 17B shows the amount of exponential improvement that will compound with a (assumed) 50% improvement per year. This is equivalent to a decrease in cost (or a performance increase) of 1.5 times each year. Every 4 years, this would correspond to a 5 times decrease in cost. After 12 years of exponential compounding, there will be a 125 times decrease in cost. After 20 years of exponential compounding, there will be a 3125 times decrease in cost. Hence, the currently higher costs of pseudo-live music, compared with "static" music, may become increasingly smaller and eventually insignificant in the near future.

Many Alternative Implementations, Formats and Playback Programs:

Those knowledgeable in the art will recognize that the inventive scope includes many alternative implementations and composition (parameter) formats and playback programs. Although detail implementations are used to illustrate various embodiments, the inventive concept/scope is not limited to these specific detailed implementations. There are many alternative implementations that accomplish the same result within the inventive concept/scope. In addition, (as previously stated) the creation tools, formats and playback programs are expected to evolve over time with artist demands for enhanced variable playback creative capabilities.

Alternative Spawning Location Definitions:

One example, of many such alternative implementations, is related to the definition of the segment spawn locations. Examples of the alternative approaches to the spawning of segments include:

Embodiment A: Use of a group spawning location along with zero sample filling the segments to the common starting location. This is shown in FIG. 4 and is reflected in the format details of FIG. 5. This is also reflected in many of the other figures, because of the illustrative clarity of showing fewer spawning locations (i.e., only one per group versus one per segment) within a figure. The processing flowcharts (FIGS. 7 and 8) may also be simplified with this embodiment.

Embodiment B: Use of a unique spawn location for each segment in the group. This approach is illustrated in FIG. 24 and is reflected in the format of FIG. 26 (which is a slight modification of FIG. 5). In FIG. 24, spawning snippet 241 is defined to initiate a group 247 consisting of 3 segments (242, 243 and 244) where each segment may have its own unique spawn (placement) location (242*s*, 243*s* and 244*s*, respectively).

A selection method defines how a subset of the segments (242, 243, 244) in group 247 are to be variably selected during later playback. A placement location may be defined for each segment in the group; in-order to indicate where each selected segment may be placed during later playback. During later playback, the segments variably selected from group 247 are combined with segment 241 to form the output sound sequence.

Figure 26:
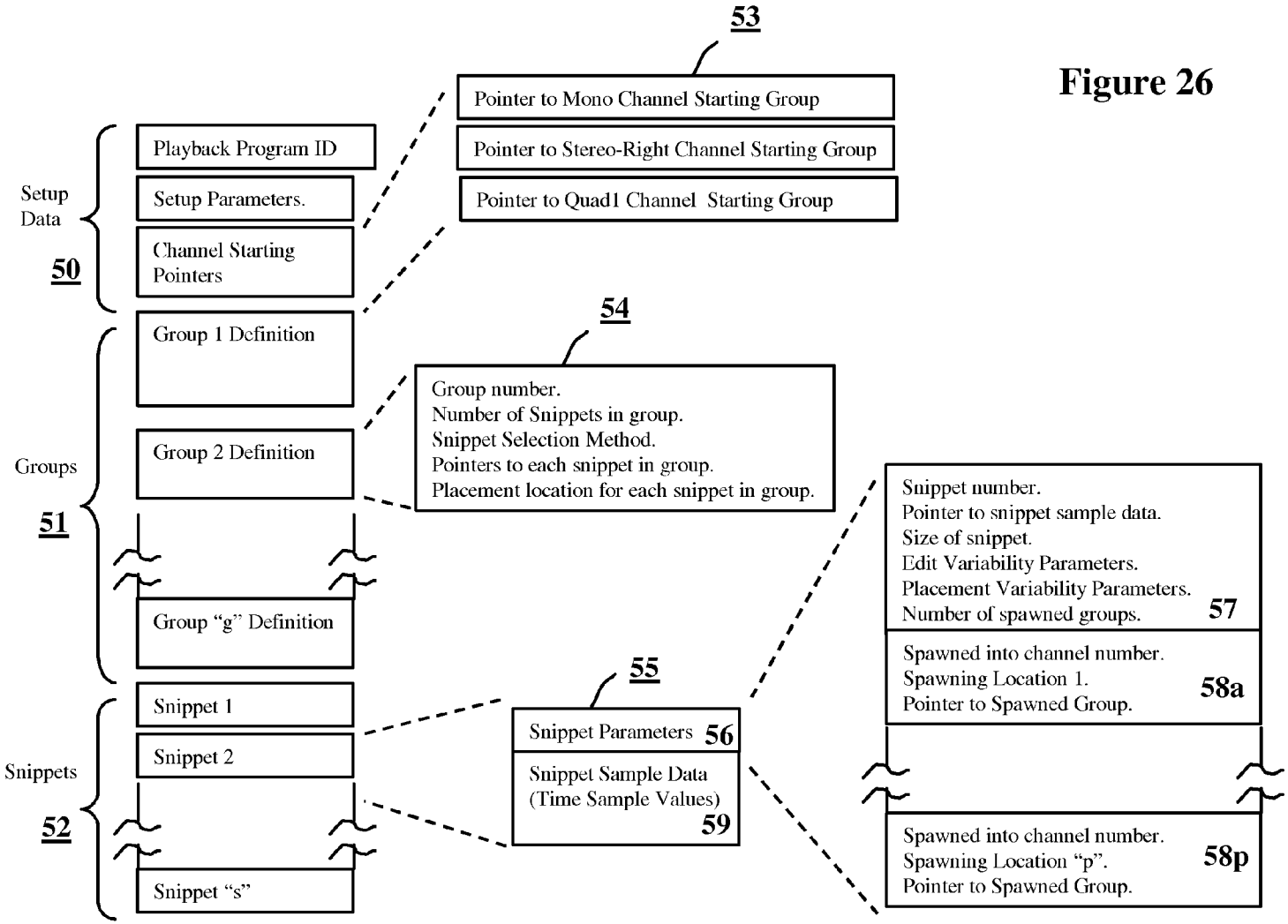
FIG. 26 shows an alternative format that is compatible with each segment having a unique placement location.

As shown in the composition format of FIG. 26, the unique placement location for each segment in the group may be located in the group definition 54. For this embodiment, it may be not necessary to zero fill segments (i.e., including zero sample values at the start of a segment) to a common spawning location and the group spawning location parameter in 58*a* and 58*p* may not be needed.

Embodiment C: In this alternative variation of B, the unique placement locations for each segment in a group may be alternatively located in blocks 58*a* through 58*p*, instead of in the group definition 54 shown in FIG. 26.

Embodiment D: There are many other variations including various combinations of embodiments A, B and C that fall within the inventive concept/scope.

Figure 29:
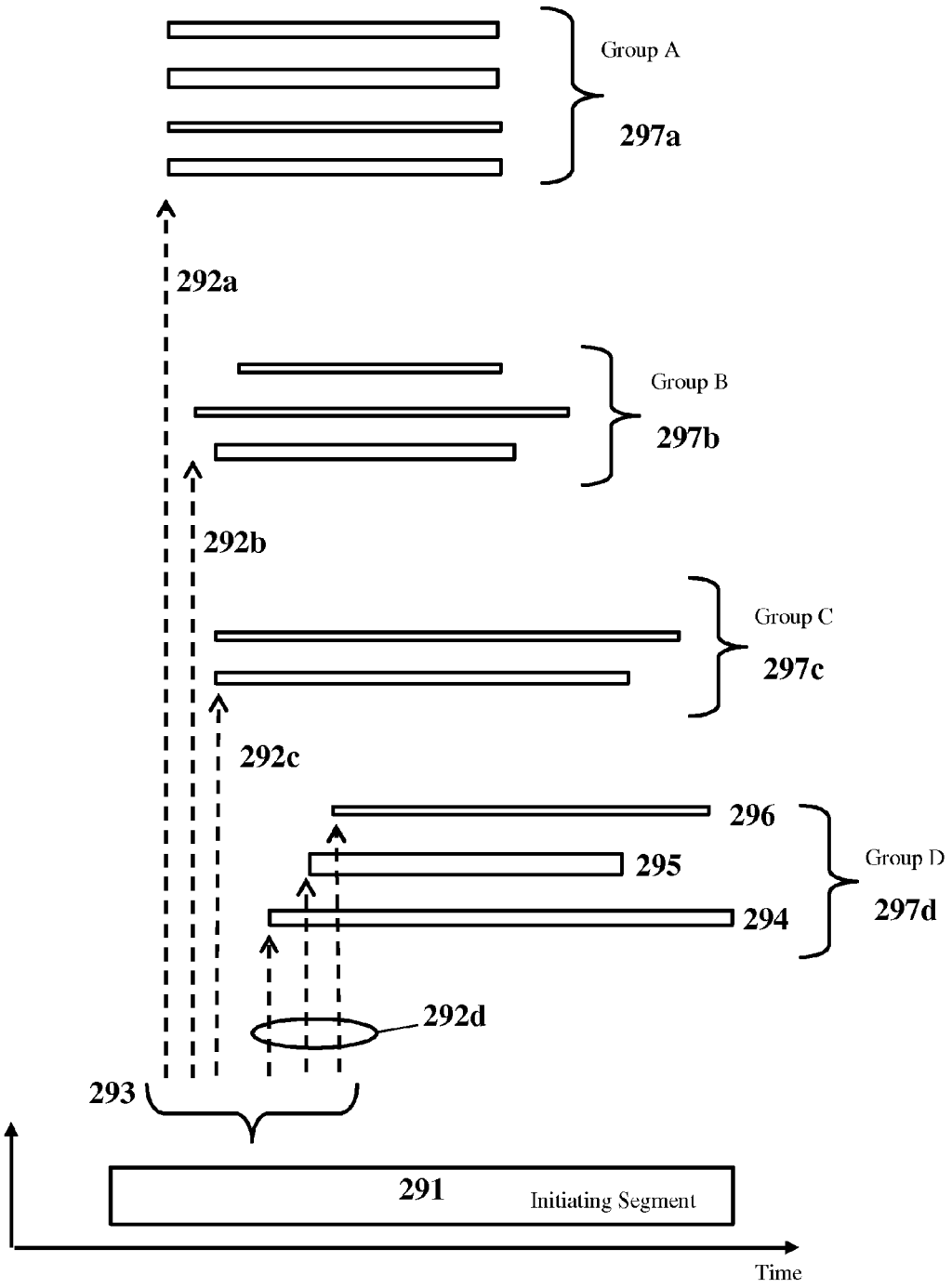
FIG. 29 shows an example of the initiation of alternative-groups that may be variably selected during playback.

An Example of a Variable Four-Part Harmony:

FIG. 29 may be used to illustrate an example of the definition of a variable four-part harmony. This example shows the flexibility and ease of defining this artistic effect. Each of the four parts may be defined to be in a separate group [297*a*; 297*b*; 297*c* and 297*d*]. Alternative segments may be defined for each group where all the segments in a group may be created to act as one part of the four-part harmony. Each segment in a group (e.g., 297*a*) may be created to harmonize with the segments in the other 3 groups [e.g., 297*b*; 297*c* and 297*d*]. During each playback a different segment may be selected from each of the four groups and the four selected segments then combined together to form a four part-harmony that may vary from playback to playback.

In another alternative embodiment, more than one segment may be selected from one or some or all of the groups to create a variable multi-voice four-part harmony.

Variable Selection of Alternative-Groups:

Another optional alternative embodiment may include an initiating segment that initiates the selection of a subset of a defined set of alternative-groups, wherein each group may contain one or more segments.

FIG. 29 shows an example of a variable group-selection from a plurality of alternative-groups. This example may represent a portion of the definition of a larger composition. An initiating (e.g., spanning) segment 291 may initiate a variable group-selection from a plurality of alternative-groups [297*a*; 297*b*; 297*c* and 297*d*] where the selection of the groups may vary from playback to playback. When segment 291 is used, then a variable selection from the alternative-groups may be initiated. The composition format may be defined so that a varying subset of the alternative-groups may be variably selected for use during each playback. For example, a subset "m" of the groups may be variable selected, where during a given playback "m" may be variable selected to be 1; 2; 3, . . . up to the maximum number of groups available. For example, during one playback "m" may be variably (e.g., randomly) selected to be equal to 3 and then 3 of the available groups [297*a*; 297*b*; 297*c* and 297*d*] are then variably selected for use during that playback. On another playback, "m" may be variably (e.g., randomly) selected to be equal to 1 and then only 1 of the available groups [297*a*; 297*b*; 297*c* and 297*d*] are then variably selected for use during that playback.

An alternate-group selection definition may specify how: subsets of the alternate-groups are to be selected during each playback. One or more alternate-group selection-definitions may be incorporated into a modified version of the composition format shown in FIG. 5. In one embodiment, the alternate-group selection-definition(s) may be located within a modified definition of the "snippet parameters" 56 shown in FIG. 5. The number of alternate-group selection-definition(s) and pointers to their locations within the alternate-group selection-definition(s), can be included in the "snippet definition parameters" 57 of the "initiating snippet" (e.g., initiating segment). Each alternate-group selection-definition(s) may also be package within the "snippet parameters" 56 of the initiating segment. Those skilled in the art will recognize may other ways to locate the alternate-group selection-definition(s) within a composition format that can be processed during later playback.

Note that each group may contain one or more segments. Once the alternative-group(s) have been selected during a given playback, the group definitions may then be processed, as discussed elsewhere, to select a subset of the segments from each of the selected groups.

As discussed elsewhere, the segments in each group may utilize a group placement location and/or each segment in a group may have its own unique placement location. As shown in FIG. 29, one spawn location 292*a* may define the placement locations for all segments in a group 297*a*. Alternatively, as also shown in FIG. 29, each segment (e.g., 294; 295; 296) may be defined to have its own placement location 292*d*.

Figure 28:
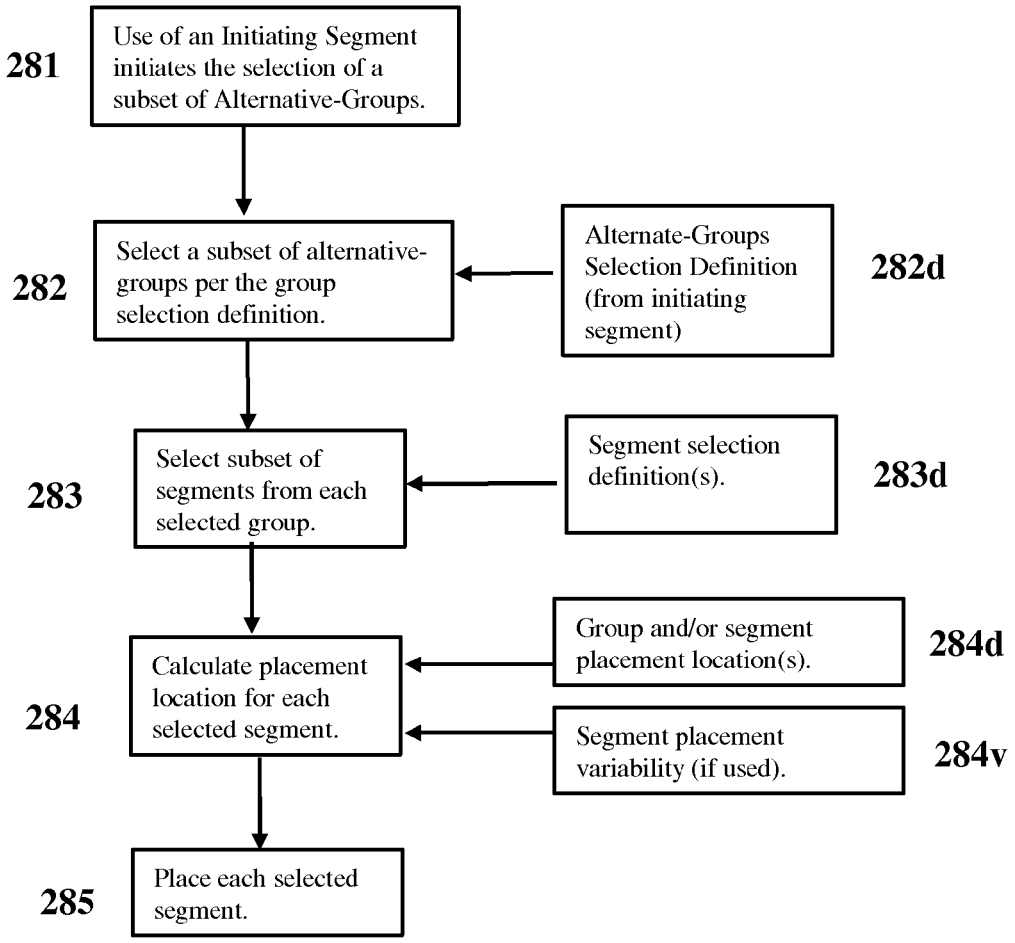
FIG. 28 is a flow diagram showing the variable selection of a segment or segments from multiple groups.

Processing of Alternative-Groups:

Some alternative embodiments may employ alternative-group selection. FIG. 28 shows a flow diagram of the variable selection of segment(s) from multiple groups.

As shown in FIG. 28, the use of an initiating segment (e.g., spawning snippet) initiates the use of a subset of a two or more alternative-groups 281. Then a subset of the groups may be selected 282, as defined in an alternative-groups selection-definition 282*d*. The alternative-groups selection-definition 282*d* may include the selection of "m" of the groups where "m" is an integer that may be a constant for all playbacks; or "m" may vary from playback to playback; and/or a random type of selection; or any other variable selection method. Once the groups are selected during a playback, one or more segments may be selected from each group 283 according to the "segment selection definition(s)" 283*d*. Then, the placement location is determined for each segment 284; using the "group and/or segment placement location(s). In some alternative embodiments, an optional "segment placement variability" 284*v* may also be utilized in segment placement as described elsewhere. Then the "segments are placed" 285 by using the methods discussed in earlier selections.

Formatting into Alternative Fixed Versions:

In another embodiment, a plurality of full length versions may be created in the studio by using pre-mixing. These may be used as optional special case embodiments or may be used in combination with other embodiments. This option may be possible when all the overlaid segments defined in the variable composition are fixed (i.e., do not include any special effects editing during playback) and there is no variable positioning of segments during playback. The creation process of designating and/or overlaying alternative segments to create the mixed segments may be similar to that described for other embodiments.

Figure 25:
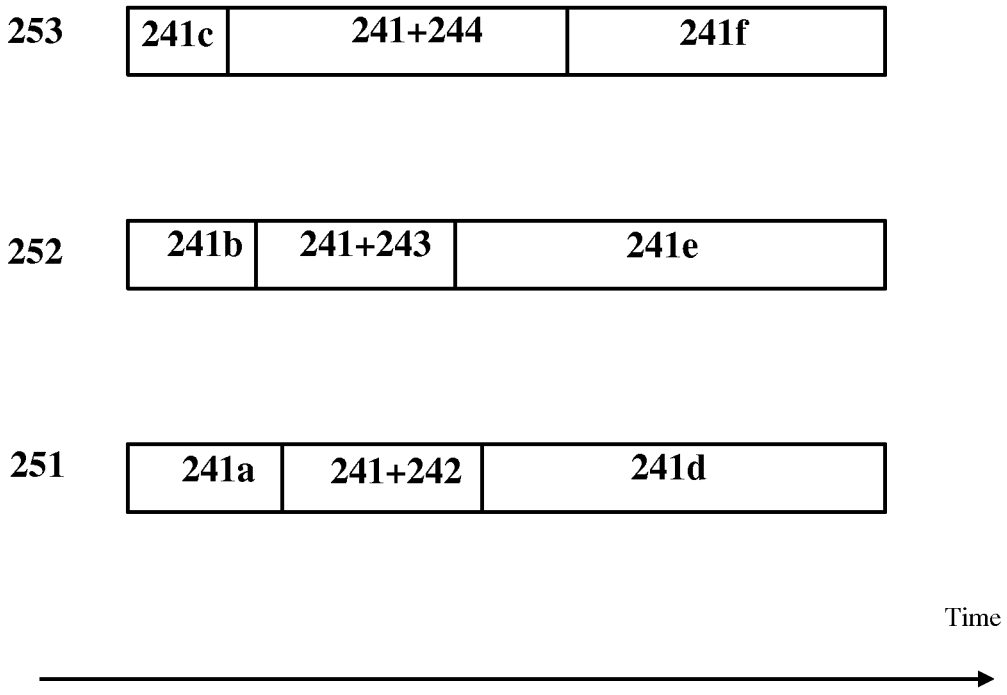
FIG. 25 shows a group of pre-mixed alternative versions (simplified).

FIG. 25 shows how the spawning definition in FIG. 24 may be pre-mixed in the studio to form three versions (251; 252; 253). During later playback, one of these three versions may be selected from the group for playback. If desired each version may be separately stored and one version randomly selected during playback. In this case, playback processing is simplified since only one of the three versions (251; 252; 253) must be variably (e.g., randomly) selected and then used during playback. In general with this embodiment, all the segments may be pre-mixed in the studio to create a plurality of full-length segments; where each of the full-length segments represents a complete alternative version of the variable composition. During each playback, only one of the full-length versions may be automatically: variably (e.g., randomly) selected and played-back for the listener. With this embodiment, the composition size may become impractically large when there are many different versions.

In another embodiment, each of the versions in FIG. 25 may be defined as a listing of the pre-mixed segments in playback order. For example, version 251 in FIG. 25 may be defined as "play segment 241*a*; then play pre-mixed-segment 241+242; then play segment 241*d*". For this simple example, three lists of pre-mixed segments may be defined, one for each version.

In another embodiment, the composition data size may be reduced by noting the common regions that occur in multiple segments and then using start and/or stop pointers to designate sub-segments. For example in FIG. 25, the composition data size may be reduced by noting that segments 241*b* and 241*c* may be defined as a sub-subset of segment 214*a*; by defining stop at-a-sample-numbers in segment 241*a*; to define segments 241*b* and 241*c*. Similarly, segments 241*d* and 241*f* may be defined as a subset of segment 241*e* by defining a start-at-sample-number for each segment. If desired both a start and stop at-a-sample-number may be defined for a segment. By using starts and stops, only the data for five segments (241*a*, 241+242, 241+243, 241+244 and 241*e*) along with the three listings (to define 251; 252; 253) would be needed to playback the three versions shown in FIG. 25.

In another embodiment, FIG. 23 shows how the spawning definition in FIG. 22 may be pre-mixed in the studio; into twelve pre-mixed versions. As above, each version may be defined with a listing of the pre-mixed segment playback order. During later playback, one of these twelve versions may be selected (from the group) for playback. To minimize composition size, segment boundaries may be chosen so the pre-mixed segment sections may be used in many different versions, For example, the same pre-mixed section segment 60*a*+61*a* may be used in 9 different versions, which may reduce the composition data size.

With these embodiments, playback processing may be simpler since the spawning of groups; selection of segments in a group; special effects processing; segment placement; and mixing of segments may be avoided during playback processing. But, a major disadvantage of these embodiments may be a significantly larger composition size, since a listing of the segment sections (or a full composition) may be stored for each variation. The number of versions stored may equal the multiplicative product of the number of selections for each possible group usage. The number of versions grows exponentially and may quickly become impractical. For example, if there are only 10 groups with only 5 possible selections within each group, then the number of versions is 5 to the 10th power (=over 9 million unique versions).

Additional disadvantages of the exclusive usage of pre-mixed embodiments, may include the inability to use variability: from special effects processing before mixing during playback and variable segment placement before mixing during playback; and by not handling MIDI-type segments during playback.

Alternative Uses:

In some optional embodiments, the disclosed concepts may also be optionally used, as a form of data compression, to reduce the amount of composition data by re-using sound segments throughout a playback. For example, the same drum-beat (or any other parts) could be re-used multiple times. The artists may carefully consider the (negative) impact of such re-use on the listener's experience.

Although the above discussion is directed to the creation and playback of music and audio by artists, it may also be easily applied to any other type of sound, audio, non-repetitive background sound, language instruction, sound effects, musical instruments, demo modes for instruments, music videos, videos, multi-media creations, and variable MIDI-like compositions.

General:

Numbered (rather than bulleted) listings of items/elements have been used to allow easier reference to each specific item/element during later patent prosecution/discussions. Such numbering does not necessarily imply that the items/elements must occur in any particular order.

In any specific detailed implementation/embodiment, a subset of the items/elements in a listing may be optionally selected and utilized. For some alternate implementation/embodiments, two or more of the items/elements may be combined and implemented as a single item/element.

To keep the disclosure a reasonable size, the listings of items/elements may not be exhaustive. Those skilled in the art will recognize that there are many other options/elements that may be combined with or added to any such listing of items/elements.

While embodiments have been described using examples that include specific detailed implementations, it should be understood that such terminology is intended to be in the nature of words of description, rather than of limitation. Those familiar with the art will recognize there are many variations, arrangements, formats and alternate implementations and embodiments that may be used.

Obviously, many modifications and variations of the present methods are possible in light of the above teachings. Therefore, within the scope of the claims, the inventive concepts may be practiced otherwise than as specifically described. Therefore, the scope of the invention should be determined by the claims and their legal equivalents.

What is claimed is:

1. Apparatus for generating music or sound, comprising:

a memory or memories that store; a variable playback composition that includes at least a plurality of groups of sound segments, including a first group and a second group; wherein each group is associated with a plurality of alternative sound segments; wherein at least; said first group and said second group, include a plurality of alternative sound segments that include human voices;

a processor or processors that process said variable composition by:

variably selecting, at least one sound segment from said first group and at least one sound segment from said second group; wherein at least one sound segment selected from said first group at least partially overlaps at least one sound segment selected from said second group; wherein different sound segments are selected from one playback to another playback of said variable playback composition;

combining said selected sound segments to generate a sound sequence; wherein said selected sound segments that overlap in time are combined together; and wherein said sound sequence varies from one playback to another playback of said variable playback composition.

2. Apparatus as in claim 1 wherein, during playback, two or more sound segments are selected from one of said groups of sound segments.

3. Apparatus as in claim 1 wherein, during playback, two or more sound segments are selected from each one, of two or more of said groups of sound segments.

4. Apparatus as in claim 1 wherein said sound segments in said first group represent one part of a vocal harmony, and said sound segments in said second group represent another part of said vocal harmony.

5. Apparatus as in claim 1 wherein there are two or more vocal harmony groups; and wherein each vocal harmony group contains alternatives for one part of a two or more part vocal harmony.

6. Apparatus as in claim 1 wherein a number of sound segments selected from one of said groups varies from one playback to another playback.

7. Apparatus as in claim 1 wherein a number of sound segments variably selected from one group is unique from another group or groups, and said number varies from one playback to another playback.

8. Apparatus as in claim 1 wherein, for each of two or more said groups, a different number of sound segments is selected from each group, wherein the number of sound segments selected varies from one playback to another playback.

9. Apparatus as in claim 1 wherein parts of said sound segments that overlap in time are added or mixed together.

10. Apparatus as in claim 1 wherein one or more of said groups are initiated by one or more initiating sound segments.

11. Apparatus as in claim 1 wherein one or more of said sound segments selected from said first or second group, at least partially overlap with an initiating sound segment, and are combined with said initiating sound segment.

12. Apparatus as in claim 1 further including a rate-buffer wherein said processor provides digital samples to an input side of said rate-buffer at a non-uniform rate, while an output side of said rate-buffer provides digital samples to an output sound channel at a substantially uniform rate.

13. Apparatus as in claim 1 wherein a given selected sound segments is utilized at a defined placement location in time.

14. Apparatus as in claim 1 wherein said first group includes alternative sound segments for one voice part; and wherein said second group includes alternative sound segments for a second voice part.

15. Apparatus as in claim 1 wherein at least one selected sound segment overlaps with and is combined with: a foundation sound segment or a baseline sound segment.

16. A method for generating music or sound, comprising:

storing, in a memory or memories, a variable playback composition that includes at least a plurality of groups of sound segments, including a first group and a second group; wherein each group is associated with a plurality of alternative sound segments; wherein at least; said first group and said second group, include a plurality of alternative sound segments that include human voices;

selecting, by processor or processors, at least one sound segment from said first group;

variably selecting, by processor or processors, at least one sound segment from said second group; wherein at least one sound segment selected from said first group at least partially overlaps at least one sound segment selected from said second group; wherein different sound segments are selected from one playback to another playback of said variable playback composition;

combining, by processor or processors, said selected sound segments to generate a sound sequence; wherein said selected sound segments that overlap in time are combined together; and wherein said sound sequence varies from one playback to another playback of said variable playback composition.

17. One or more non-transitory computer-readable memories or storage media, not including carrier-waves, having computer-readable instructions stored thereon which, when executed by one or more processing devices, implement a method for generating music or sound, the method comprising:

storing, in a memory or memories, a variable playback composition that includes at least a plurality of groups of sound segments, including a first group and a second group; wherein each group is associated with a plurality of alternative sound segments; wherein at least; said first group and said second group, include a plurality of alternative sound segments that include human voices;

variably selecting at least one sound segment from said first group; wherein different sound segments are selected from one playback to another playback of said variable playback composition variably selecting at least one sound segment from said second group; wherein at least one sound segment selected from said first group at least partially overlaps at least one sound segment selected from said second group; wherein different sound segments are selected from one playback to another playback of said variable playback composition;

combining said selected sound segments to generate a sound sequence; wherein said selected sound segments that overlap in time are combined together; and wherein said sound sequence varies from one playback to another playback of said variable playback composition.

18. Apparatus as in claim 1 wherein said sound sequence includes a harmony of human voices that varies from one playback to another playback.

19. Apparatus as in claim 1 wherein no action by a user is needed to cause different alternative segments to be selected from said groups, from one playback to another playback of said variable playback composition.

20. Apparatus as in claim 1 wherein no action by a user is needed to cause said sound sequence to vary from one playback to another playback of said variable playback composition.

21. Apparatus as in claim 1 wherein two or more of said sound segments each include different sound recordings.

22. Apparatus as in claim 1 wherein some of said alternative sound segments are sound recordings of alternative human voices.

23. Apparatus as in claim 1 wherein some of said alternative sound segments were:

recorded substantially simultaneously, with an audio playback of a previously recorded sound segment.

24. Apparatus as in claim 1 wherein at least some of said alternative sound segments were created by mixing together tracks, and wherein some of said tracks were recorded substantially simultaneously with creating or listening to other tracks or sound segments.

25. Apparatus as in claim 1 wherein one or more groups of sound segments include alternative recorded sound segments of one or more musical instrument part(s).

* * * * *